US008919332B2

(12) United States Patent
Trpkovski

(10) Patent No.: US 8,919,332 B2
(45) Date of Patent: Dec. 30, 2014

(54) COMPOUND BOW

(71) Applicant: MCP IP, LLC, Sparta, WI (US)

(72) Inventor: Paul Trpkovski, Buffalo, WY (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 13/732,185

(22) Filed: Dec. 31, 2012

(65) Prior Publication Data

US 2013/0118463 A1 May 16, 2013

Related U.S. Application Data

(63) Continuation of application No. 12/496,063, filed on Jul. 1, 2009, now Pat. No. 8,522,762.

(60) Provisional application No. 61/149,900, filed on Feb. 4, 2009, provisional application No. 61/097,899, filed on Sep. 18, 2008, provisional application No. 61/077,928, filed on Jul. 3, 2008.

(51) Int. Cl.

| | |
|---|---|
| ***F41B 5/00*** | (2006.01) |
| ***F41B 5/10*** | (2006.01) |
| ***F41B 5/22*** | (2006.01) |
| *F41B 5/12* | (2006.01) |

(52) U.S. Cl.

CPC ..... *F41B 5/0094* (2013.01); *F41B 5/10* (2013.01); *Y10S 124/90* (2013.01); *F41B 5/105* (2013.01)

USPC ..... 124/23.1; 124/25; 124/25.6; 124/44.5; 124/86; 124/900

(58) Field of Classification Search

CPC ..... A63H 5/00; A63H 5/0094; A63H 5/12; A63H 5/143

USPC ..... 124/23.1, 25.6, 86, 900, 25, 44.5

See application file for complete search history.

(56) References Cited

U.S. PATENT DOCUMENTS

| | | | | |
|---|---|---|---|---|
| 1,192,639 | A * | 7/1916 | Hunholz | 124/25 |
| 1,526,176 | A * | 2/1925 | O'Connell | 124/24.1 |
| 1,689,141 | A * | 10/1928 | Keller | 124/22 |
| 2,786,461 | A * | 3/1957 | Pelsue, Jr. | 124/25 |
| 3,486,495 | A | 12/1969 | Allen | |
| 3,851,638 | A | 12/1974 | Alexander | |
| 3,923,035 | A | 12/1975 | Trotter | |
| 3,945,368 | A | 3/1976 | Jones | |
| 3,958,551 | A | 5/1976 | Ketchum | |
| 3,987,777 | A | 10/1976 | Darlington | |
| 3,993,039 | A | 11/1976 | Groves et al. | |
| 4,027,645 | A * | 6/1977 | Damron | 124/24.1 |
| 4,041,927 | A | 8/1977 | Van House | |
| 4,077,385 | A | 3/1978 | Fredrickson | |

(Continued)

OTHER PUBLICATIONS

Swiss Crossbow Makers, about us; Aug. 24, 2007; 2 pages (from www.archive.org).

(Continued)

*Primary Examiner* — Gene Kim
*Assistant Examiner* — Alexander Niconovich
(74) *Attorney, Agent, or Firm* — Vidas, Arrett & Steinkraus

(57) ABSTRACT

A compound bow comprises at least one limb that extends continuously between opposed rotatable members. In some embodiments, the bow comprises a second limb that extends continuously between the opposed rotatable members. In some embodiments, the limbs are parallel to one another.

18 Claims, 51 Drawing Sheets

(56) References Cited

U.S. PATENT DOCUMENTS

| | | | | | |
|---|---|---|---|---|---|
| 4,086,901 | A | * | 5/1978 | Clement | 124/21 |
| 4,134,383 | A | | 1/1979 | Flood | |
| 4,169,453 | A | | 10/1979 | Hunsicker | |
| 4,201,177 | A | | 5/1980 | Holman et al. | |
| 4,246,883 | A | | 1/1981 | Ash | |
| 4,261,320 | A | | 4/1981 | Barna | |
| 4,290,407 | A | * | 9/1981 | Damron | 124/44.5 |
| 4,291,664 | A | * | 9/1981 | Nishioka | 124/44.5 |
| 4,337,749 | A | | 7/1982 | Barna | |
| 4,343,286 | A | * | 8/1982 | Thacker | 124/24.1 |
| 4,385,618 | A | * | 5/1983 | Nishioka | 124/24.1 |
| 4,388,914 | A | | 6/1983 | Cesin | |
| 4,438,753 | A | | 3/1984 | Simonds | |
| 4,446,844 | A | * | 5/1984 | Nishioka | 124/44.5 |
| 4,458,657 | A | | 7/1984 | Stockmar | |
| 4,461,267 | A | | 7/1984 | Simonds et al. | |
| 4,478,202 | A | | 10/1984 | Anderson | |
| 4,512,326 | A | | 4/1985 | Jarrett | |
| 4,649,891 | A | * | 3/1987 | Bozek | 124/25 |
| 4,651,707 | A | | 3/1987 | Bozek | |
| 4,693,229 | A | * | 9/1987 | Nishioka | 124/44.5 |
| 4,722,317 | A | * | 2/1988 | Hartwig | 124/25.6 |
| 4,766,874 | A | | 8/1988 | Nishioka | |
| 4,827,893 | A | * | 5/1989 | Nishioka | 124/25 |
| 4,903,677 | A | | 2/1990 | Colley et al. | |
| 4,971,020 | A | | 11/1990 | Soderstrom et al. | |
| 5,054,463 | A | | 10/1991 | Colley et al. | |
| 5,062,406 | A | * | 11/1991 | Robertson | 124/25 |
| 5,150,699 | A | | 9/1992 | Boissevain | |
| 5,205,269 | A | | 4/1993 | Guzzetta | |
| 5,353,777 | A | | 10/1994 | Fincher | |
| 5,368,006 | A | | 11/1994 | McPherson | |
| 5,373,831 | A | | 12/1994 | Cushman | |
| 5,381,777 | A | * | 1/1995 | Mitchell et al. | 124/25.6 |
| 5,503,135 | A | | 4/1996 | Bunk | |
| 5,638,804 | A | | 6/1997 | Remick et al. | |
| 5,649,519 | A | * | 7/1997 | Linderman | 124/23.1 |
| 5,657,739 | A | | 8/1997 | Smith | |
| 5,697,355 | A | * | 12/1997 | Schaffer | 124/25.6 |
| 5,720,268 | A | * | 2/1998 | Koltze | 124/25 |
| 5,979,425 | A | | 11/1999 | Loomis | |
| 5,996,566 | A | | 12/1999 | Malan | |
| 6,032,660 | A | | 3/2000 | Hervig | |
| 6,055,974 | A | | 5/2000 | Dieziger | |
| 6,216,681 | B1 | * | 4/2001 | Dougherty et al. | 124/88 |
| 6,267,108 | B1 | * | 7/2001 | McPherson et al. | 124/25 |
| 6,371,098 | B1 | * | 4/2002 | Winther | 124/23.1 |
| 6,651,641 | B1 | * | 11/2003 | Bower et al. | 124/25 |
| 6,698,413 | B1 | * | 3/2004 | Ecklund | 124/25.6 |
| 6,758,204 | B1 | | 7/2004 | Goff et al. | |
| 6,792,931 | B1 | | 9/2004 | Schaar | |
| 7,047,958 | B1 | | 5/2006 | Colley | |
| 7,201,161 | B1 | | 4/2007 | York | |
| 7,204,242 | B2 | * | 4/2007 | Dziekan | 124/25 |
| 7,328,693 | B2 | | 2/2008 | Kempf | |
| 7,347,196 | B1 | | 3/2008 | Shepley, Jr. et al. | |
| 7,363,921 | B2 | | 4/2008 | Kempf | |
| 7,578,289 | B2 | * | 8/2009 | Norkus | 124/25.6 |
| 7,823,572 | B2 | * | 11/2010 | Anderson | 124/25 |
| 8,056,548 | B1 | * | 11/2011 | Larson | 124/89 |
| 8,079,353 | B2 | * | 12/2011 | Davis et al. | 124/23.1 |
| 8,360,044 | B2 | * | 1/2013 | Platt | 124/88 |
| 8,443,791 | B2 | * | 5/2013 | Miller | 124/25.6 |
| 2007/0044782 | A1 | * | 3/2007 | Norkus | 124/25.6 |
| 2007/0101980 | A1 | * | 5/2007 | Sims et al. | 124/25.6 |
| 2007/0104980 | A1 | | 5/2007 | Kim et al. | |
| 2009/0101126 | A1 | * | 4/2009 | Anderson | 124/25 |
| 2010/0000504 | A1 | * | 1/2010 | Trpkovski | 124/25.6 |
| 2011/0056467 | A1 | * | 3/2011 | Popov et al. | 124/25.6 |
| 2011/0203563 | A1 | * | 8/2011 | Platt | 124/88 |
| 2012/0298087 | A1 | * | 11/2012 | Trpkovski | 124/25 |

OTHER PUBLICATIONS

Swiss Crossbow Makers, The Original Twinbow II® Join a new era!, precision; Feb. 23, 2008; 2 pages (from www.archive.org).

Swiss Crossbow Makers, Member of Archery Trade Association (ATA); Apr. 13, 2008; 1 page (from www.archive.org).

Swiss Crossbow Makers, The Original Twinbow II® Join a new era!, 3 seconds; Feb. 23, 2008; 1 page (from www.archive.org).

Swiss Crossbow Makers, The Original Twinbow II® Join a new era!, 370 FpS; Jul. 29, 2007; 1 page (from www.archive.org).

Swiss Crossbow Makers, The Original Twinbow II® Join a new era!, extremely quiet—no recoil! Brochure; Published prior to the filing date of the present application; 4 pages (from www.archive.org).

* cited by examiner

COMPOUND BOW

CROSS REFERENCE TO RELATED APPLICATIONS

This application is a continuation application of U.S. patent application Ser. No. 12/496,063, which claims priority to U.S. Provisional Application Ser. No. 61/149,900 filed on Feb. 4, 2009, entitled COMPOUND BOW; and to U.S. Provisional Application Ser. No. 61/097,899 filed on Sep. 18, 2008, entitled COMPOUND BOW; and to U.S. Provisional Application Ser. No. 61/077,928 filed on Jul. 3, 2008, entitled COMPOUND BOW WITH CENTERED FEED WHEEL, the disclosures of which are incorporated by reference herein in their entireties.

BACKGROUND

Bows have been used for thousands of years as a tool for rapidly propelling an arrow. The simplest bow designs have included a body made of a single piece of material—usually wood. The body is shaped to include flexible limbs at each end. A bow string is securely fastened between the flexible limbs. When the bow string is pulled, the force causes the limbs to bend. When the string is released, the reduced force causes the limbs to spring back to their original position, thereby propelling an arrow.

In recent years major advances in bow technology have occurred. One major advance is the development of the compound bow. A compound bow typically includes pulleys and cams that provide added mechanical advantage. As a result, a compound bow may be both easier to draw and also more powerful than prior bow technology.

SUMMARY

In general terms, this disclosure is directed to an archery bow. In one possible configuration and by non-limiting example, an archery bow is a compound bow that includes a force compounding system for compounding a force supplied by an archer.

One aspect is a compound bow comprising a frame assembly, a force compounding system, and a draw string guide system. The frame assembly includes at least one riser. The force compounding system is supported by the frame assembly and includes a first string guide connected to the frame assembly and a second string guide connected to the frame assembly. The force compounding system is arranged at least partially forward of the riser. The draw string guide system is supported by the frame assembly and includes a third string guide connected to the frame assembly and a fourth string guide connected to the frame assembly. The draw string guide assembly is arranged at least partially rearward of the riser.

Another aspect is a compound bow comprising a frame assembly, a force compounding system, and a draw string guide system. The frame assembly includes at least one riser. The force compounding system is supported by the frame assembly and includes a first string guide connected to the frame assembly and a second string guide connected to the frame assembly. The force compounding system is arranged at least partially rearward of the riser. The draw string guide system is supported by the frame assembly and includes a third string guide connected to the frame assembly and a fourth string guide connected to the frame assembly. The draw string guide assembly is arranged at least partially forward of the riser.

Another aspect is a compound bow including a frame assembly, a force compounding system, and a draw string guide system. The force compounding system is connected to the frame assembly and includes a first string guide rotatable about a first axis and a second string guide rotatable about a second axis, wherein the first and second axes define ends of a first line. The draw string guide system is separate from the force compounding system and is connected to the frame assembly. The draw string guide system includes a third string guide rotatable about a third axis and a fourth string guide rotatable about a fourth axis, wherein the third and fourth axes define ends of a second line, wherein the first line is spaced from the second line.

A further aspect is a compound bow comprising: a frame assembly extending from a first end to a second end, the frame assembly including a frame, a first flexible limb mounted to the frame at the first end, and a second flexible limb mounted to the frame at the second end; a first guide wheel rotatably mounted to the first end of the frame assembly, the first guide wheel having a substantially constant radius; a second guide wheel rotatably mounted to the second end of the frame assembly, the second guide wheel having a second constant radius; a first bow string pulley rotatably mounted to the first end of the frame assembly; a first tension member pulley rotatably mounted to the first end of the frame assembly, the first tension member pulley rotationally connected to the first bow string pulley; a second bow string pulley rotatably mounted to the second end of the frame assembly; a second tension member pulley rotatably mounted to the second end of the frame assembly, the second tension member pulley rotationally connected to the second bow string pulley; a bow string with a first attachment point and a second attachment point, the first attachment point of the bow string attached to the first bow string pulley and the second attachment point of the bow string attached to the second bow string pulley, a draw string portion of the bow string extending between the first and the second guide wheels; a first tension member with a first attachment point and a second attachment point, the first attachment point of the first tension member attached to the first tension member pulley and the second attachment point of the first tension member attached to the second flexible limb; and a second tension member with a first attachment point and a second attachment point, the first attachment point of the second tension member attached to the second tension member pulley and the second attachment point of the second tension member attached to the first flexible limb, wherein the draw string portion of the bow string extending between the first and the second guide wheels is spaced from both of the first and the second tension members by a distance greater than about 2 inches when the bow string is undrawn.

Yet another aspect is a compound bow comprising a frame and a quiver. The frame includes a first limb and a second limb spaced from the first limb and defines a region directly between the first limb and the second limb. The quiver is arranged and configured to support at least one arrow at least partially within the region.

Another aspect is a bow comprising a pair of elongate flexible limbs supported in a side-by-side arrangement and separated by a distance, wherein the bow is configured to propel an arrow along an arrow flight path extending through a region between the pair of elongate flexible limbs.

A further aspect is a compound bow comprising a frame and a line feed mechanism. The frame includes an upper limb, a lower limb, and a riser connecting the upper limb to the lower limb. The line feed mechanism is supported by the frame and includes a dual feed wheel, wherein the dual feed wheel is arranged at least partially forward of the riser and is substantially centered between the upper limb and the lower limb.

Yet another aspect is a compound bow frame comprising a frame member defining a fixed and non-adjustable arrow rest receptacle, the receptacle including a keyed feature configured to mate with a second keyed feature of a non-adjustable arrow rest, wherein the keyed feature supports and aligns the arrow rest in the arrow rest receptacle when the arrow rest is arranged therein.

DETAILED DESCRIPTION

Figure 1:
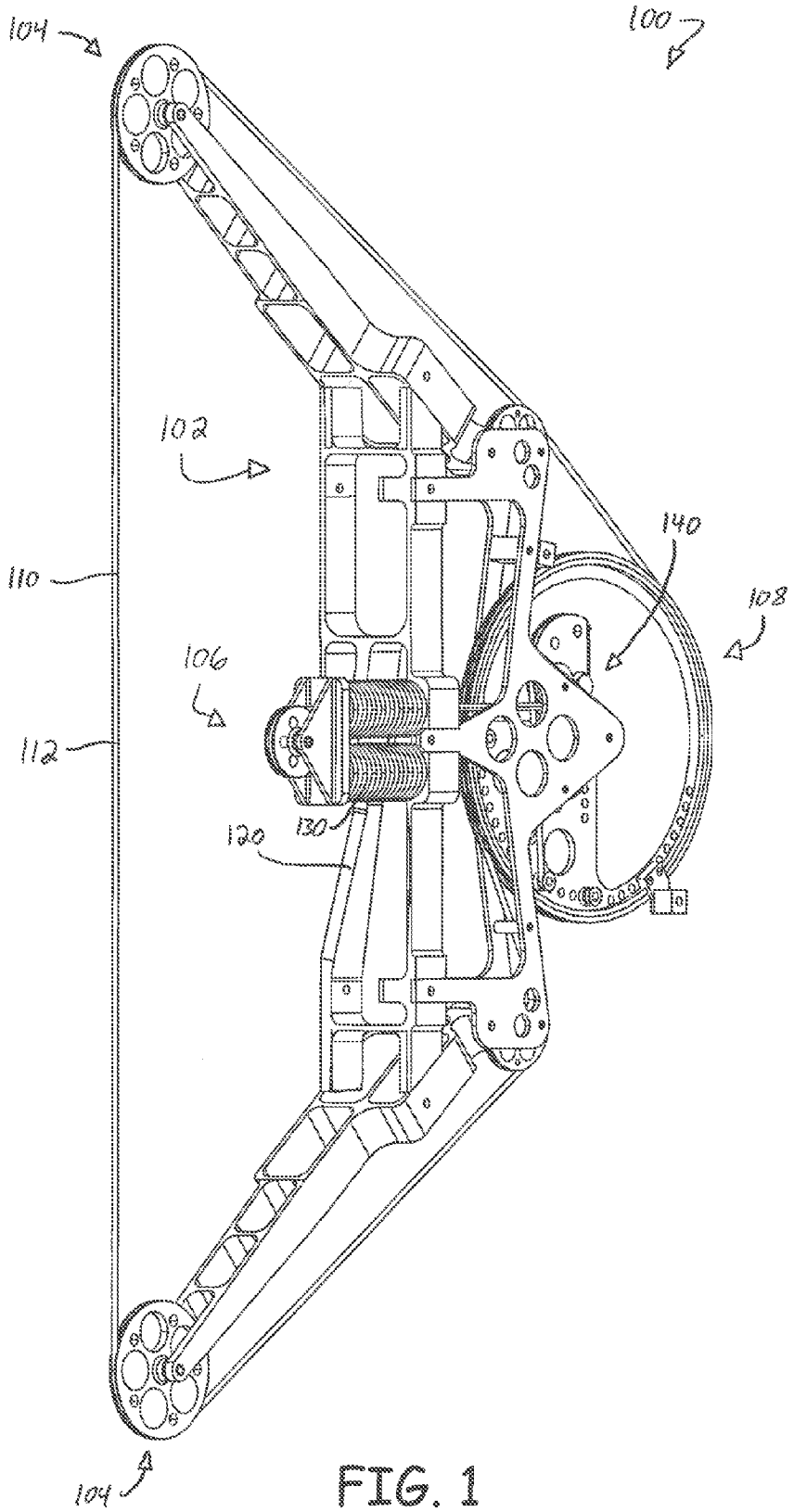
FIG. 1 is perspective view of an exemplary compound bow according to the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is perspective view of an exemplary compound bow 100. Compound bow 100 includes frame 102, string guides 104, power delivery mechanism 106, string feed mechanism 108, and bow string 110.

Compound bow 100 includes a rigid frame 102 that provides the general structure of compound bow 100. Unlike traditional bows that store and deliver power by bending flexible limbs, compound bow 100 has a rigid frame 102 that is designed to resist bending and flexing. Frame 102 includes a handle portion 120 that is designed to be grasped by one hand of an archer. The embodiments illustrated herein are examples of right-handed compound bows, where the handle portion 120 is designed to be grasped by the left hand of the archer. Left-handed embodiments may be made by reversing the design, such that the handle portion 120 is designed to be grasped by the right hand. Similarly, certain parts and arrangements of parts can be mirrored to convert a compound bow design from a right-handed version to a left-handed version.

String guides 104 are connected to frame 102 and guide bow string 110 around frame 102. In this example, string guides 104 are connected to the rear-most ends of frame 102. String guides 104 guide bow string 110 such that the bow string spans the space between the rear-most ends of frame 102. During use, a nock of an arrow may be connected to the segment of bow string 110 that is between string guides 104. In some embodiments, bow string 110 includes a nocking point 112 that assists the archer in properly positioning the arrow on bow string 110. In this embodiment, the string guides 104 arrange bow string 110 so that it can be retracted using the right hand of the archer (or a tool, such as a release connected to the right hand or arm).

Compound bow 100 includes a power delivery mechanism 106 that delivers power to the bow string 110 to propel an arrow. Because frame 102 is rigid, a separate power delivery mechanism 106 is provided in place of traditional flexible limbs. Power delivery mechanism 106 typically acts to store energy and to subsequently deliver the stored energy to bow string 110.

In some embodiments, power delivery mechanism 106 operates to store energy provided by the archer. For example, when the archer pulls back on string 110, the force provided by the archer is transmitted through bow string 110 and is stored as elastic energy by an energy storage mechanism 130 of power delivery mechanism 106. Examples of energy storage mechanisms include springs, pneumatic or hydraulic pistons, and flexible limbs. In another possible embodiment, energy storage mechanism 130 includes a pre-compressed gas, such as a $CO_2$ cartridge. The embodiment illustrated in FIG. 1 includes helical compression springs. Energy storage mechanism 130 converts stored elastic energy into kinetic energy to propel an arrow.

Power delivery mechanism 106 also typically includes a mechanical advantage apparatus 140 that magnifies the force provided by the archer. Various embodiments of compound bow 100 include various types of mechanical advantage apparatuses. Some examples of mechanical advantage apparatuses include cams, wheels, pulleys, levers, and combinations thereof. Wire or string is also used in some embodiments. Mechanical advantage apparatus 140 is an example of a force compounding system.

Compound bow 100 typically includes a string feed mechanism 108. When the archer draws compound bow 100 by pulling on bow string 110, string feed mechanism 108 supplies additional string to allow the archer to fully draw compound bow 100. The increased string length allows the archer to provide more energy to the power delivery mechanism and allows the archer to hold the nocking point 112 of bow string 110 at a comfortable position (typically to the side of the archers head) when at full draw. String feed mechanism 108 also acts to retract the additional string when bow string 110 is released.

Having generally described an exemplary embodiment of compound bow 100, further details of some exemplary embodiments of compound bow 100 are provided below with respect to FIGS. 2-11.

Figure 2:
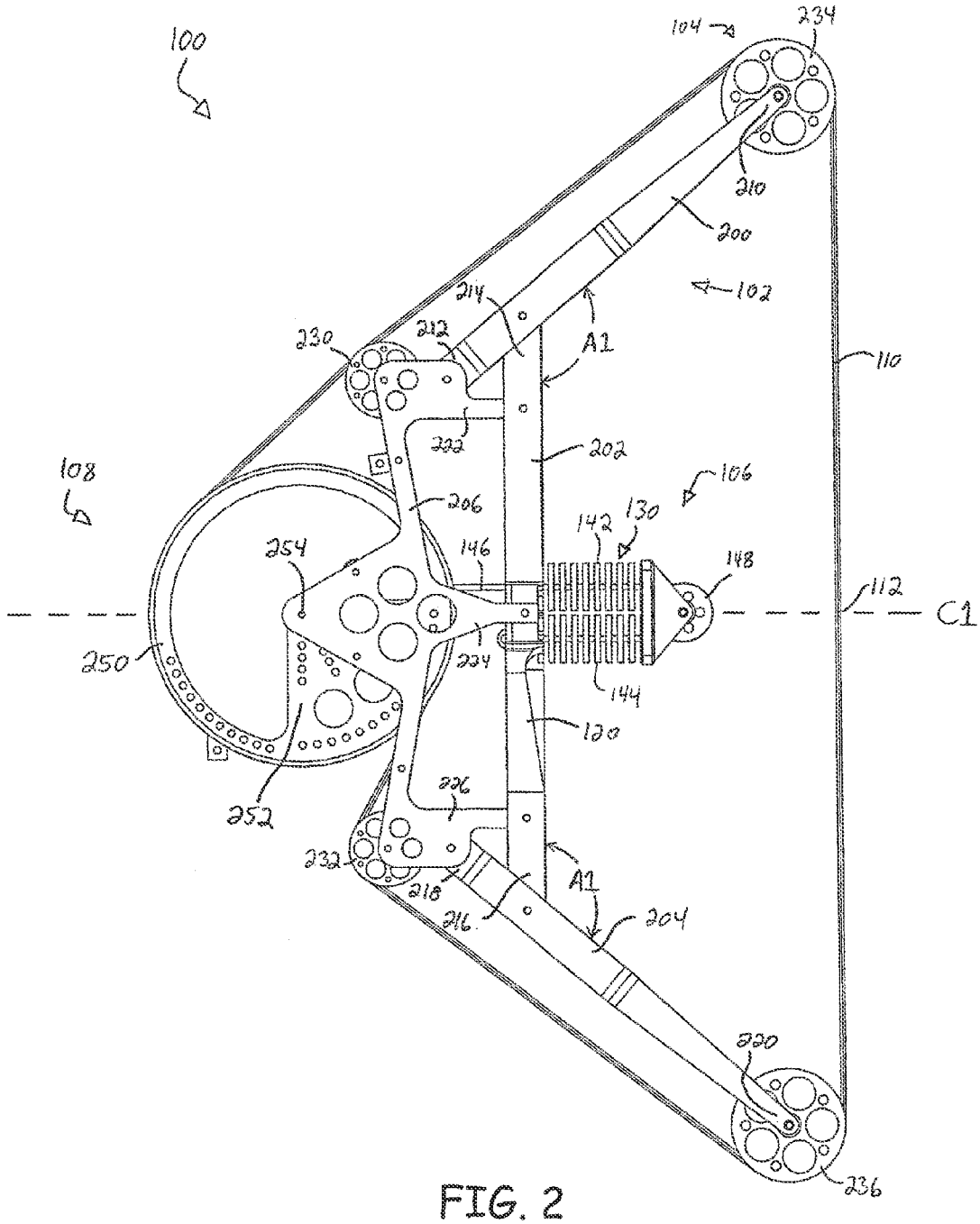
FIG. 2 is a left side elevational view of the exemplary compound bow shown in FIG. 1.

FIG. 2 is a left side elevational view of exemplary compound bow 100. As described above, compound bow 100 includes frame 102, string guides 104, power delivery mechanism 106, string feed mechanism 108, and bow string 110.

Frame 102 includes a plurality of frame members including upper limb 200, riser 202, lower limb 204, and secondary riser 206. Upper limb 200 includes ends 210 and 212. Riser 202 includes handle portion 120 and ends 214 and 216. Lower limb 204 includes ends 218 and 220. Secondary riser 206 includes upper support member 222, power stroke support member 224, and lower support member 226. In this embodiment, upper limb 200, riser 202, lower limb 204, and secondary riser 206 are substantially rigid structures that resist movement relative to each other.

When an archer holds compound bow 100 at handle portion 120, the riser 202 can be oriented so that the longitudinal axis of riser 202 is vertical and upper limb 200 is vertically higher than lower limb 204. The following discussion assumes this orientation of compound bow 100, recognizing that compound bow 100 may be held in a variety of other orientations.

Riser 202 is connected at end 214 to upper limb 200. Examples of suitable fasteners include bolts and nuts, screws, welded joints, adhesive, pins. Other fasteners are used in other embodiments. Upper limb 200 typically extends upward and rearward from end 214 of riser 202. Riser 202 is connected at lower end 216 to lower limb 204. Lower limb 204 typically extends downward and rearward from riser 202. In some embodiments a fastener is used to connect portions of frame 102 together. Upper and lower limbs 200 and 204 are typically arranged symmetrically across a central axis C1 of compound bow 100 to form a well balanced design, although such symmetry is not required by all embodiments. An angle between riser 202 and upper and lower limbs 200 and 204 is defined by angle A1. Angle A1 is preferably in a range from about 45 degrees to about 170 degrees, and more preferably in a range from about 100 degrees to about 170 degrees, and even more preferably in a range from about 130 degrees to about 150 degrees.

Secondary riser 206 provides added strength and stability to frame 102. Upper support member 222 of secondary riser 206 is connected to end 212 of upper limb 200. Upper support member 222 is also connected to riser 202 near to, but spaced from, end 214. This configuration forms a triangular frame structure at the intersections of upper limb 200, riser 202, and upper support member 222 that provides added strength and stability to frame 102.

Similarly, lower support member 226 of secondary riser 206 is connected to end 218 of lower limb 204. Lower support member 226 is also connected to riser 202 near to, but spaced from end 216. This configuration also forms a triangular frame structure at the intersections of lower limb 204, riser 202, and lower support member 226 that provides added strength and stability to frame 102.

In some embodiments, frame 102 includes secondary riser 206. The secondary riser 206 supports the string feed mechanism 108 described in more detail below. The secondary riser 206 also includes a power stroke support member 224 that supports the power delivery mechanism 106.

Frame members of frame 102 are typically made of a rigid material, such as metal or a composite. Examples of suitable materials include aluminum or composite graphite. Other embodiments include other materials, such as wood and plastic. To reduce the weight of compound bow 100, some embodiments include apertures (such as shown in FIGS. 3-6) in frame members of frame 102. In some embodiments, frame members are made by forming each frame member from a solid piece of material. Standard processing techniques can be used, including cutting, drilling, grinding, and polishing. In another embodiment, frame members are made by molding. Other embodiments include other manufacturing techniques. Manual or automated process may be used.

String guides 104 typically guide the bow string between the string feed mechanism 108 and across the rear side of compound bow 100, where bow string 110 is intended to be grasped by the archer (such as at nocking point 112). In this embodiment, string guides 104 include a plurality of rotating guide wheels, including guide wheels 230, 232, 234, and 236. Guide wheel 230 is connected to secondary riser 206 at upper support member 222. Guide wheel 232 is also connected to secondary riser 206, but is connected to the lower support member 226. Guide wheels 230 and 232 guide bow string 110 as it comes from, or returns to, string feed mechanism 108. Guide wheel 234 is connected to end 210 of upper limb 200. Guide wheel 236 is connected to end 220 of lower limb 204. Guide wheels 234 and 236 guide bow string around the respective ends of upper and lower limbs 200 and 204. In some embodiments, guide wheels are each connected to frame 102 by a fastener, such as a pin. The guide wheels are free to rotate around the pin. Ball bearings are used in other embodiments. Other embodiments include other fasteners or mechanisms to allow free rotation of the guide wheels.

Bow string 110 is arranged such that it is connected to string feed mechanism 108 at a first end, extends around frame 102, and then is connected again to string feed mechanism 108 at the second end. Guide wheels 230 and 234 guide bow string 110 adjacent to and generally parallel with upper limb 200. Bow string 110 then spans the space between guide wheel 234 and 236. Bow string 110 continues around guide wheel 234, where it is directed generally parallel with lower limb 204 by guide wheels 234 and 232. The bow string then returns from guide wheel 232 to string feed mechanism 108.

In this embodiment, guide wheel 232 is needed to direct bow string 110 from string feed mechanism 108 around end 216 of riser 202 and end 218 of lower limb 204. On the other hand, guide wheel 230 is optional in this embodiment because string feed mechanism 108 directs bow string 110 to approximately the appropriate position even if guide wheel 230 is not present. However, guide wheel 230 has the advantage of providing further support to bow string 110 and increases the symmetry of compound bow 100 with respect to central axis C1.

Guide wheels 230, 232, 234, and 236 are preferably lightweight circular discs having a central grove through which bow string 110 passes. The thickness of the guide wheels is typically only slightly more than the thickness of the bow string 110. The guide wheels may also include apertures to further reduce weight. It is desirable to make guide wheels as light as possible for multiple reasons. One reason is that it is generally desirable to reduce the overall weight of compound bow 100, and lighter guide wheels result in a lighter compound bow 100. Another reason is that light guide wheels increase the amount of energy transferred from power delivery mechanism 106 to bow string 110 by not requiring as much energy to make the guide wheels rotate. In some embodiments, guide wheels are made of metal. Other materials are used in other embodiments, such as plastic, graphite, wood, composites, or other suitable materials.

Figure 5:
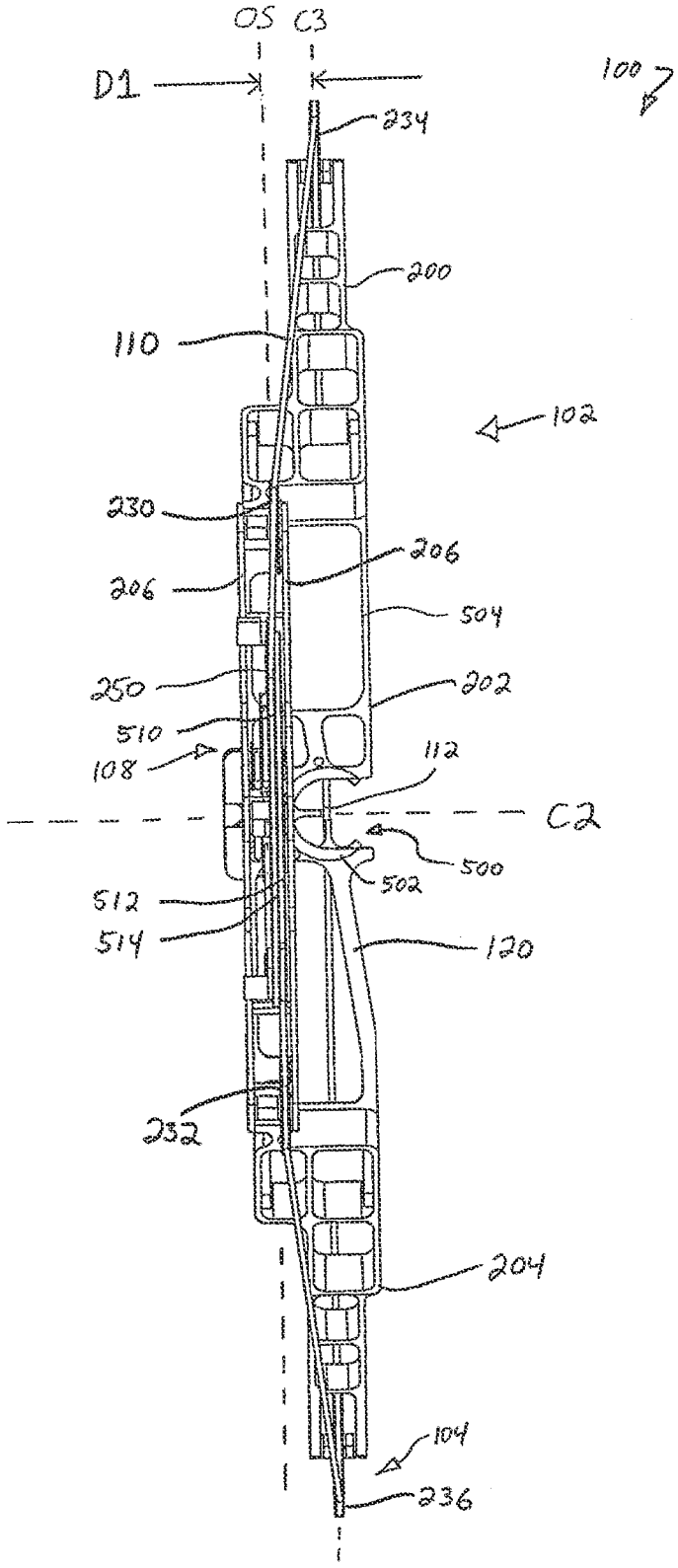
FIG. 5 is a front elevational view of the exemplary compound bow shown in FIG. 1.

String feed mechanism 108 operates to feed or retract bow string 110 as needed. When an archer begins to pull back on bow string 110, such as at nocking point 112, string feed mechanism 108 feeds added length of bow string 110. This allows the archer to fully draw the bow to the desired draw length. Draw length is the distance from the rear side of handle portion 120 to nocking point 112 when compound bow 100 is fully drawn (the draw length is shown in FIG. 5). String feed mechanism 108 allows compound bow 100 to achieve such a draw length.

String feed mechanism 108 includes dual feed wheel 250, support member 252, and pivot point 254. In some embodiments, dual feed wheel 250 is a cylindrical wheel that stores additional length of bow string 110. Other embodiments of dual feed wheel 250 include non-circular cross-sections, such that dual feed wheel 250 operates as a cam having oblong, elliptical, or other non-circular rounded shapes. Ends of bow string 110 are typically connected to dual feed wheel 250. As shown and described in more detail below (see, for example, FIGS. 5 and 6), dual feed wheel 250 typically includes two parallel channels formed in the periphery of dual feed wheel 250. The channels are separated by a wall. End portions of bow string 110 are wrapped at least partially around dual feed wheel 250 when compound bow 100 is in the non-drawn position, each being in a separate channel. Typically each end portion of bow string 110 is wrapped at least half way around dual feed wheel 250. The channels of dual feed wheel 250 maintain a separation between the end portions of bow string 110 to prevent the end portions from overlapping or otherwise interfering with each other. In some embodiments, the two parallel channels of dual feed wheel 250 rotate together and thus wrap end portions of bow string 110 in the same direction about an axis of dual feed wheel 250. In other embodiments, two alternative channels of an alternative feed wheels may rotate in different directions (e.g., in opposite directions) and thus wrap end portions of bow string 110 is different directions (e.g., in opposite directions).

Support member 252 is connected interior to dual feed wheel 250 and includes a pivot point 254. Support member 252 is pivotally connected to secondary riser 206 at pivot point 254. Support member 252 and dual feed wheel 250 are connected to secondary riser 206 in such a way that dual feed wheel 250 is able to pivot around pivot point 254.

Dual feed wheel 250 is arranged forward of riser 202. Typically, the central axis of dual feed wheel 250 is aligned, but perpendicular to, central axis C1. In some embodiments, dual feed wheel 250 is centered, such that the pivot point 254 of dual feed wheel 250 is aligned with central axis C1 of frame 102. In other embodiments, dual feed wheel 250 is substantially centered, such that a horizontal plane passing through central axis C1 crosses through any portion of dual feed wheel 250. For example, dual feed wheel 250 is vertically offset in some embodiments, such that the pivot point 254 of dual feed wheel 250 is above or below central axis C1.

Although dual feed wheel 250 is typically arranged in front of riser 202 and is vertically aligned with central axis C1, dual feed wheel 250 does not interfere with the flight path of an arrow because dual feed wheel 250 is offset toward the right side of compound bow 100 from the arrow path. The offset of dual feed wheel 250 is described in more detail below.

Power delivery mechanism 106 includes energy storage mechanism 130 and mechanical advantage apparatus 140 (primarily obscured in FIG. 3, but illustrated and described in more detail below). Energy storage mechanism 130 is a device that stores energy provided by the archer, when the archer draws compound bow 100 by applying separation forces to handle portion 120 and bow string 110 (at or near to nocking point 112).

In some embodiments, energy storage mechanism 130 includes springs. More specifically, some embodiments of energy storage mechanism 130 include helical die compression springs 142 and 144. An example of a suitable die compression spring is the Chrome-Silicon Steel Die Spring, Part Number 9588K69, distributed by McMaster-Carr, located in Elmhurst, Ill. Die compression springs 142 and 144, typically require a force in a range from about 1200 pounds to about 2400 pounds in order to compress the spring. When in the non-drawn position, some embodiments of compound bow 100 includes die compression springs that are pre-loaded, such that they are already somewhat compressed even before the bow string 110 is drawn back. For example, some embodiments include die compression springs that are pre-loaded by compressing the die compression spring a distance that is in a range from about 0.1 inches to about 0.5 inches, and preferably from about 0.2 inches to about 0.3 inches. Pre-loading allows compound bow 100 to provide a higher force to arrow through the entire power stroke and lessen or eliminate tapering off of force at the end of the power stroke. (The length of springs 142 and 144 is represented by length D5, shown in FIG. 10.)

Such high powered compression springs 142 and 144 are capable of storing a large amount of energy with only a small amount of compression. For example, in some embodiments the die compression spring is compressed beyond the preloaded compression a distance in a range from about 0.2 inches to about 1 inch, and preferably from about 0.3 inches to about 0.7 inches. Some embodiments include die compression springs 142 and 144 that have a substantially uniform and linear force curve in such ranges of compression. Other embodiments include die compression springs 142 and 144 that have a substantially non-uniform and non-linear force curve in such ranges of compression.

Some embodiments of energy storage mechanism 130 include one or more compression springs. In the illustrated embodiment shown in FIG. 2, two compression springs are used. A wire 146 is used to connect energy storage mechanism 130 to mechanical advantage apparatus 140. The wire 146 passes through a first compression spring 142 and is then passed over a pulley 148. The wire is then guided by pulley 148 through the second compression spring 144 and is then fixed to frame 102. The wire 146 and pulley 148 provide a uniform force to both compression springs 142 and 144 to use them simultaneously. In some embodiments, wire 146 is made of braided materials or a single strand of material, such as including metal, nylon, or a fibrous material. Other embodiments include other wire, rope, cord, or string materials.

Figure 3:
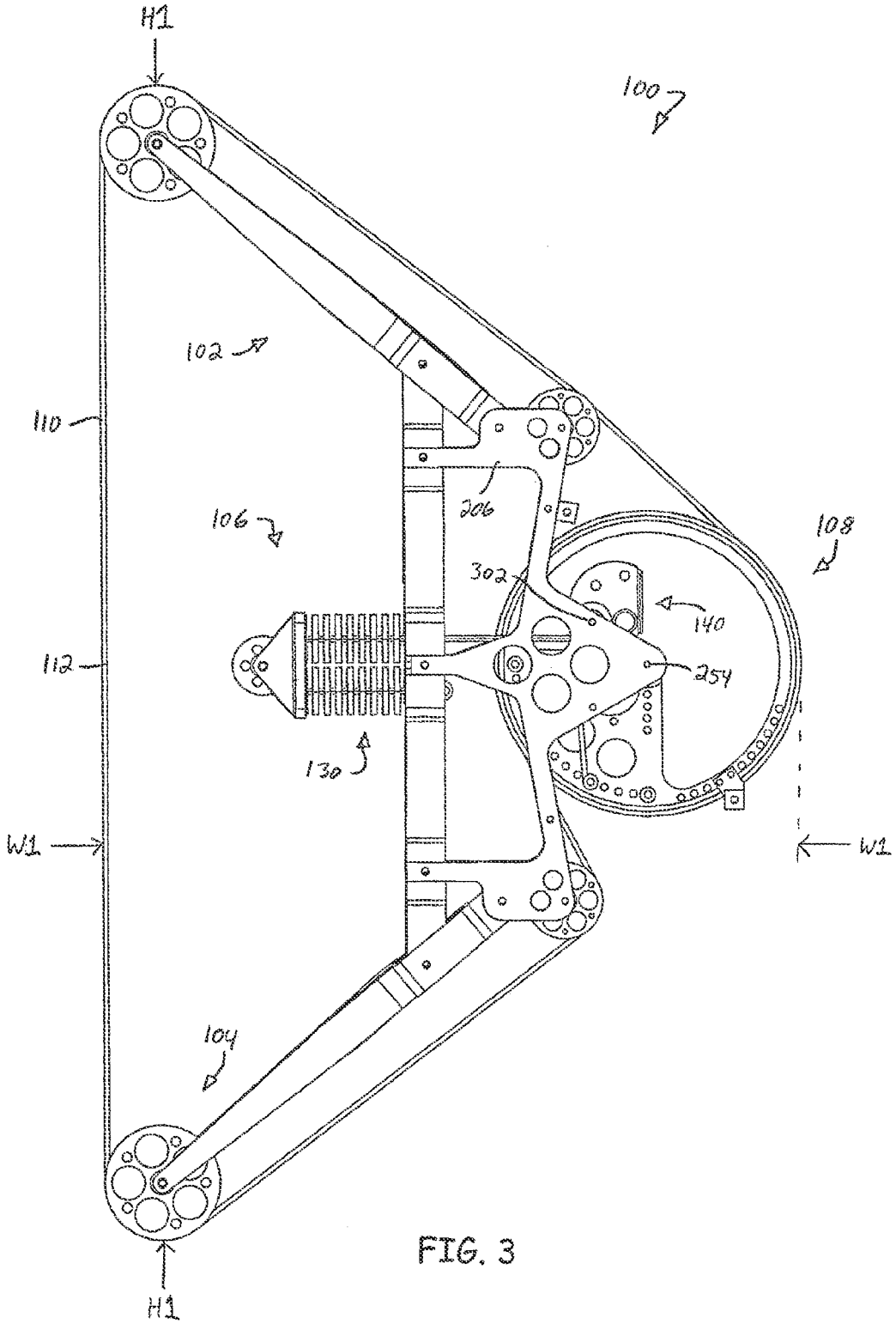
FIG. 3 is a right side elevational view of the exemplary compound bow shown in FIG. 1.

FIG. 3 is a right side elevational view of exemplary compound bow 100. As described above, compound bow 100 typically includes frame 102, string guides 104, power delivery mechanism 106, string feed mechanism 108, and bow string 110. Power delivery mechanism 106 typically includes energy storage mechanism 130 and mechanical advantage apparatus 140. Compound bow 100 is shown in a non-drawn position.

Frame 102 includes secondary riser 206. Secondary riser 206 includes pivot points 254 and 302 that are pivotally connected to mechanical advantage apparatus 140 and to string feed mechanism 108. Pivot points 254 and 302 typically include a pivotal connector, such as a pin or ball bearing mechanism that allows secondary riser 206 to support portions of mechanical advantage apparatus 140 and string feed mechanism 108, while allowing pivotal movement of these components relative to secondary riser 206. Pivot points 254 and 302 are referred to in more detail below.

Various embodiments of compound bow 100 have various sizes. The overall height of compound bow 100 is represented by H1. In some embodiments, H1 is in a range from about 2 feet to about 6 feet, and preferably from about 3 feet to about 5 feet. The overall width of compound bow 100 is represented by W1. In some embodiments, W1 is in a range from about 1 foot to about 5 feet, and preferably from about 2 feet to about 3 feet. Other embodiments include other dimensions.

Figure 4:
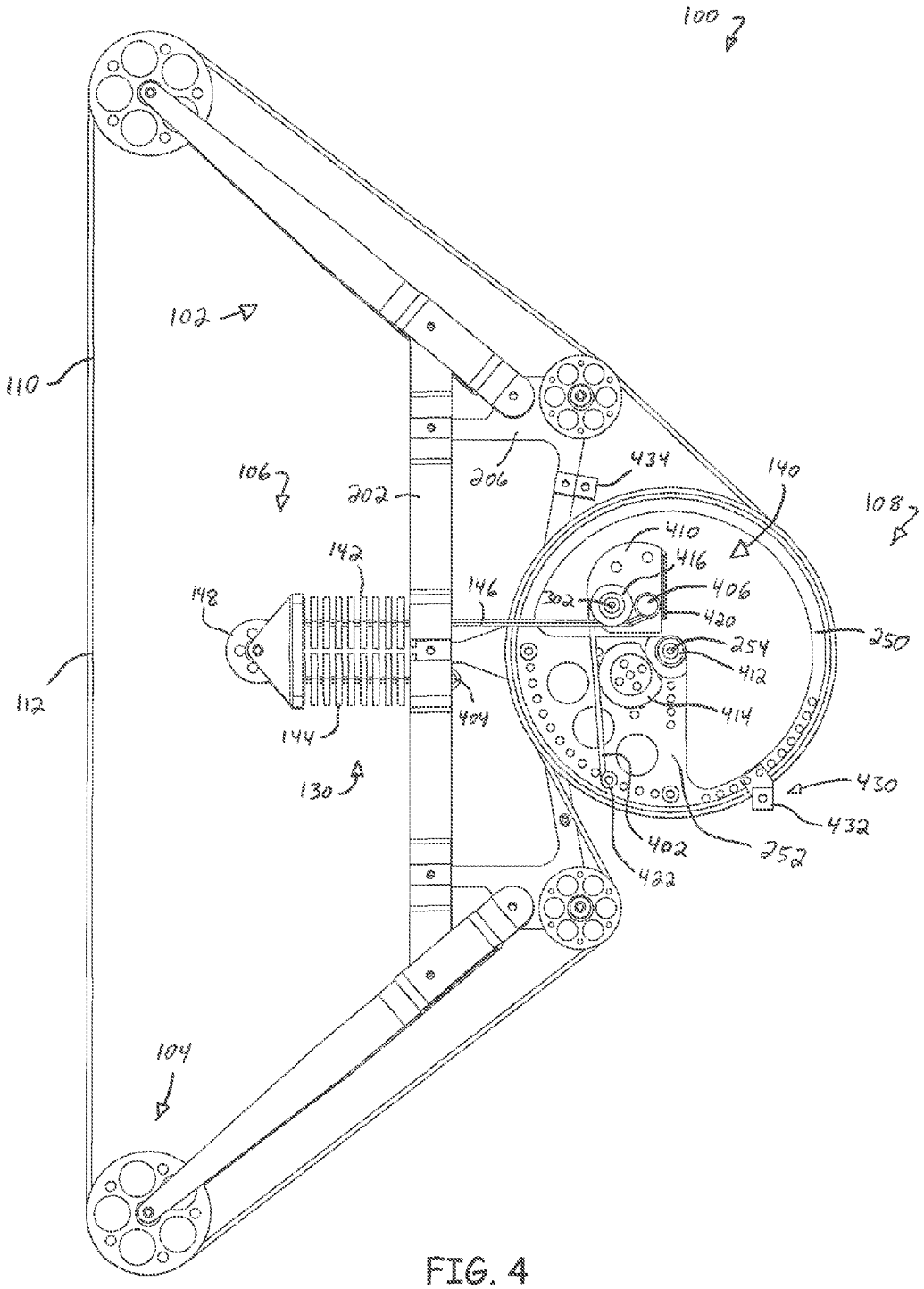
FIG. 4 is a right side elevational view of the exemplary compound bow shown in FIG. 1.

FIG. 4 is a right side elevational view of exemplary compound bow 100. In FIG. 4, the right side of the secondary riser 206 is removed to expose the power delivery mechanism 106 and the string feed mechanism 108. As described above, compound bow 100 typically includes frame 102, string guides 104, power delivery mechanism 106, string feed mechanism 108, and bow string 110. Frame 102 includes riser 202. Power delivery mechanism 106 typically includes energy storage mechanism 130 and mechanical advantage apparatus 140. String feed mechanism 108 includes dual feed wheel 250, support member 252, and pivot point 254.

Compound bow 100 further includes wire 402, junction points 404 and 406, pivoting cam 410, guide wheels 412, 414, and 416, junction points 420 and 422, and mechanical stop mechanism 430.

Junction point 404 is fixed to riser 202. Junction point 406 is fixed to pivoting cam 410. A portion of pivoting cam 410 is curved and includes a groove on the outer periphery. The groove is sized and configured to receive and guide wire 402 therein. Pivoting cam 410 is pivotally connected to secondary riser 206 at pivot point 302. Guide wheel 412 is connected to support member 252 and is pivotally connected to secondary riser 206. Guide wheel 414 is fixed to secondary riser 202.

Power delivery mechanism 106 and string feed mechanism 108 cooperate to perform their respective functions. In this embodiment, two wires are used to transfer forces within power delivery mechanism 106 and string feed mechanism 108. The wires include wire 146 and wire 402. Wire 146 has two ends. A first end of wire 146 is fixed to riser 202 at junction point 404. The other end of wire 146 is connected to pivoting cam 410 of mechanical advantage apparatus 140 at junction point 406. Wire 146 extends from junction point 404 through compression spring 144 and then around a portion of pulley 148. Wire 146 then proceeds through compression spring 142, past riser 202, and ends at junction point 406.

The second wire, wire 402 is fixed at one end to junction point 420 and extends around a portion of pivoting cam 410. The wire then extends past guide wheel 414 and to junction point 422 that is fixed to dual feed wheel 250. The above description of the locations of wires 146 and 402 describes an exemplary arrangement of the wires in compound bow 100 when in the non-drawn position. As compound bow 100 is drawn, the positions change to the position illustrated in FIG. 10, described in more detail below.

Mechanical stop mechanism 430 is also illustrated in FIG. 4. Mechanical stop mechanism operates to limit the draw length of compound bow 100 to a fixed location. An advantage of mechanical stop mechanism 430 is that the length of a draw will be consistent each time compound bow 100 is drawn. This provides greater accuracy and consistency when shooting arrows with compound bow 100.

Figure 10:
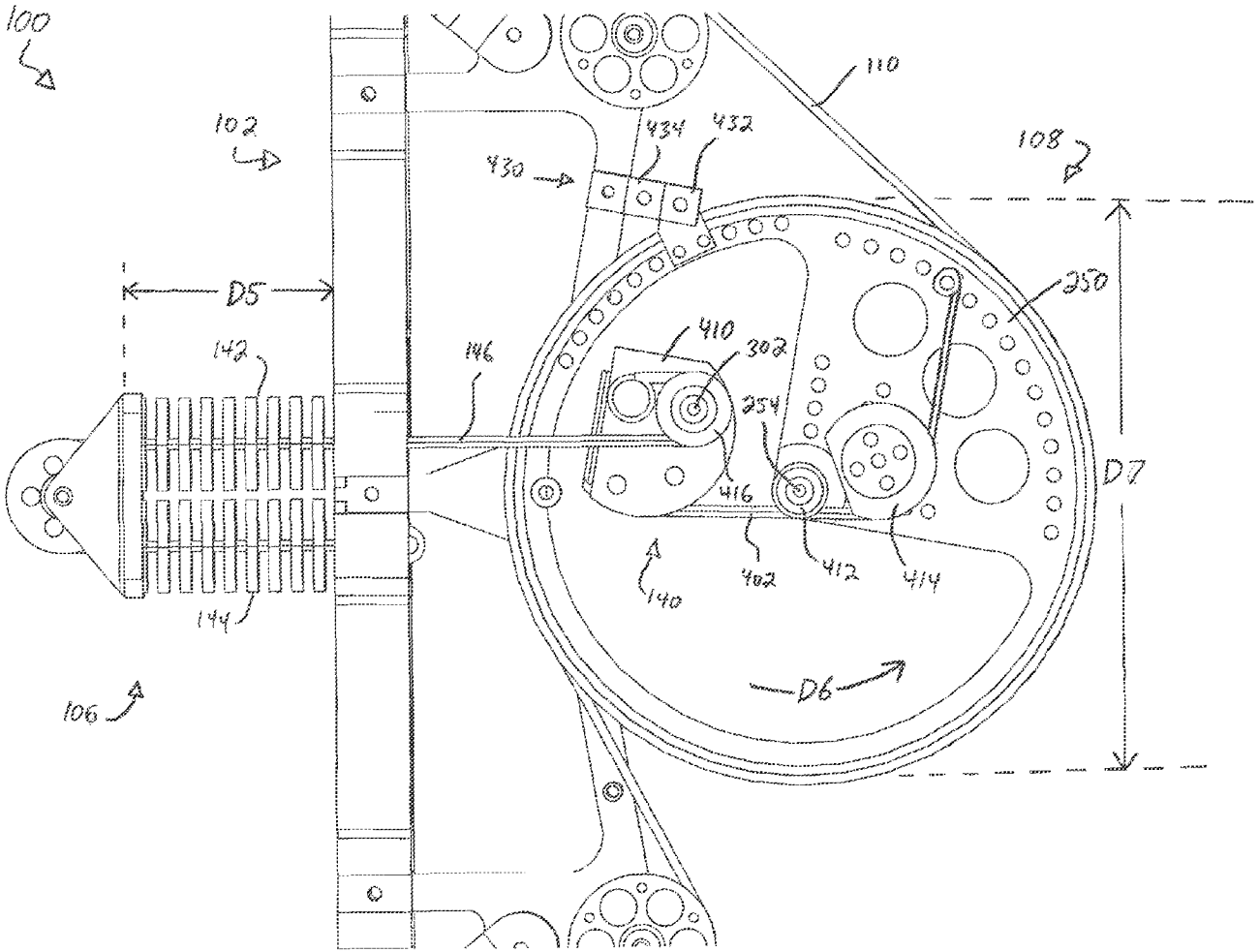
FIG. 10 is an enlarged right side elevational view of portions of the exemplary compound bow shown in FIG. 1.

Mechanical stop mechanism 430 typically includes a first portion 432 and a second portion 434. First portion 432 is connected to dual feed wheel 250. Second portion 434 is connected to secondary riser 206. When compound bow 100 is drawn by applying a separation force between the handle (shown in FIG. 2) and bow string 110 (such as a nocking point 112) the force causes dual feed wheel 250 to pivot. The pivoting motion causes first portion 432 to advance toward second portion 434. Eventually first portion 432 comes into contact with second portion 434 (as shown in FIG. 10), causing dual feed wheel 250 to stop rotating, thereby stopping the draw at the desired draw length. The draw length is adjustable by connecting first portion 432 to a different location on dual feed wheel 250. One example of a suitable mechanical stop mechanism 430 is a pair of angle brackets. In some embodiments, secondary riser 206 (or other portion of frame 102) acts as the second portion 434, such that a separate second portion is not required.

In some embodiments, mechanical stop mechanism 430 is also a force let-off mechanism that reduces the force required to maintain compound bow 100 in the fully drawn position. Although an archer may be able to provide a force large enough to draw the bow for a short period of time, the archer will eventually weary if required to maintain this force for too long. The force let-off mechanism provides some holding force, thereby assisting the archer in maintaining compound bow 100 in the fully drawn position. In one possible embodiment, first and second portions 432 and 434 include magnets. For example, small magnets are provided that provide a holding force in a range from about 10 to about 40 pounds each. When two magnets are used, one on each of portions 432 and 434, the forces combine to provide a total let-off in a range from about 20 pounds to about 80 pounds. The total draw force is greater than the let-off force, such that when the bow string 110 is released, the draw force separates first and second portions 432 and 434 to release the let-off force. Other possible embodiments include one or more magnets. Yet other embodiments include other force-removal components. Examples include a mechanical latch, clip, or other device configured to provide holding force. Yet other embodiments include a let-off mechanism that will hold the entire draw force, such as to allow compound bow 100 to be used in a cross-bow configuration. Typically, such a mechanism also includes a trigger mechanism. In this way, the compound bow 100 can be maintained in a drawn position by the let-off mechanism until the trigger is pulled. In some embodiments, a gun-type stock is mounted to frame 102 to arrange compound bow 100 into a cross-bow configuration. Various example compound bows (e.g., 3100', 3900") arranged in a cross-bow configuration including a gun-type stock (e.g., 3195, 3995) are illustrated at FIGS. 40-41, and 46-50. Cross-bows are typically arranged in a horizontal orientation during use. In contrast, compound bows are typically arranged in a vertical orientation when used in a traditional manner (i.e., when not being used as a cross-bow).

FIG. 5 is a front elevational view of exemplary compound bow 100. Compound bow 100 typically includes frame 102, string guides 104, string feed mechanism 108, and bow string 110. Bow string 110 includes nocking point 112. Frame 102 includes a plurality of frame members, including upper limb 200, riser 202, lower limb 204, and secondary riser 206. Riser 202 includes handle portion 120, arrow rest mounting region 500, and arrow rest 502, and sight mounting region 504. String guides 104 include guide wheels 230, 232, 234, and 236. String feed mechanism 108 includes dual feed wheel 250 including channel 510, channel 512, and wall 514 that separates channels 510 and 512.

Riser 202 includes arrow rest mounting region 500. Arrow rest mounting region 500 includes a recess that is configured to receive an arrow rest 502. In some embodiments, arrow rest mounting region 500 is a recess having a generally arcuate shape that is formed in riser 202. Arrow rest mounting region 500 is typically a non-adjustable region that is configured to receive arrow rest 502 in a single fixed position. An advantage of arrow rest mounting region 500 is that does not need to be adjusted to properly align an arrow rest 502. Rather, arrow rest 502 is automatically properly aligned by insertion of arrow rest 502 into arrow rest mounting region 500. This reduces the number of possible adjustments, simplifying the use and alignment of compound bow 100.

Riser 202 also includes sight mounting region 504. Sight mounting region 504 includes an aperture formed in riser 202 through which an archer may look to view a desired target. Sight mounting region 504 is configured to receive a sight mechanism (not shown), which is mounted to sight mounting region 504, such as by the use of a fastener. One or more fastener holes are drilled through portions of sight mounting region 504, in some embodiments, for mounting of the sight mechanism to sight mounting region 504. Sight mechanisms typically include one or more sight pins, often having a colored or illuminating tip. Because an arrow is pulled by gravity as it is in flight, the further an arrow travels, the more the arrow will drop. Multiple sight pins are typically provided to provide separate pins for different target distances to accommodate for the anticipated arrow drop.

The alignments of various portions of compound bow 100 are illustrated in FIG. 5. To aid in the illustration and description of such alignment, axes C2, C3, and OS are provided.

Axis C2 is a line passing through a center point of arrow rest mounting region 500 and perpendicular to bow string 110 at nocking point 112. A central horizontal plane is a plane that passes through axis C2, nocking point 112, as well as through central axis C1, shown in FIG. 2. (In some embodiments, however, the plane is defined by the position of an arrow when connected to bow string 110 and when seated in arrow rest 502. In such embodiments, the plane may be slightly offset, such as slightly above or slightly below nocking point 112, depending on the type of nocking point used and the archer's preferred method of connecting the arrow.)

Axis C3 is a vertical line passing through a rear segment of bow string 110 (between guide wheel 234 and 236) when compound bow 100 is in the non-drawn position. A vertical plane is a plane passing through axis C3 and also through a center point of arrow rest mounting region 504.

Axis OS is an offset axis passing through a center of dual feed wheel 250 and oriented vertically (when compound bow 100 is positioned as illustrated in FIG. 5). An offset vertical plane is a plane passing through axis OS and parallel with the central vertical plane.

String guides 104 include guide wheels 230, 232, 234, and 236. Bow string 110 is arranged in the central vertical plane through axis C3 between guide wheels 234 and 236 (which are also arranged in the central vertical plane). However, guide wheels 230 and 232 are offset from the central vertical plane, causing bow string 110 to leave the central vertical plane. Rather, guide wheels 230, 232, and dual feed wheel 250 are arranged in the offset vertical plane that passes through axis OS. This offset is represented by distance D1. Distance D1 is a distance sufficient to move string feed mechanism 108 (and secondary riser 206) out of an arrow path. For example, the offset is sufficient in some embodiments to align a left side of secondary riser 206 with the right interior side of arrow rest 502. This distance is typically sufficient to ensure that secondary riser 206 will not come into contact with an arrow (including the tip or broadhead, arrow shaft, and fletching). In some embodiments, distance D1 is slightly larger than the largest anticipated radial fletching length plus the distance between the offset plane and the left side of secondary riser 206. For example, D1 is typically in a range from about 0.5 inches to about 4 inches, and preferably from about 0.8 inches to about 2.5 inches. In other embodiments, distance D1 can range from about 3.5 inches to about 6 inches. In still other embodiments, distance D1 can have other dimensions. The offset allows dual feed wheel 250 and power delivery mechanism 106 (shown in FIG. 1) to be aligned along central horizontal plane C2 without interfering with the arrow flight path. The central alignment improves the balance and stability of compound bow 100.

Dual feed wheel 250 includes two parallel channels 510 and 512, separated by wall 514. A first end portion of bow string 110 is connected to and received by channel 510. When in the non-drawn position, the first end portion of bow string 110 typically wraps at least about 180 degrees around dual feed wheel 250 in channel 510. A second end portion of bow string 110 is connected to and received by channel 512. When in the non-drawn position, the second end portion of bow string 110 typically wraps at least about 180 degrees around dual feed wheel 250 in channel 512. Wall 514 separates channel 510 from channel 512.

In addition to the offset of dual feed wheel 250, mechanical advantage apparatus 140 is similarly offset to avoid interference with an arrow flight path.

Figure 6:
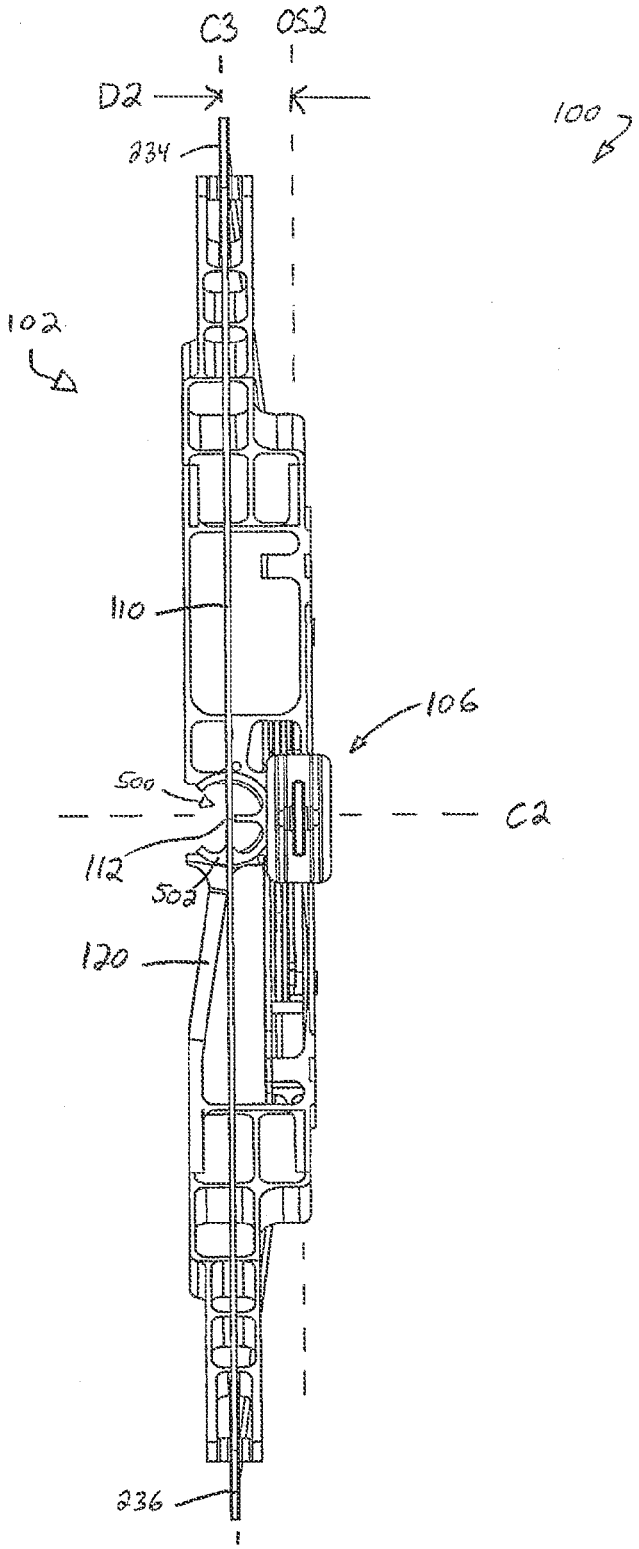
FIG. 6 is a rear elevational view of the exemplary compound bow shown in FIG. 1.

FIG. 6 is a rear elevational view of exemplary compound bow 100. Compound bow 100 includes frame 102 having handle portion 120, power delivery mechanism 106, and bow string 110 including nocking point 112. FIG. 6 further illustrates the alignment of various components of compound bow 100.

As described above, axis C3 is a line passing through a rear portion of bow string 110, the rear portion extending between guide wheels 234 and 236. The central vertical plane passes through axis C3 and through a center of arrow rest mounting region 500, which is aligned with an arrow flight path.

Axis OS2 is a vertical axis that passes through a center of power delivery mechanism 106. A second vertical offset plane passes through axis OS2 and is parallel with the central vertical plane.

Power delivery mechanism 106 is offset from the central vertical plane passing through axis C3 to prevent power delivery mechanism from interfering with an arrow along the arrow flight path. For example, power delivery mechanism 106 is offset a distance D2. Distance D2 is typically at least a distance sufficient to align a left side of power delivery mechanism 106 with an inner right side of arrow guide 512, such that the arrow will not come in contact with power delivery mechanism 106. For example, D2 is typically in a range from about 0.5 inches to about 4 inches, and preferably from about 1 inch to about 3 inches.

Figure 7:
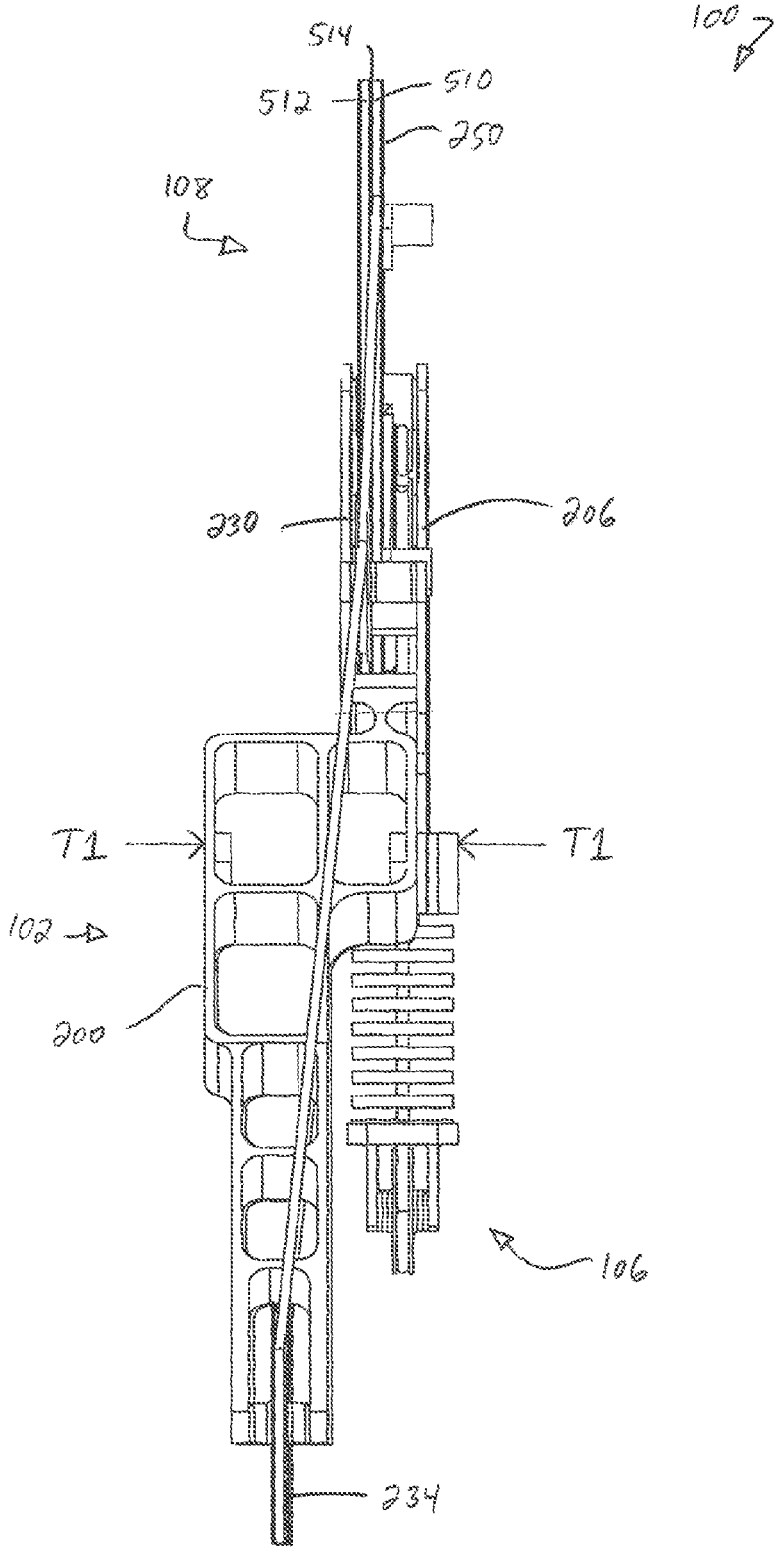
FIG. 7 is a top plan view of the exemplary compound bow shown in FIG. 1.

FIG. 7 is a top plan view of exemplary compound bow 100. Compound bow 100 includes frame 102 including upper limb 200 and secondary riser 206, power delivery mechanism 106, string feed mechanism 108, and guide wheel 230. Bow string feed mechanism includes dual feed wheel 250 having channels 510 and 512, separated by wall 514.

Various embodiments of compound bow 100 have various sizes. The overall thickness of compound bow 100 is represented by T1. In some embodiments, T1 is in a range from about 1 inch to about 1 foot, and preferably from about 2 inches to about 6 inches. Other embodiments include other dimensions.

Figure 8:
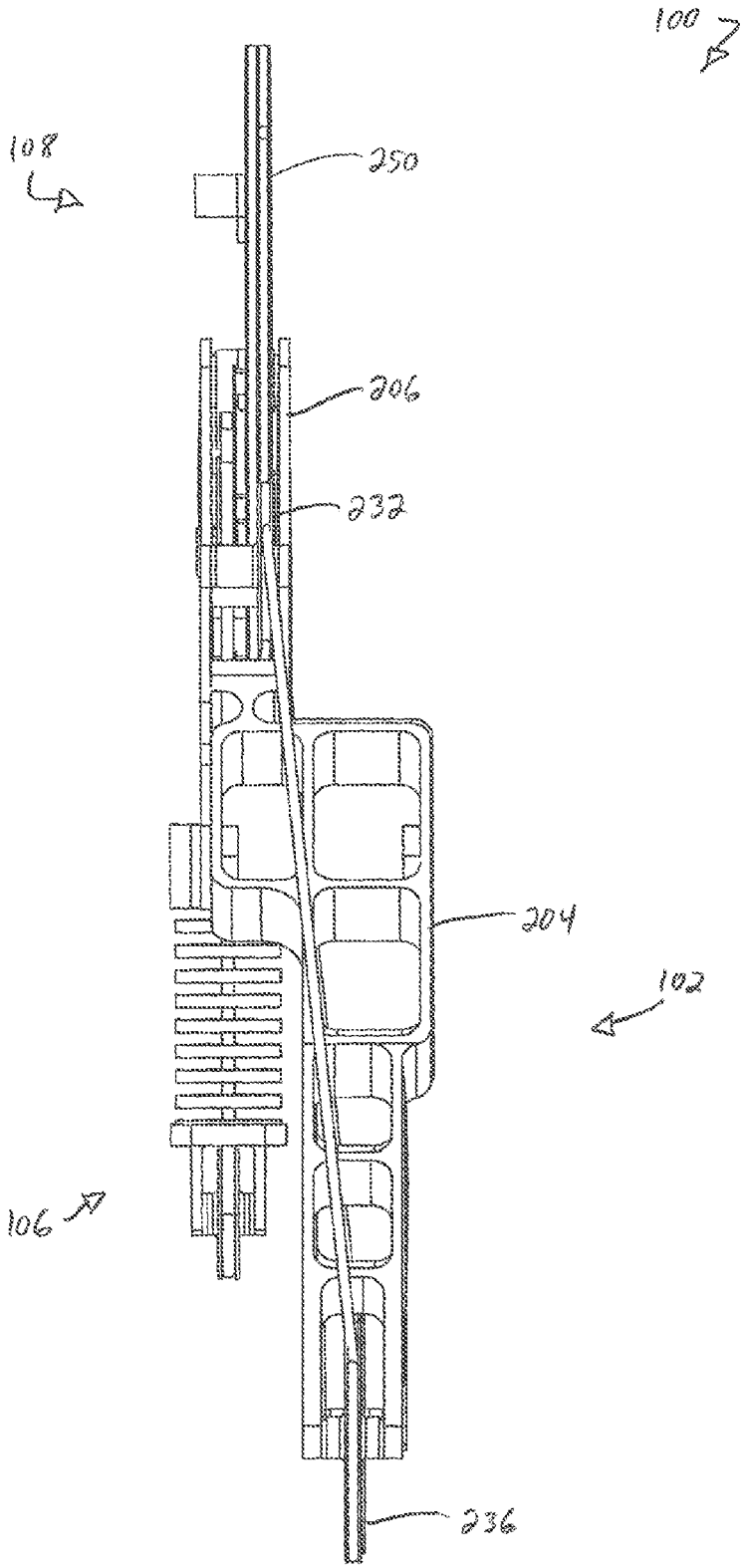
FIG. 8 is a bottom plan view of the exemplary compound bow shown in FIG. 1.

FIG. 8 is a bottom plan view of exemplary compound bow 100. Compound bow 100 includes frame 102 including lower limb 204 and secondary riser 206, power delivery mechanism 106, string feed mechanism 108, and guide wheel 232.

Figure 9:
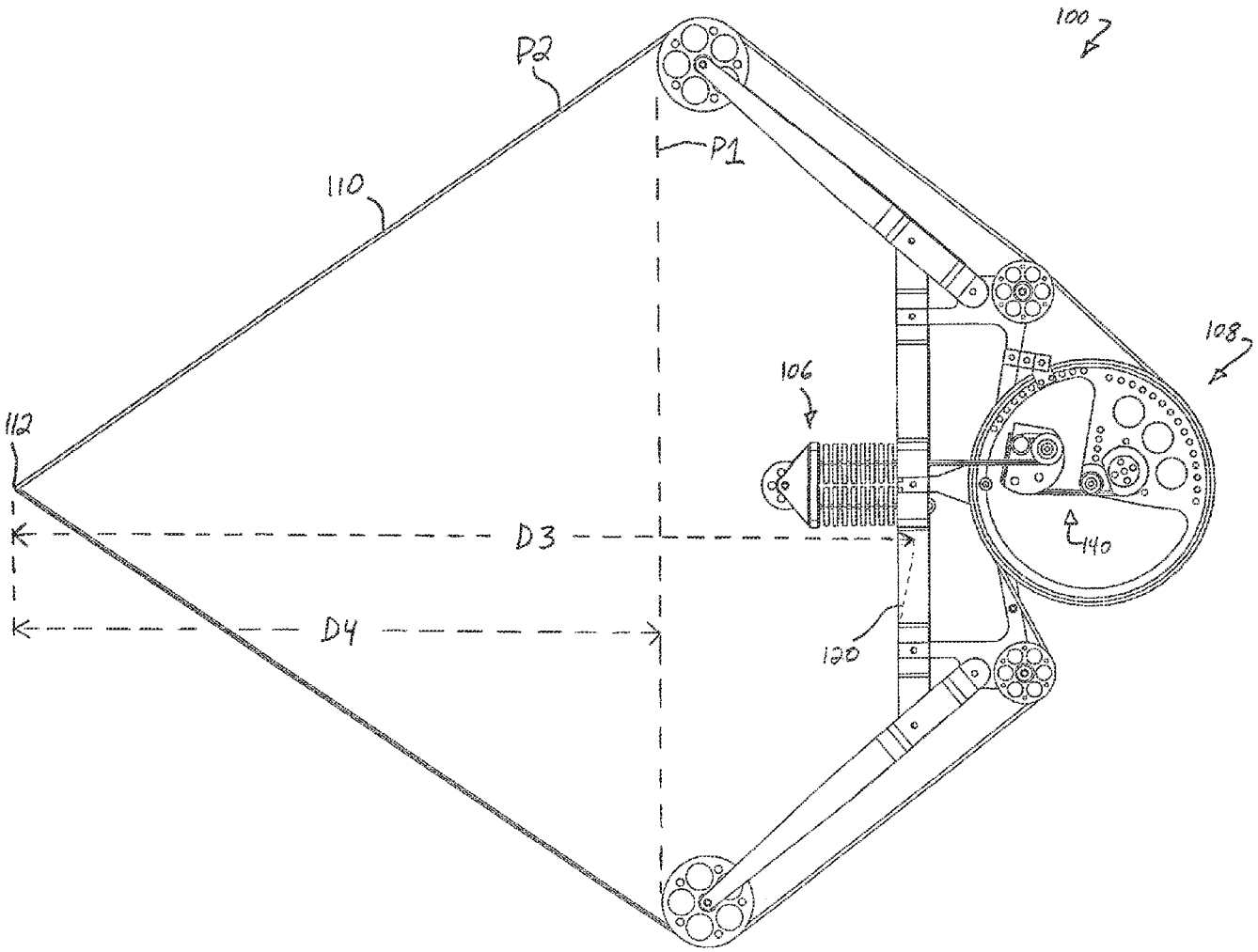
FIG. 9 is a right side elevational view of the exemplary compound bow shown in FIG. 1 in a drawn configuration.

FIG. 9 is a right side elevational view of exemplary compound bow 100 in a drawn configuration and having the right side of secondary riser 202 removed to expose portions of mechanical advantage apparatus 140 and string feed mechanism 108.

Compound bow has two primary positions. The first position is the non-drawn position in which bow string 110 is arranged at position P1 (such as previously illustrated). The second position is the drawn position in which bow string 110 is arranged in position P2. In the drawn position P2, nocking point 112 is displaced from the non-drawn position P1 a distance D4. The total draw length of compound bow 100 is distance D3, the distance from the rear side of handle portion 120 to nocking point 112. Distance D3 is equal to distance D4 plus the distance between the bow string 110 and handle portion 120 when compound bow 100 is in the non-drawn position P1.

In some possible embodiments, D3 is typically in a range from about 20 inches to about 36 inches, and for an average adult is preferably in a range from about 24 inches to about 32 inches.

As compound bow 100 is advanced from the non-drawn position P1 to the drawn position P2, added length of bow string 110 is fed from string feed mechanism 108 to allow bow string 110 to be pulled back to the desired draw length.

FIG. 10 is an enlarged right side elevational view of portions of compound bow 100 in a drawn configuration. Compound bow 100 includes frame 102, power delivery mechanism 106 and string feed mechanism 108.

When compound bow 100 is drawn, springs 142 and 144 are compressed to store energy. The length of springs 142 and 144 is D5. D5 is less when compound bow is in the drawn position (as shown in FIG. 10) than when it is in the non-drawn position (such as shown in FIGS. 1-8).

Compression of springs 142 and 144 is accomplished through the cooperation of mechanical advantage apparatus 140 and string feed mechanism 108 that acts on the force provided by the archer to bow string 110.

When an archer pulls back on bow string 110 (at nocking point 112, shown in FIG. 9), the force causes dual feed wheel 250 to rotate in direction D6 (counter-clockwise in FIG. 10) around pivot point 254. This rotation causes additional length of bow string 110 (wrapped around the periphery of dual feed wheel 250) to be provided to allow the archer to draw the bow.

At the same time, the rotation of dual feed wheel 250 causes movement within mechanical advantage apparatus 140. (Refer to FIG. 4 for a view of compound bow 100 in the non-drawn position and FIG. 10 for a view of compound bow 100 in the drawn position.) Specifically, the rotation of dual feed wheel 250 pulls on wire 402 which in turn pulls on pivoting cam 410. The force applied to pivoting cam 410 causes rotation of pivoting cam around pivot point 302. The rotation of pivoting came 410 advances an end of wire 146 around guide wheel 416. As wire 146 advances, it a compression force is transmitted through to wire 146 to pulley 148. Pulley 148 then compresses springs 142 and 144 to store the energy from the draw. Rotation of dual feed wheel 250 continues until mechanical stop mechanism 430 stops the rotation at the appropriate draw length, as shown in FIG. 10. In some embodiments, mechanical stop mechanism 430 also provides a let-off force to aid the archer in maintaining compound bow 100 in the drawn position.

Dual feed wheel 250 feeds a length of bow string 110 in two directions simultaneously as rotation occurs. The added length of bow string 110 provided by dual feed wheel 250 is related to the rotation of the feed wheel by the formula L=(R degrees/360 degrees)×Pi×D7, where L is the length of bow string 110 provided to a single side of compound bow 100, R degrees is the angle of rotation in degrees, and D7 is the diameter of dual feed wheel 250. The total added length of bow string 110 provided by dual feed wheel 250 is equal to 2×L. Because dual feed wheel 250 provides the same additional length of bow string 110 to both sides of the bow, and similarly retracts the same length of bow string 110 when the bow string is released, the nocking point 112 (shown in FIG. 9) travels in a straight line between the drawn position and the non-drawn position. Linear nock travel aids compound bow 100 in accurately propelling an arrow.

The rotation of dual feed wheel (R degrees) is typically in a range from about 90 degrees to about 270 degrees, and preferably from about 135 to about 225. Diameter D7 is the diameter of dual feed wheel 250. Diameter D7 is typically in a range from about 6 inches and about 12 inches, and preferably from about 7 inches to about 10 inches. These diameters provide an appropriate length of bow string to accommodate typical draw lengths.

Mechanical advantage apparatus 140 provides a significant mechanical advantage that magnifies the amount of force applied to compression springs 142 and 144. The magnification is calculated by dividing the force provided to the compression springs by the force provided by the archer to bow string 110. In some embodiments, the magnification is in a range from about 25 to about 45.

Figure 11:
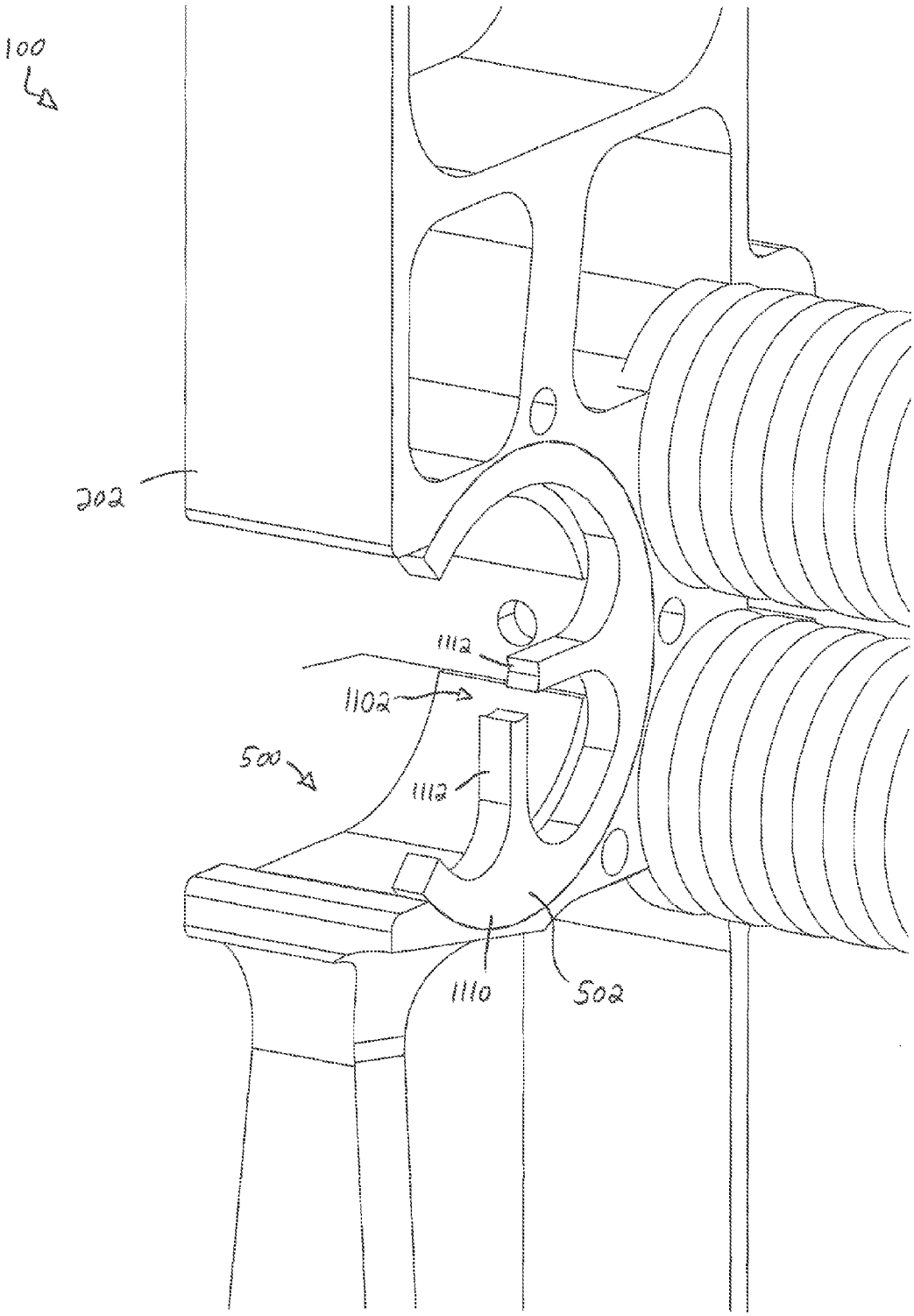
FIG. 11 is an enlarged left rear perspective view of portions of the compound bow shown in FIG. 1 illustrating an arrow rest mounting region and an exemplary arrow rest.

FIG. 11 is an enlarged left rear perspective view of portions of compound bow 100 illustrating an exemplary arrow rest mounting region 500 and arrow rest 502. Arrow rest 502 is designed to support the shaft of an arrow and to allow the arrow fletching to pass through when the arrow is fired without interfering with the arrow path. Arrow rest 502 includes a body 1110 and one or more arms 1112. Arrow rest 502 holds an arrow at the rest location 1102, at the ends of arms 1112.

Arrow rest mounting region 500 is formed as an opening within riser 202. In some embodiments, the opening is generally circular in shape but having an open side for insertion of an arrow. Arrow rest 502 is mountable within arrow rest mounting region 500. In some embodiments, arrow rest mounting region includes a keyed notch or other shape that is configured to receive only matching arrow rests 502 that have a matching keyed protrusion. In some embodiments, one or more fasteners are used to fasten arrow rest 502 with arrow rest mounting region 500. The design of compound bow 100 allows compound bow 100 to include a fixed arrow rest mounting region 500 and arrow rest 502 that is non-adjustable. For example, compound bow 100 includes a nocking point 112 that is automatically aligned with rest location 1102 so that adjustment of the arrow rest 502 is not necessary.

In some embodiments, arms 1112 are rigid structures, such as made from plastic, metal, or other rigid materials. In other embodiments, arms 1112 are flexible such that they bend out of the way when an arrow is released. In yet other embodiments, a large number of radially extending arms are provided, the arms being formed of thin bristles. For example, the Whisker Biscuit® brand arrow rest, marketed by Trophy Ridge, 817 Maxwell Avenue, Evansville, Ind. 47711, may be configured to fit within arrow rest mounting region 500.

If an archer finds that slight adjustment is preferred to the rest location 1102, however, some embodiments of compound bow 100 include arrow rests 502 that have a rest location 1102 that is arranged slightly off-center. For example, arms 1112 are sized and positioned to be offset in a range from about −0.2 inches (i.e. 0.2 inches left) to 0.2 inches (i.e. 0.2 inches right, and more preferably in a range from about −0.1 inches to about 0.1 inches. Similarly, offset rests are also provided in some embodiments to adjust the arrow rest location 1102 up or down within similar ranges. Yet other embodiments include both left/right and up/down offsets.

Figure 12:
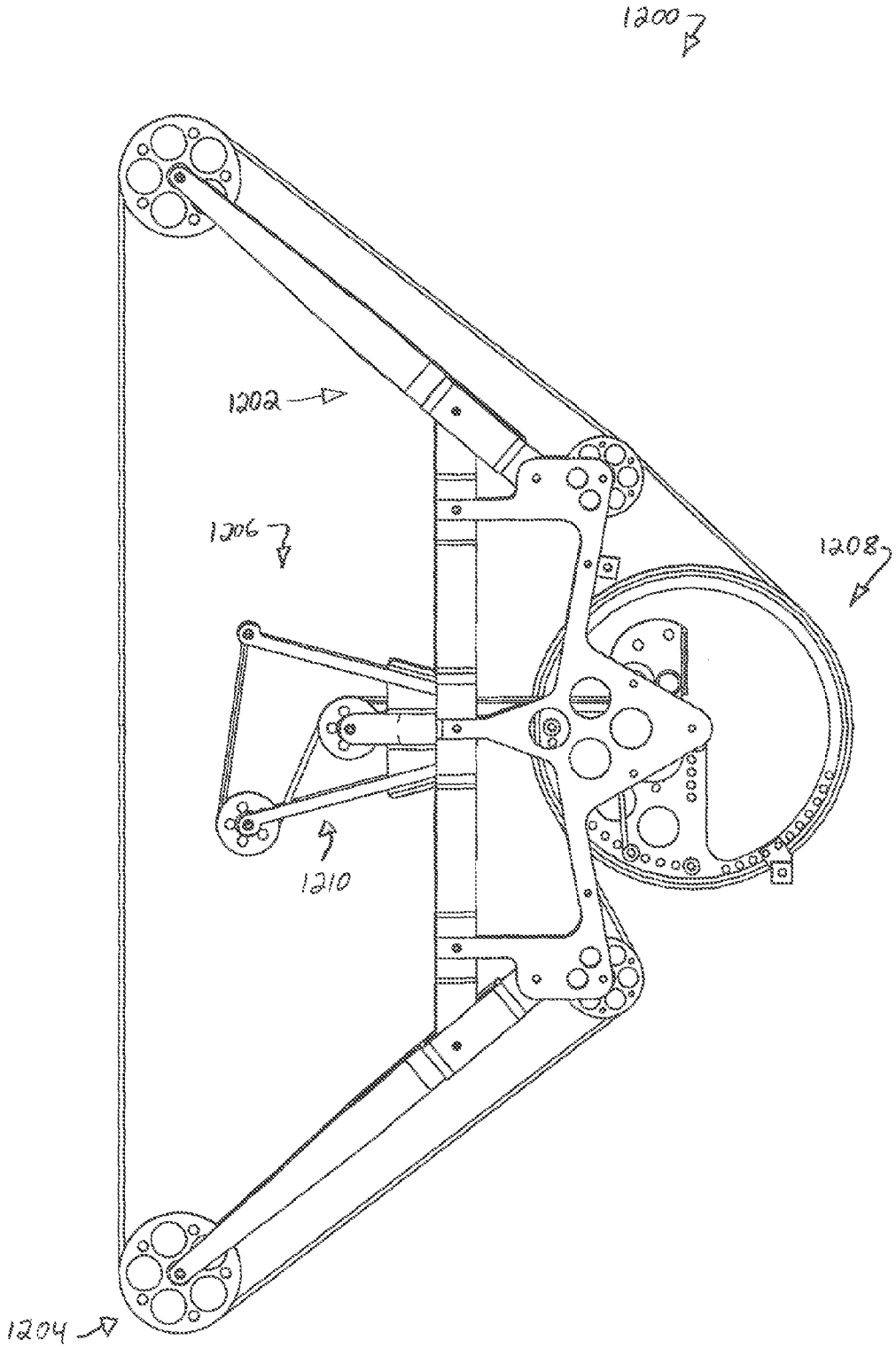
FIG. 12 is a right side elevational view of another exemplary compound bow according to the present disclosure.
Figure 13:
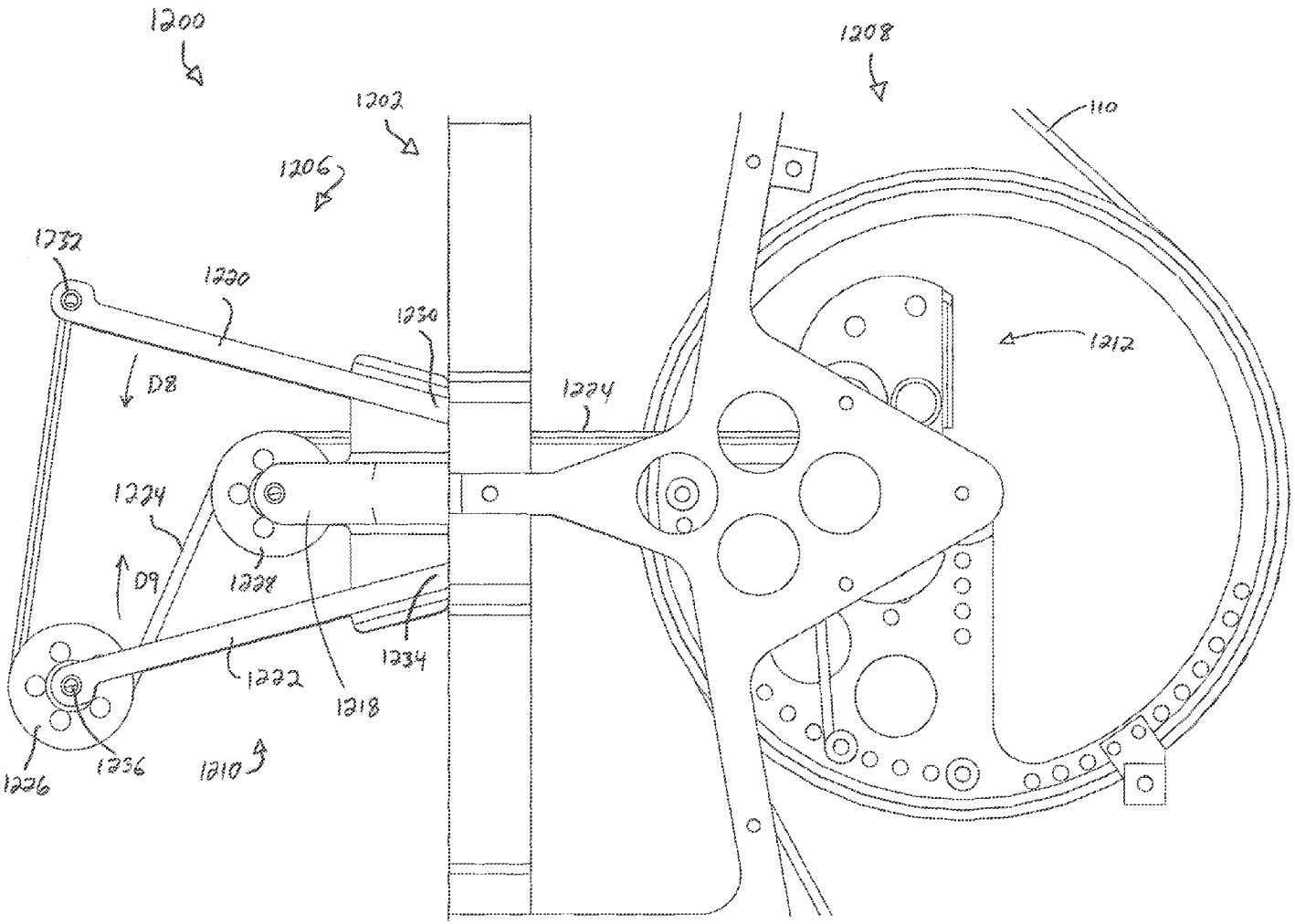
FIG. 13 is an enlarged right side elevational view of portions of the compound bow shown in FIG. 12.
Figure 14:
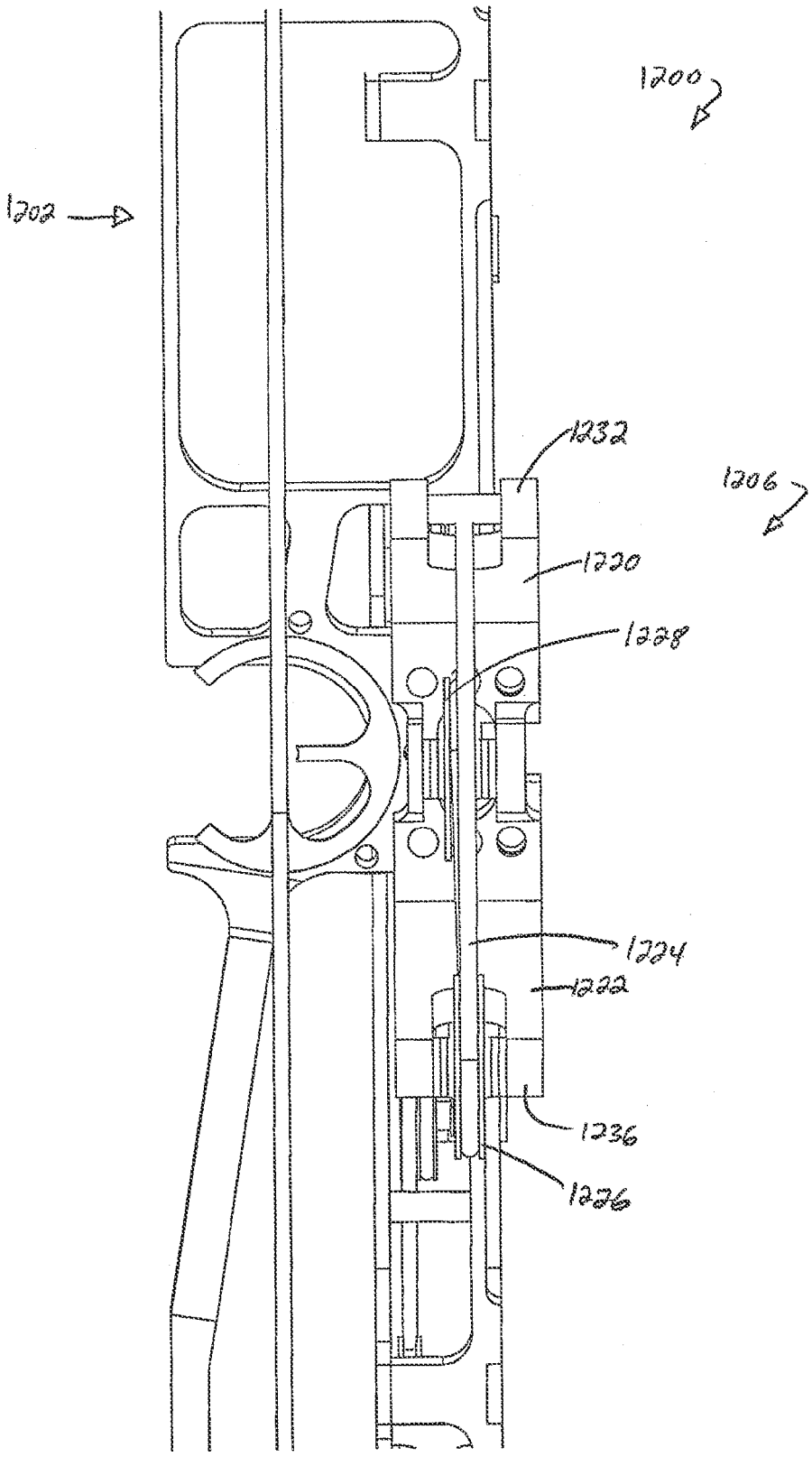
FIG. 14 is an enlarged rear elevational view of portions of the compound bow shown in FIG. 12.

FIGS. 12-14 illustrate another exemplary compound bow 1200 including flexible limbs for storing energy. FIG. 12 is a right side elevational view of exemplary compound bow 1200. Compound bow 1200 includes frame 1202, string guides 1204, power delivery mechanism 1206, and string feed mechanism 1208.

Frame 1202, string guides 1204, and string feed mechanism 1208 are similar to the respective frame 102, string guides 104, and string feed mechanism 108 described above. However, in this embodiment, power delivery mechanism 1206 includes an alternative energy storage mechanism 130 that includes limbs rather than compression springs for storage of energy provided by the archer and for delivery of the energy to propel an arrow.

FIGS. 13 and 14 illustrate further details of exemplary compound bow 1200. FIG. 13 is an enlarged right side elevational view of portions of compound bow 1200. FIG. 14 is an enlarged rear elevational view of portions of compound bow 1200. Compound bow 1200 includes power delivery mechanism 1206, string feed mechanism 1208, and bow string 110.

Power delivery mechanism includes energy storage mechanism 1210 and mechanical advantage apparatus 1212. In some embodiments, power delivery mechanism 1206 includes support member 1218, limbs 1220 and 1222, wire 1224, and pulleys 1226 and 1228. Limb 1220 includes ends 1230 and 1232. Limb 1222 includes ends 1234 and 1236.

Limb 1220 is connected to frame 1202 at end 1230. Limb 1220 extends generally rearward from frame 1202. Limb 1220 includes end 1232 that is opposite end 1230. Limb 1222 is connected to frame 1202 at end 1234. Limb 1222 extends generally rearward from frame 1202. Limb 1222 also includes end 1236 that is opposite end 1234. In some embodiments, limbs 1220 and 1222 are made of metal. In other embodiments, limbs 1220 and 1222 are made of graphite composite, carbon fiber, wood, plastic, or other suitable materials.

Wire 1224 is coupled to limbs 1220 and 1222 and acts to transfer energy between mechanical advantage apparatus 1212 and limbs 1220 and 1222. In some embodiments, wire 1224 is made of braided materials or a single strand of material, such as including metal, nylon, or a fibrous material. Other embodiments include other wire, rope, cord, or string materials.

Pulley 1226 is pivotally connected to end 1236 of limb 1222. Pulley 1228 is pivotally connected to support member 1218, between limbs 1220 and 1222. Pulleys 1226 and 1228 include a channel about the periphery of each pulley that is sized and configured to receive a portion of wire 1224 therein.

When an archer draws compound bow 1200, a force is applied to string feed mechanism 1208 causing the dual feed wheel to rotate. The force is transferred to the mechanical advantage apparatus 1212, which in turn transfers a magnified force to wire 1224. Wire 1224 is guided by pulley 1228 and 1226 and terminates at end 1232 of limb 1220. As the force is transferred through wire 1224, a force is applied to limbs 1222 and 1220. The force causes limbs 1220 and 1222 to bend inward in the directions of arrows D8 and D9, respectively. When limbs 1220 and 1222 bend, ends 1230 and 1234 remain stationary, but ends 1232 and 1236 move toward each other. This bending stores energy in limbs 1220 and 1222.

When the bow string 110 is released, the energy stored in limbs 1220 and 1222 is transferred through wire 1224 to mechanical advantage apparatus, and through string feed mechanism 1208, and finally to the bow string 110 which propels an arrow coupled to the bow string.

One suitable example of a material for limbs 1220 and 1222 is a composite material manufactured by Gordon Composites, located in Montrose, Colo. In some embodiments the material has a width and a thickness that is in a range from about 0.1 inches to about 1 inch wide, and preferably from about 0.3 inches to about 0.7 inches wide. In some embodiments, the material has a length that is in a range from about 6 inches to about 24 inches, and preferably from about 8 inches to about 14 inches. The material is then machined to the desired configuration.

Figure 15:
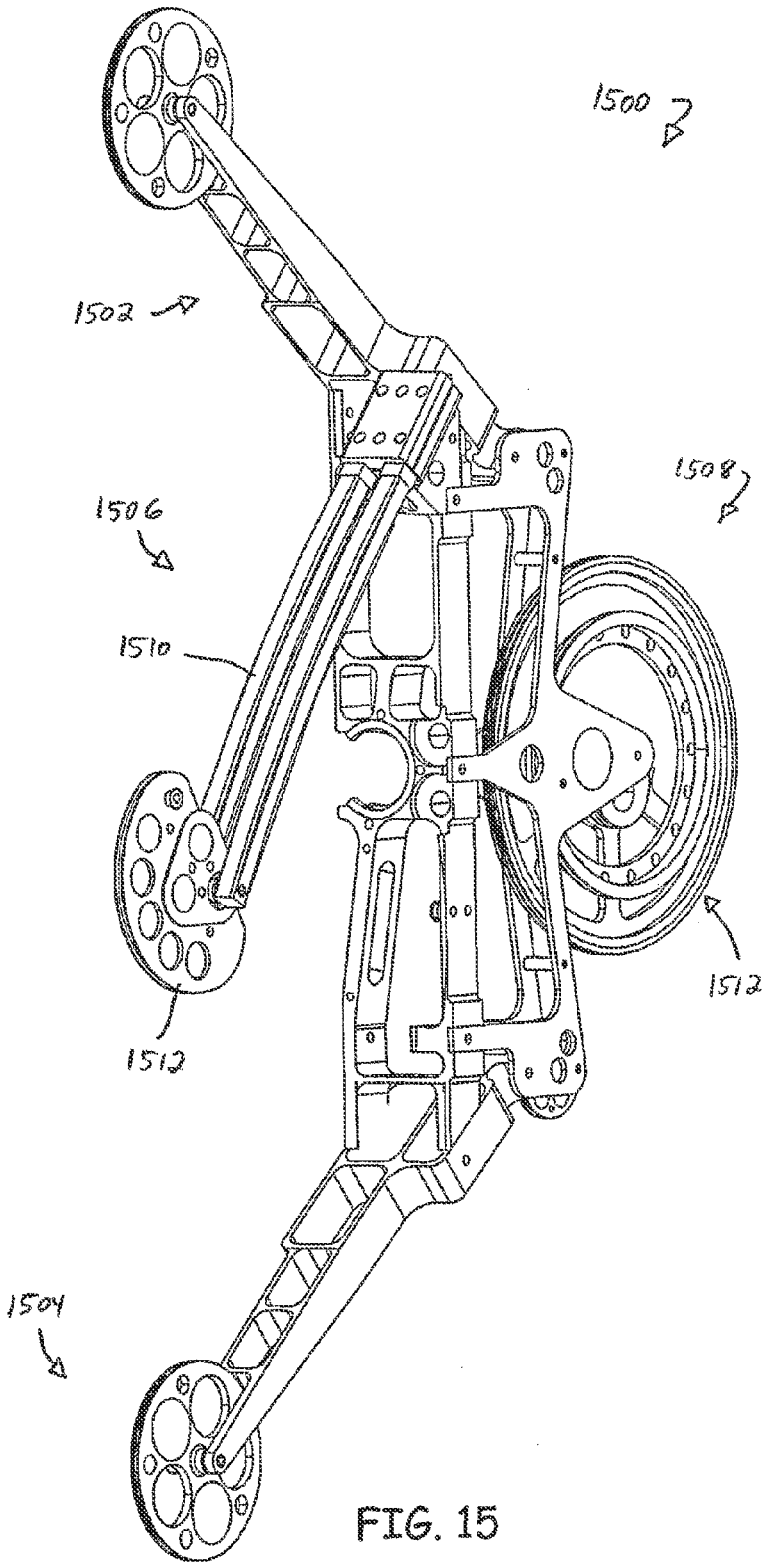
FIG. 15 is a rear right side perspective view of another exemplary compound bow according to the present disclosure.

FIG. 15 is a rear right side perspective view of another exemplary compound bow 1500. Compound bow 1500 includes frame 1502, string guides 1504, power delivery mechanism 1506, and string feed mechanism 1508.

Frame 1502 is similar to frame 102 described above, except for some modifications as shown. For example, frame 1502 is modified to connect with power delivery mechanism 1506 at a position near a top end of the riser, rather than near the center of the riser. String guides 1504 are also similar to string guides 104 described above.

Power delivery mechanism includes energy storage mechanism 1510 and mechanical advantage apparatus 1512. Power delivery mechanism 1506 and string feed mechanism 1508 are described in more detail below.

Figure 16:
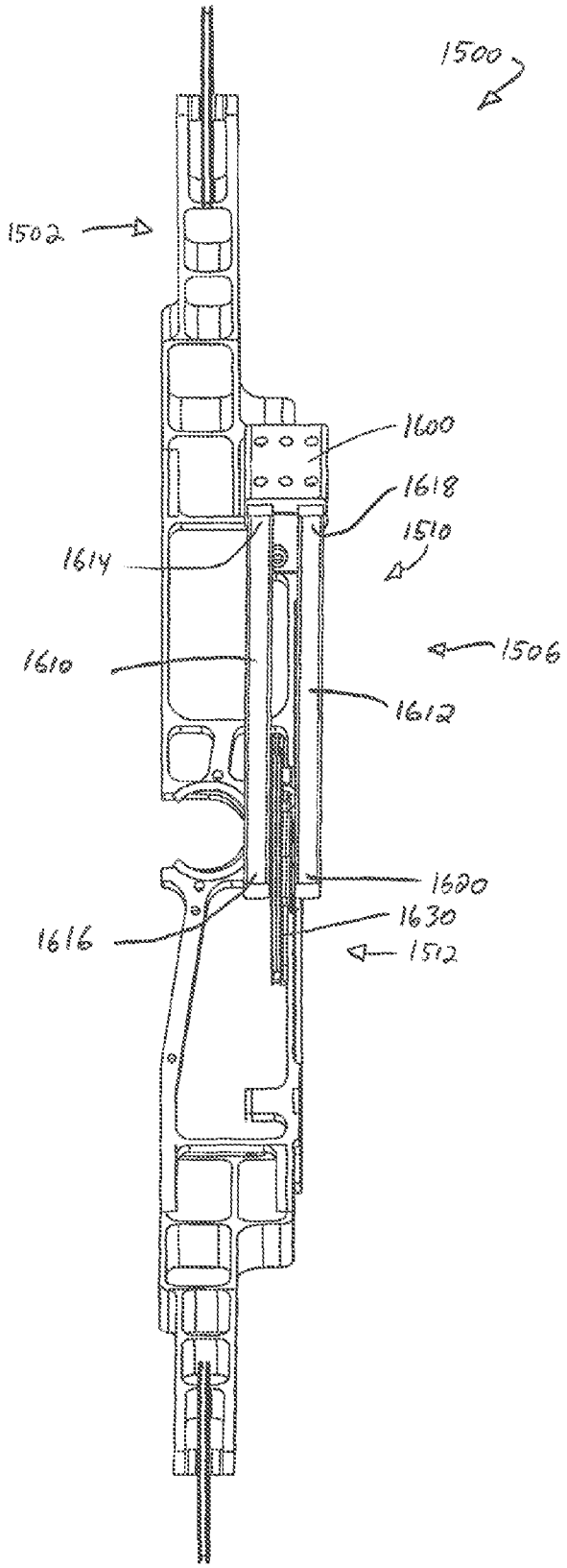
FIG. 16 is a rear elevational view of the exemplary compound bow shown in FIG. 15.
Figure 17:
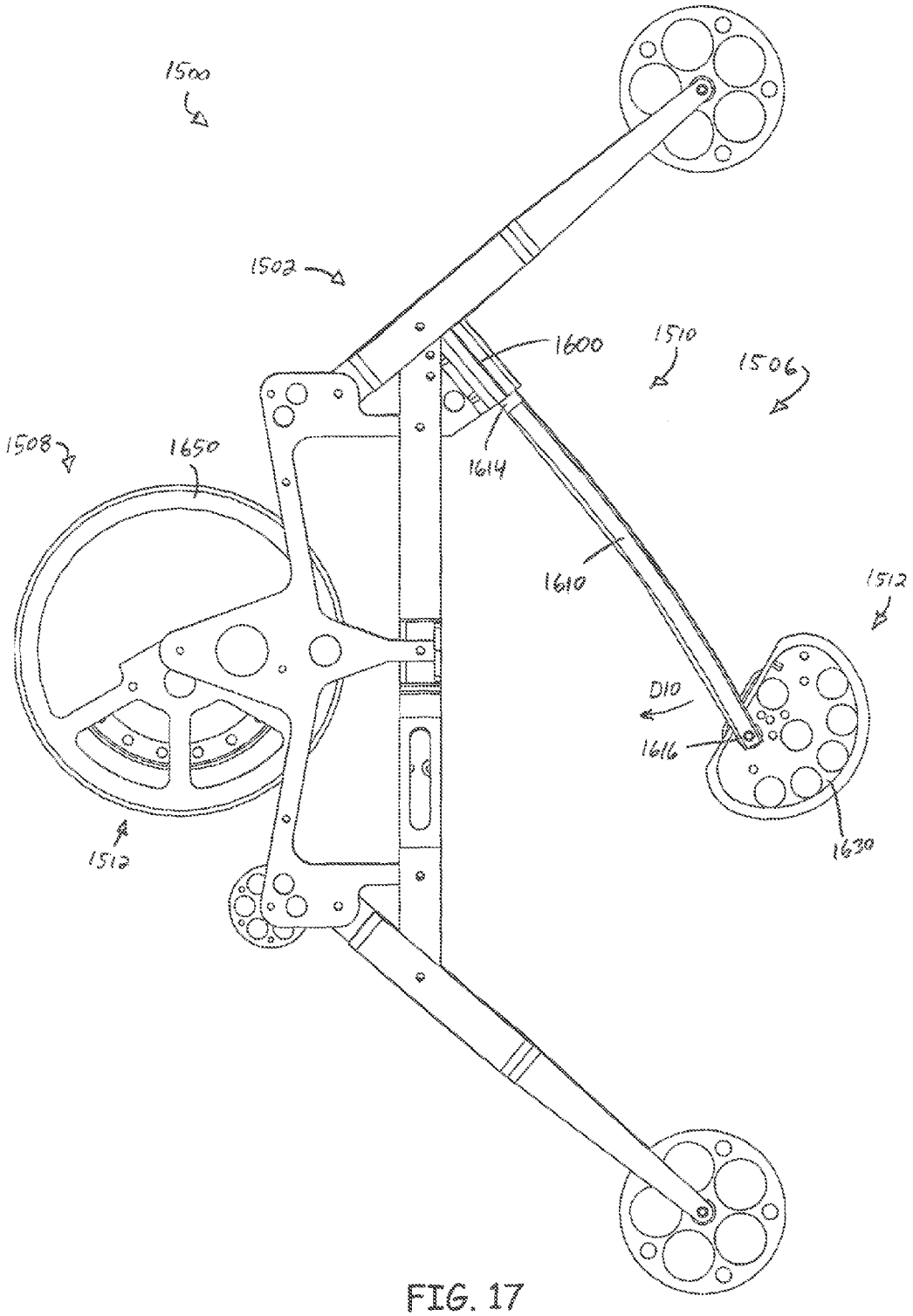
FIG. 17 is a left side elevational view of the exemplary compound bow shown in FIG. 15.

FIGS. 16 and 17 illustrate further details of exemplary compound bow 1500. FIG. 16 is a rear elevational view and FIG. 17 is a left side elevational view. Compound bow 1500 includes frame 1502, string guides 1504, power delivery mechanism 1506, and bow string feed mechanism 1508.

Frame 1502 includes support member 1600 that is connected to a top portion of the riser of frame 1502. Portions of power delivery mechanism 1506 are supported by support member 1600.

Power delivery mechanism includes energy storage mechanism 1510 and mechanical advantage apparatus 1512. In some embodiments, energy storage mechanism 1510 includes limbs 1610 and 1612. Limbs 1610 and 1612 cooperate to act as a single limb, but are spaced from each other to accommodate a portion of mechanical advantage apparatus 1512 therebetween.

Limb 1610 includes ends 1614 and 1616. Limb 1612 includes ends 1618 and 1620. Limbs 1610 and 1612 are connected to support member 1600 at ends 1614 and 1618. Limbs 1610 and 1612 project from support member 1600 in a direction generally rearward and vertically downward from support member 1600. Ends 1616 and 1620 are located at opposite ends of limbs 1610 and 1612, respectively.

Mechanical advantage apparatus 1512 includes cam 1630. Cam 1630 is pivotally connected between ends 1616 and 1620 of limbs 1610 and 1612. A wire, not shown in FIGS. 16 and 17, couples cam 1630 with other cams or wheel or mechanical advantage apparatus 1512 located on or adjacent to string feed wheel 1650.

When a draw force is applied to the bow string, the force causes string feed wheel 1650 to rotate. The rotation transfers to mechanical advantage apparatus, which transfers the force through a wire to cam 1630. The wire pulls on cam 1630 in a direction toward string feed wheel 1650. As a result of this force, limbs 1610 and 1612 flex in direction D10, shown in FIG. 17, thereby storing energy in limbs 1610 and 1612. When the bow string is released, the forces are transferred in the reverse order from limbs 1610 and 1612 and eventually to the bow string to propel an arrow.

Figure 18:
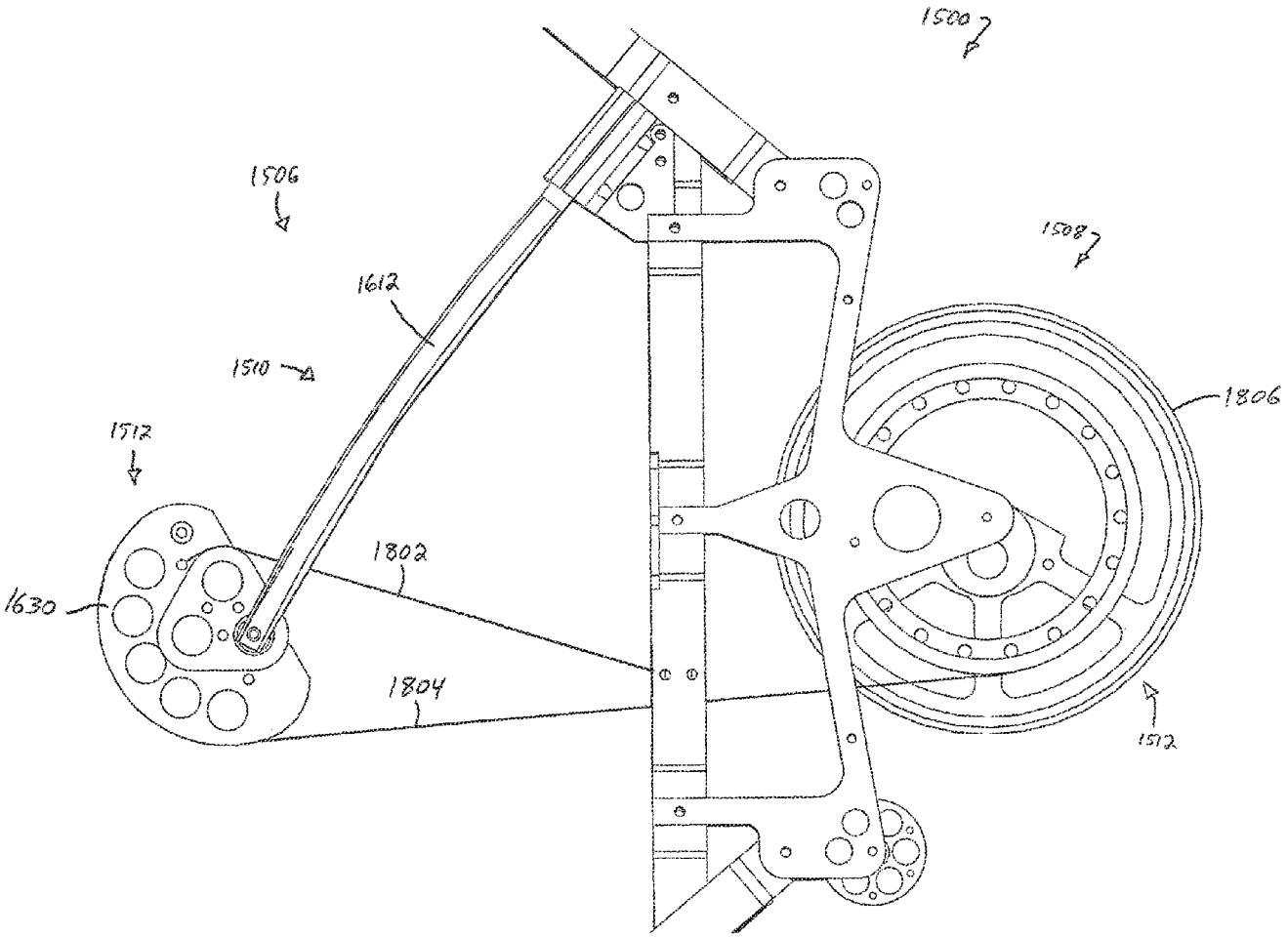
FIG. 18 is an enlarged right side elevational view of portions of the exemplary compound bow shown in FIG. 15.

FIG. 18 is an enlarged right side elevational view of portions of exemplary compound bow 1500 illustrating power delivery mechanism 1506 and bow string feed mechanism 1508. Bow string feed mechanism 1508 includes dual feed wheel 1806. Cables 1802 and 1804 are also shown.

Forces are transferred between cam 1630 and dual feed wheel 1806 by cables 1802 and 1804. Cable 1802 is connected at one end to the frame and is connected at the other end to cam 1630 as shown. Cable 1804 is also connected at one end to cam 1630 and is positioned along part of an outer periphery of cam 1630. The other end of cable 1804 is connected to dual feed wheel 1806.

When a bow string (not shown in FIG. 18) is pulled back, dual feed wheel 1806 turns in a counter-clockwise direction (as shown in FIG. 18). The rotation applies a force to cable 1804 that causes cam 1630 to rotate and bend limb 1612. In this way, elastic energy is stored in limb 1612. When the bow string is released, the energy from limb 1612 is converted into kinetic energy. The energy is transmitted through cable 1804, causing dual feed wheel 1806 to rotate, thereby transferring a force through the bow string to an arrow.

Figure 19:
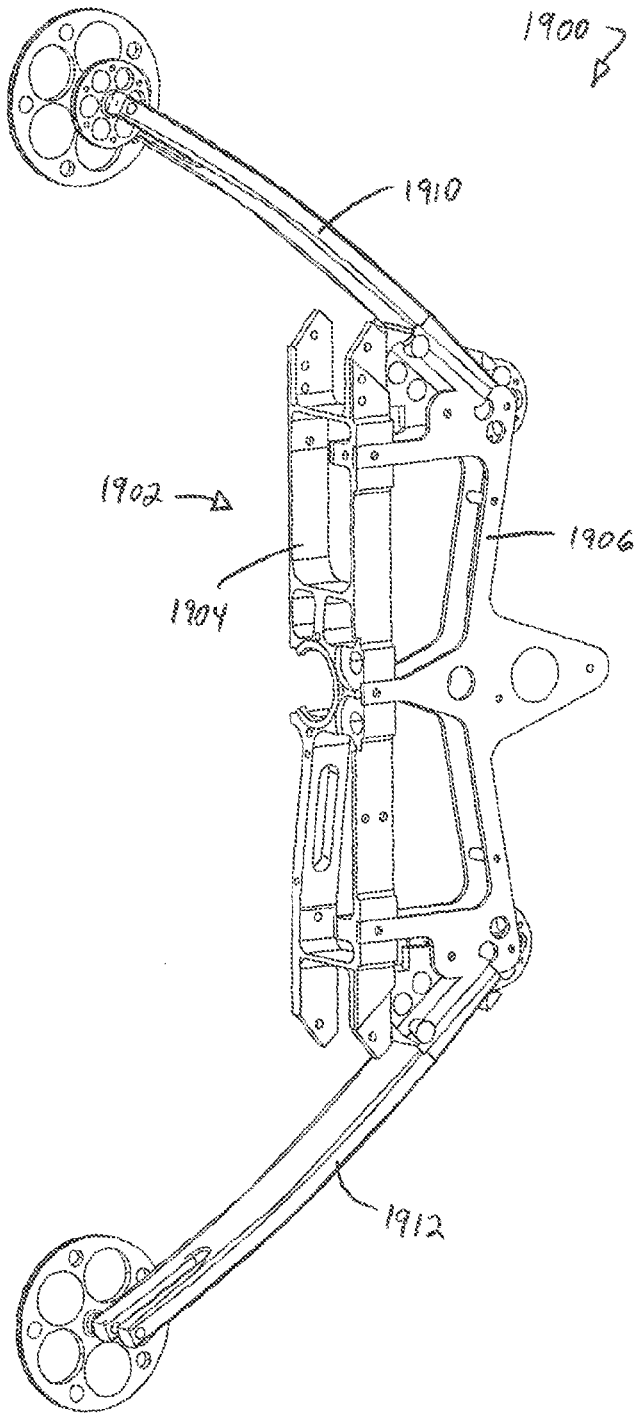
FIG. 19 is a perspective view of another exemplary embodiment of a compound bow frame of a compound bow according to the present disclosure.
Figure 20:
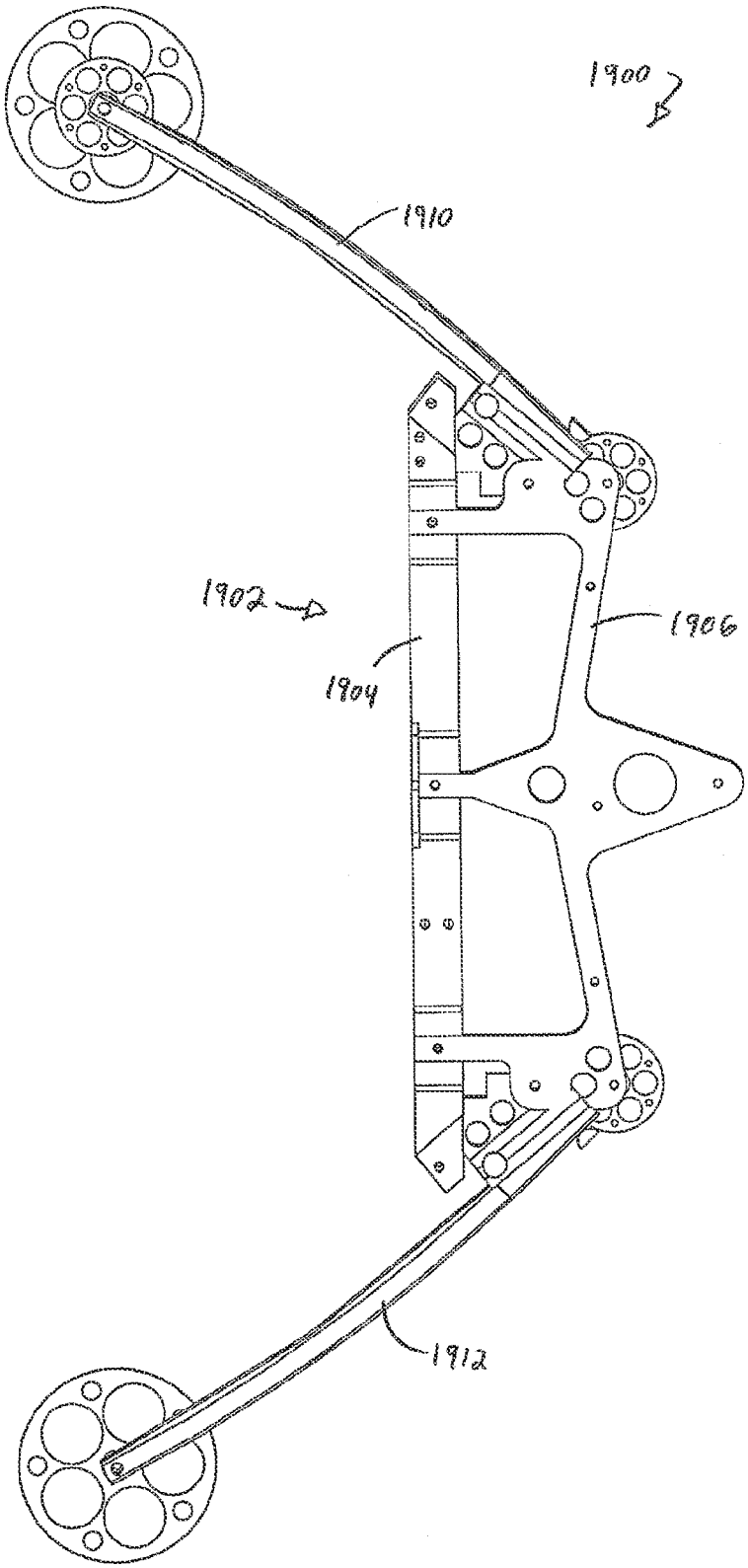
FIG. 20 is a right side view of the exemplary compound bow frame shown in FIG. 19.

FIGS. 19 and 20 illustrate another exemplary embodiment of a frame 1902 of a compound bow 1900. FIG. 19 is a rear right side perspective view. FIG. 20 is a right side elevational view. Compound bow 1900 typically includes a dual feed wheel and bow string, not shown.

Frame 1902 includes a rigid riser 1904 and secondary riser 1906, but also includes flexible limbs 1910 and 1912. Flexible limbs 1910 and 1912 store energy provided by an archer when the archer draws bow 1900. Some embodiments do not include an additional energy storage mechanism. However, other embodiments do include an additional energy storage mechanism, such as springs or additional flexible limbs.

Figure 21:
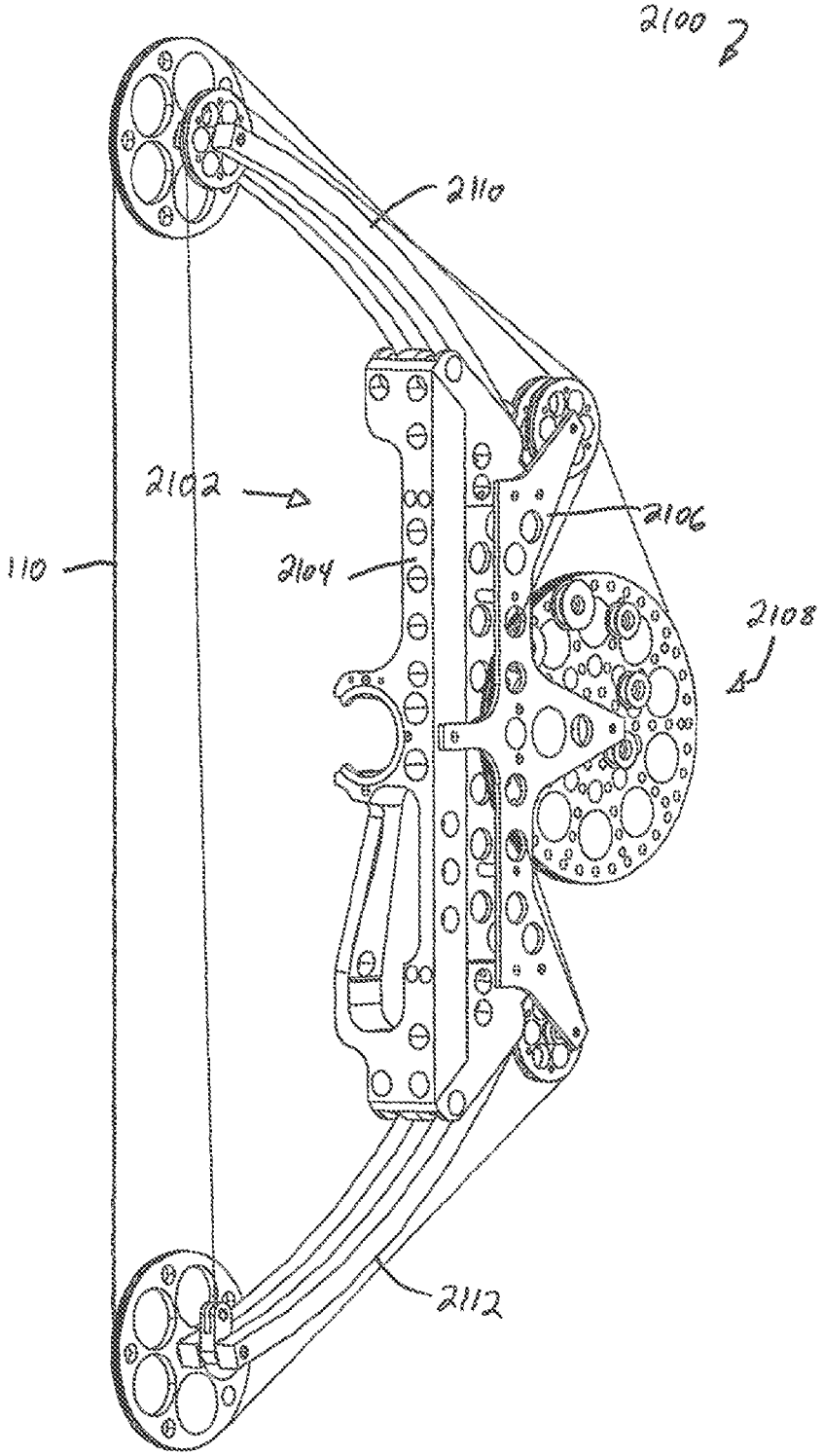
FIG. 21 is a perspective view of another exemplary embodiment of a compound bow according to the present disclosure.
Figure 22:
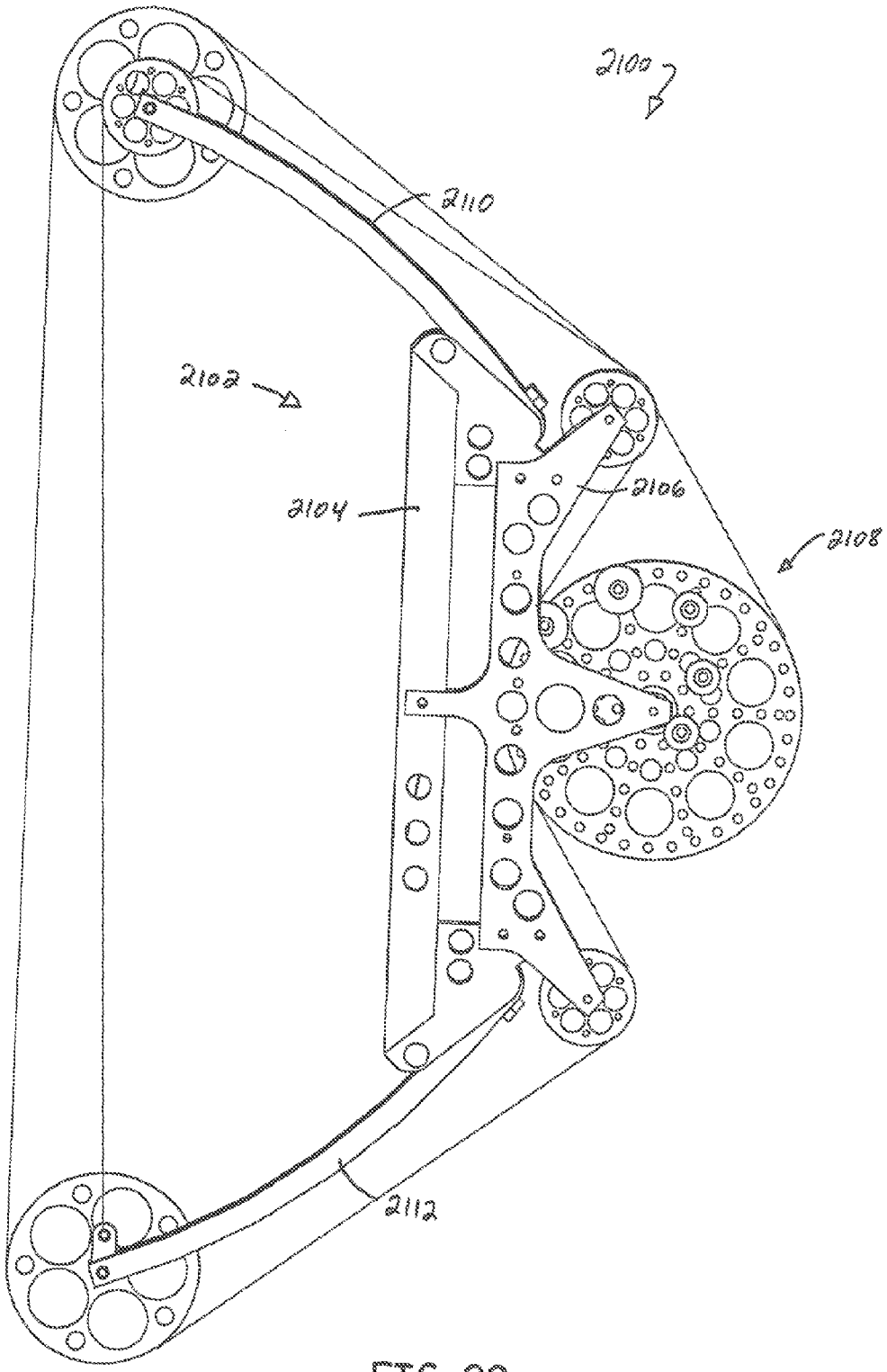
FIG. 22 is a right side elevational view of the exemplary compound bow shown in FIG. 21.
Figure 23:
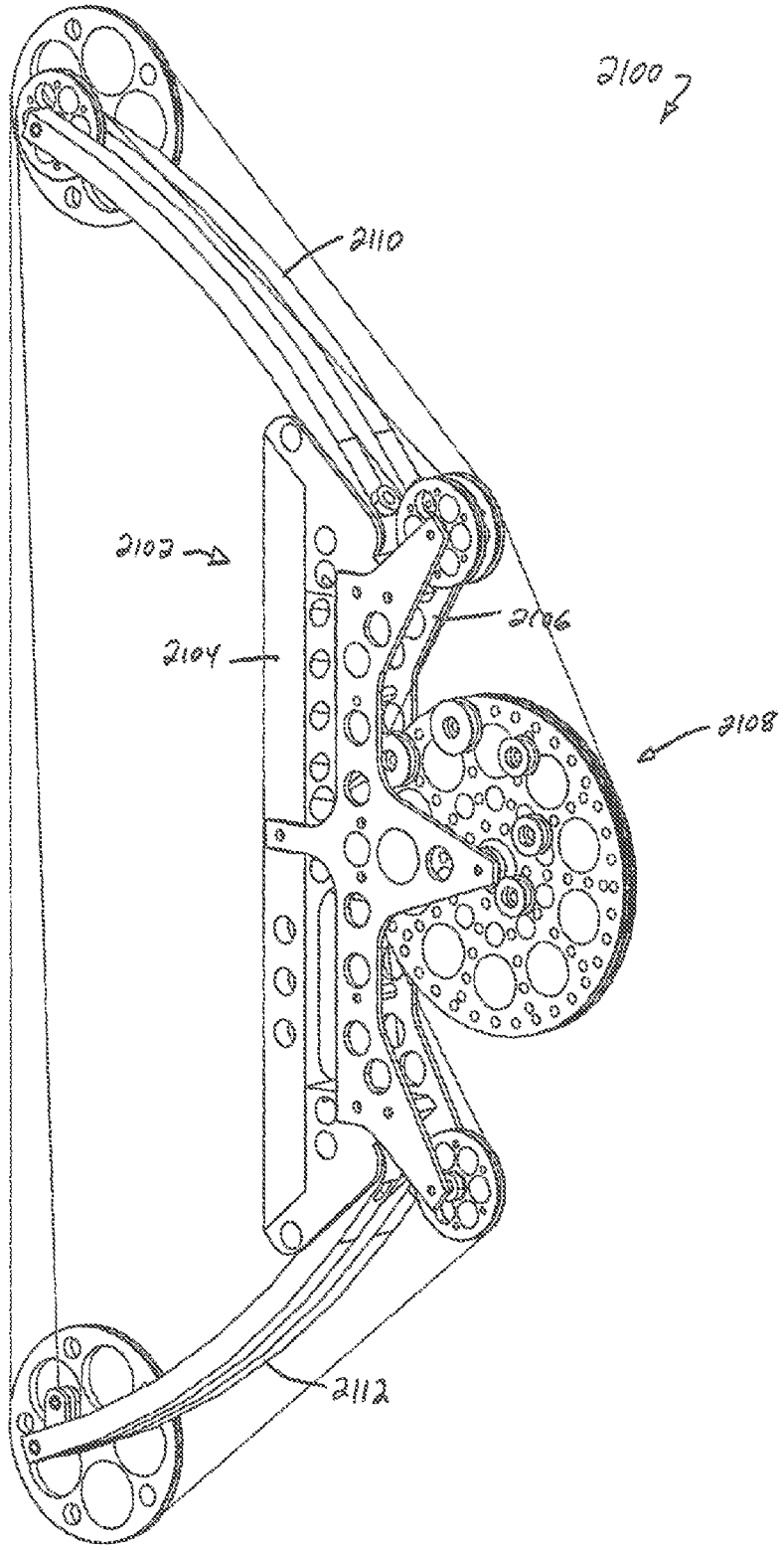
FIG. 23 is another perspective view of the exemplary compound bow shown in FIG. 21.

FIGS. 21-23 illustrate another exemplary compound bow 2100. FIG. 21 is a perspective view of the rear right side of compound bow 2100. FIG. 22 is a right side view of compound bow 2100. FIG. 23 is a front right side view of compound bow 2100.

Compound bow 2100 includes frame 2102, bow string feed mechanism 2108, and bow string 110. Frame 2102 includes riser 2104, secondary riser 2106, upper limb 2110, and lower limb 2112. Limbs 2110 and 2112 are flexible.

In some embodiments, compound bow 2100 does not include a separate energy storage mechanism apart from limbs 2110 and 2112. In this embodiment, limbs 2110 and 2112 are flexible and bend to store energy provided by an archer through the bow string 110. When the bow string is released, limbs 2110 and 2112 generate kinetic energy that is transferred to bow string 110 to propel an arrow.

Figure 24:
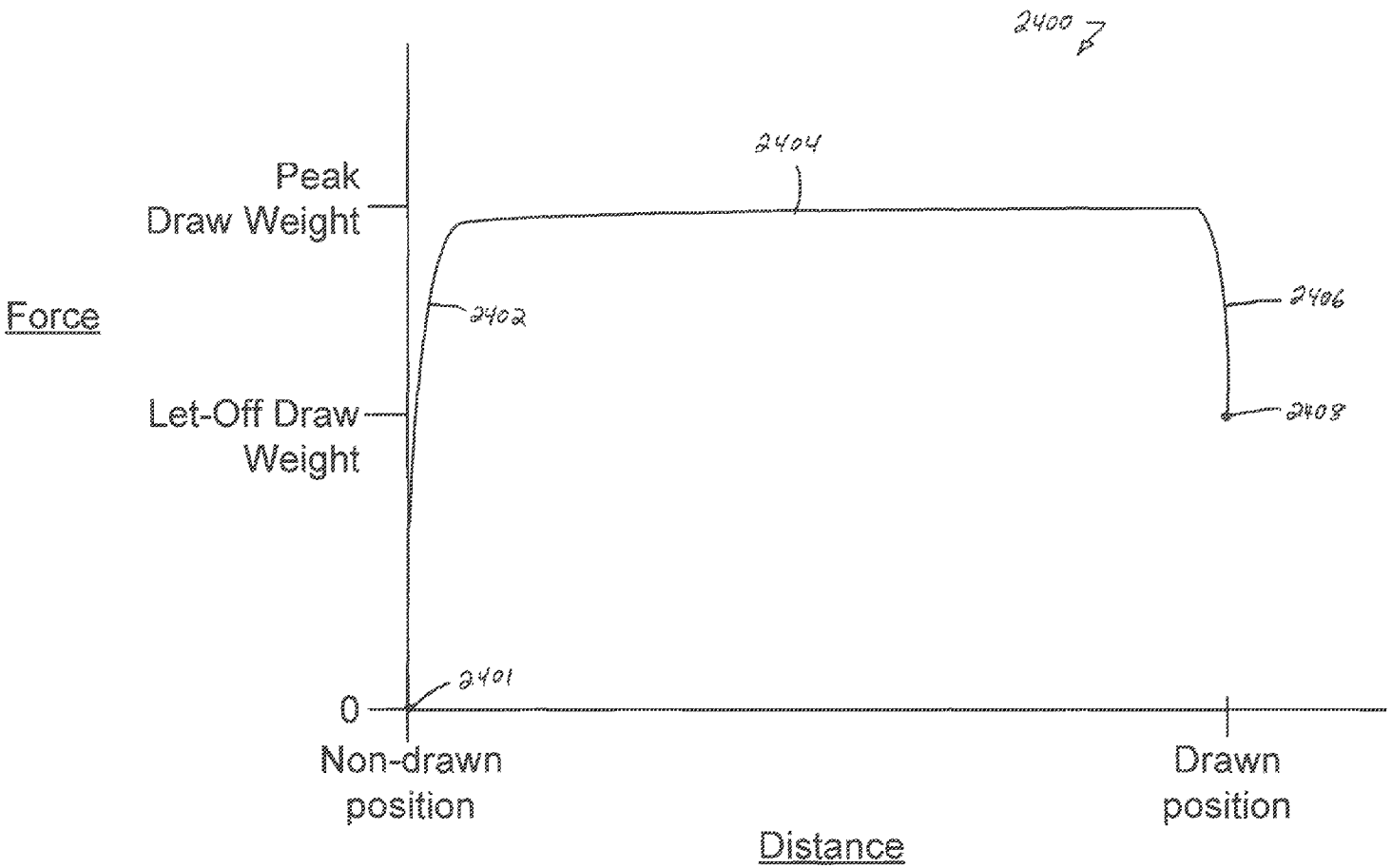
FIG. 24 is an exemplary schematic force curve illustrating the force present at a nocking point of some embodiments of a compound bow, such as the compound bow shown in FIG. 1.

FIG. 24 is an exemplary schematic force curve 2400 illustrating the force present at a nocking point of some embodiments of a compound bow, such as nocking point 112 of compound bow 100, shown in FIG. 1. Force curve 2400 begins at point 2401 and ends at point 2408. Force curve 2400 includes segment 2402, segment 2404, and segment 2406.

Force curve 2400 begins at point 2401 where the bow string is in the non-drawn position (e.g., position P1, shown in FIG. 9). An archer draws the bow by applying a rearward force to the nocking point. At the first instant, the force is equal to zero but quickly rises as shown in segment 2402.

Following segment 2402, force curve 2400 includes segment 2404. Segment 2404 is a relatively linear force segment at approximately the peak draw weight.

In this embodiment, the exemplary compound bow includes a mechanical stop mechanism and a magnetic let-off mechanism, such as mechanical stop mechanism 430, shown in FIG. 10. As the distance nears the draw length, magnetic forces begin to reduce the draw force, as shown in segment 2406. The let-off draw weight is achieved when the compound bow is in the drawn position.

Force curve 2400 stops abruptly at point 2408 due to the mechanical stop mechanism that prevents the archer from drawing beyond the desired draw length.

The area under force curve 2400 represents the total amount of energy stored in the compound bow when the bow is in the drawn position, and also the amount of energy available for propelling an arrow, less very small losses (such as due to friction).

In other possible embodiments, a magnetic mechanism is used to increase draw weight, rather than reduce draw weight. In some embodiments, a magnetic mechanism is configured to increase an amount of power delivered to an arrow when the bow string is released.

Figure 25:
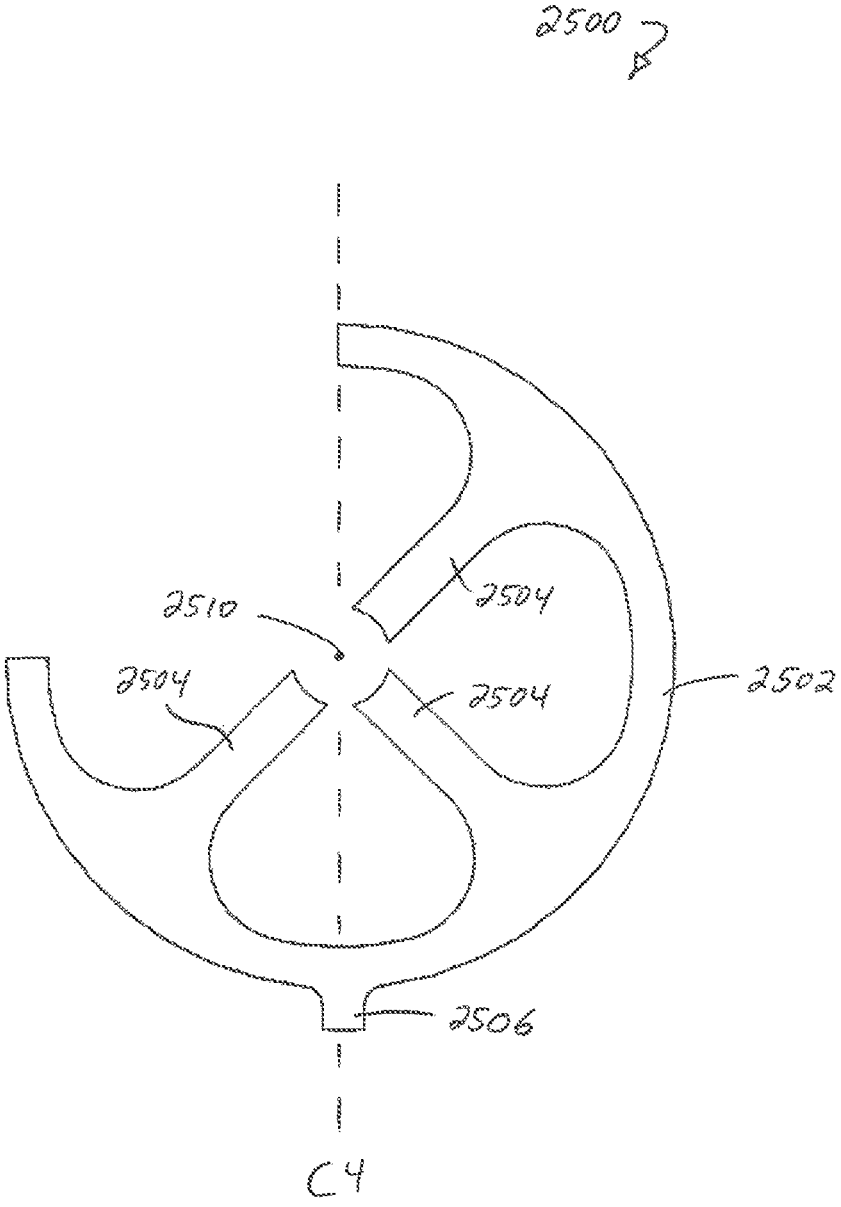
FIG. 25 is a front view of an exemplary arrow rest for use in a compound bow according to the present disclosure.

FIG. 25 is a front view of an exemplary arrow rest 2500. Arrow rest 2500 includes body 2502, one or more arms 2504, and protrusion 2506. In this example, arrow rest 2500 includes three arms. Arrow rest 2500 is configured to fit into an arrow rest mounting region, described above.

Arrow rest 2500 is configured to support a shaft of an arrow at the ends of arms 2504. In this embodiment, the shaft of an arrow may be inserted into arrow rest so that the center of the arrow shaft is aligned with the centerline C4 of arrow rest 2500. Spaces are provided between arms 2504 in some embodiments to allow fletching of the arrow to pass therethrough. In some embodiments, arms 2504 are flexible, such that when an arrow is propelled, arms 2504 are able to flex away from the arrow. In other embodiments, arms 2504 are substantially rigid. In some embodiments, arms 2504 are formed of a plurality of bristles.

Protrusion 2506 is configured to fit into a notch arranged in an arrow rest mounting region of a compound bow. In some embodiments, protrusion 2506 and the notch have a particular keyed configuration. Other embodiments have multiple notches. Yet other embodiments include other ridges, grooves, recesses, pegs, holes, fasteners, or other mounting mechanisms that allow secure connection of arrow rest 2500 to a compound bow.

Figure 26:
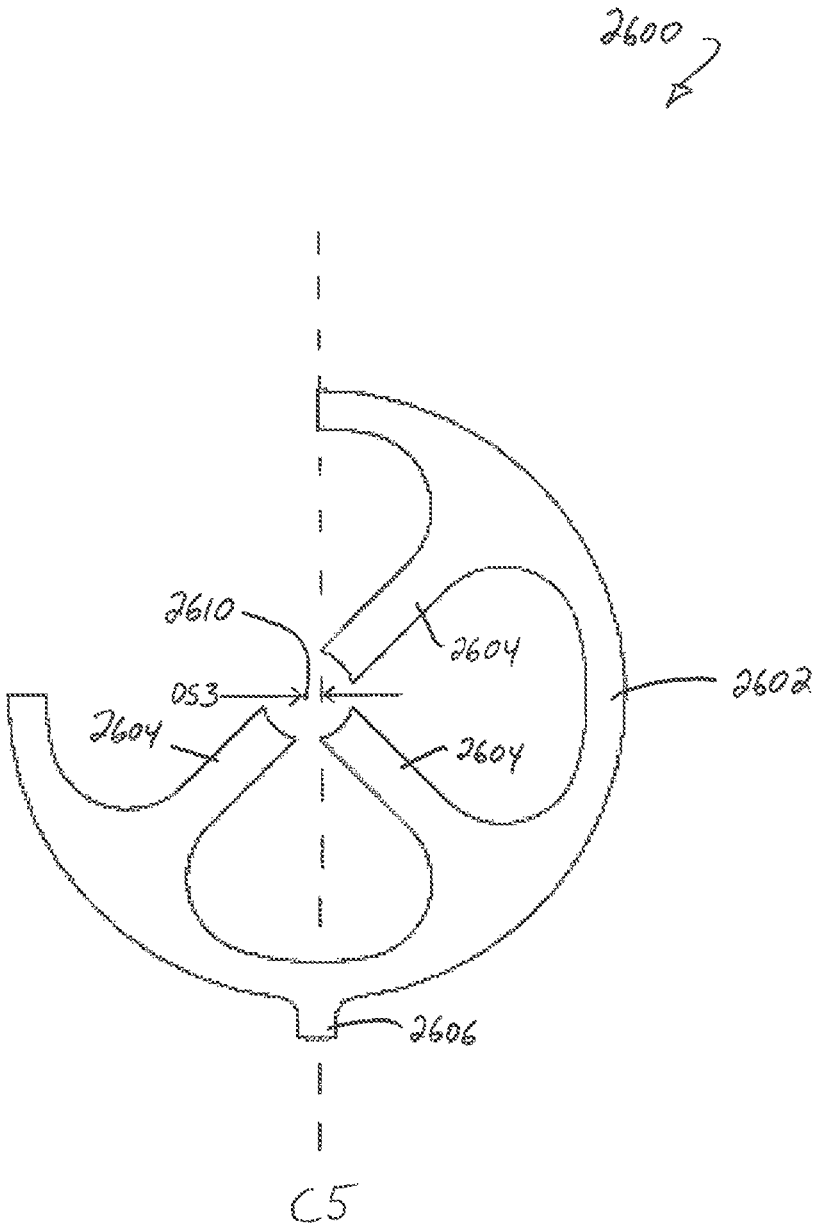
FIG. 26 is a front view of another exemplary arrow rest for use in a compound bow according to the present disclosure.

FIG. 26 is a front view of another exemplary arrow rest 2600. Arrow rest 2600 includes body 2602, one or more arms 2604, and protrusion 2606.

Some embodiments of arrow rest 2600 are offset. For example, arrow rest 2600 includes a centerline C5 that is a vertical line extending through a midpoint defined by the outer periphery of body 2602 (not including protrusion 2606). Arms 2604 are aligned offset from the centerline C5, to align an arrow shaft along point 2610. Point 2610 is offset from centerline C5. The offset distance OS3 is typically less than 0.5 inches, and more preferably in a range from about 0.05 inches to about 0.2 inches. The offset of arrow rest 2600 is left of centerline C5. In other embodiments, the offset is to the right of centerline C5. In yet other embodiments, the offset is above or below a horizontal centerline. Further, some embodiments include both a horizontal and a vertical offset.

Other example embodiments of the present disclosure are discussed below. Certain features and functions of the embodiments below are similar to the features and functions of the embodiments above. Additional features and functions are introduced by the embodiments below. The embodiments above and below are example embodiments. The features and functions of the various embodiments can be combined and/or intermixed to arrive at additional embodiments.

FIGS. 27-31 illustrate another exemplary compound bow 2700 including flexible limbs 2710, 2712 for storing energy. Compound bow 2700 further includes a substantially rigid frame 2702, guide wheels 2734, 2736, a feed wheel 2750, a handle 122, and a bow string 110. Various additional guide wheels 2730, 2730', 2732 may be optionally included and reconfigured.

The frame 2702 includes a riser 2720 that extends from a first end 2722 to a second end 2724. Clamps 2742, 2744 are positioned and preferably fixedly attached at the first and second ends 2722, 2724 of the riser 2720. A center piece 2740 is positioned and preferably fixedly attached to the riser 2720 between the first and second ends 2722, 2724. The center piece 2740 is preferably approximately centered between the first and second ends 2722, 2724. The position of the center piece 2740 is adjustable in some embodiments, and is non-adjustable in other embodiments. The center piece 2740 includes an arrow rest 2760, mounts the handle 122, and rotatably mounts the feed wheel 2750. All or portions of the clamps 2742, 2744; the center piece 2740; the handle 122; and the riser 2720 may be separate pieces or they may be combined into a single piece construction.

Figure 30:
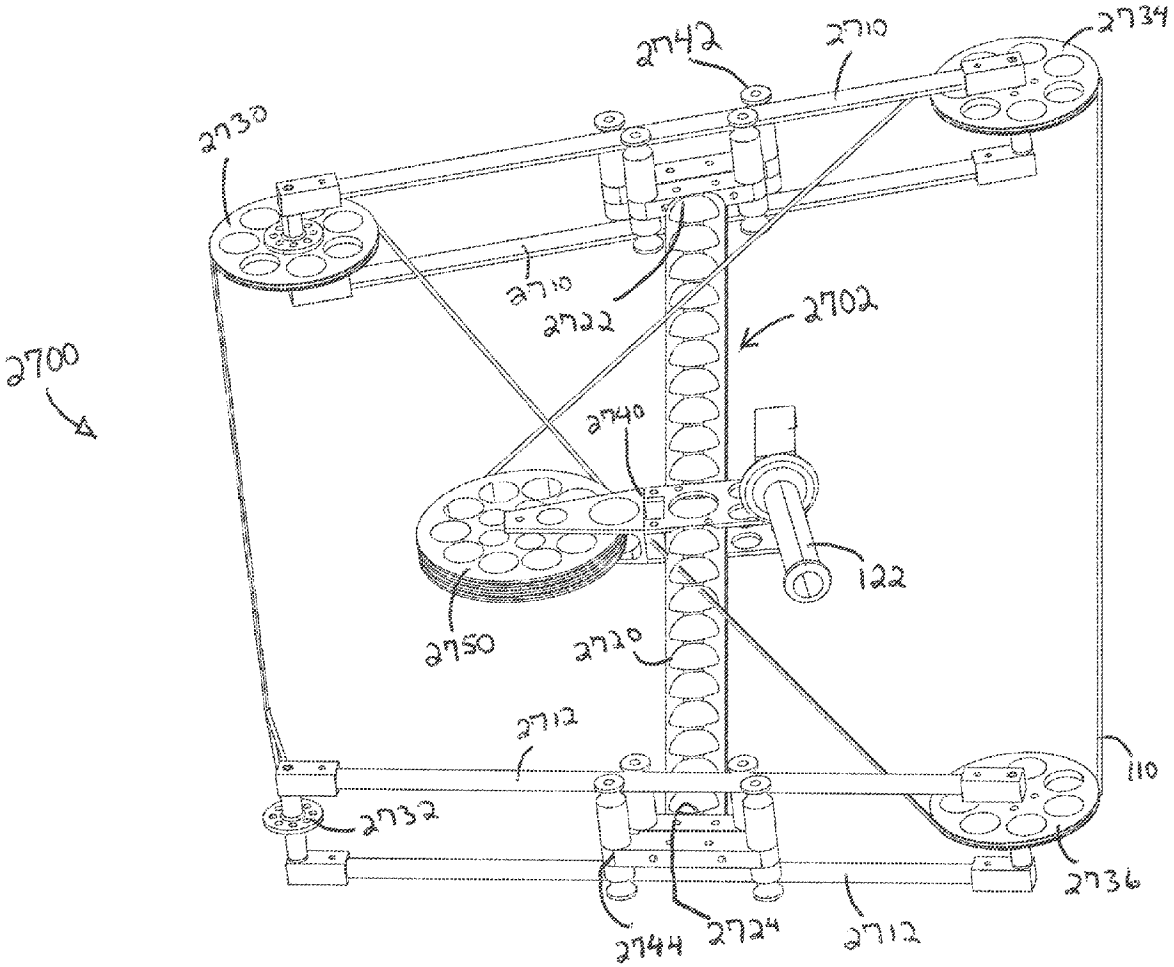
FIG. 30 is yet another perspective view of the exemplary compound bow shown in FIG. 27.
Figure 31:
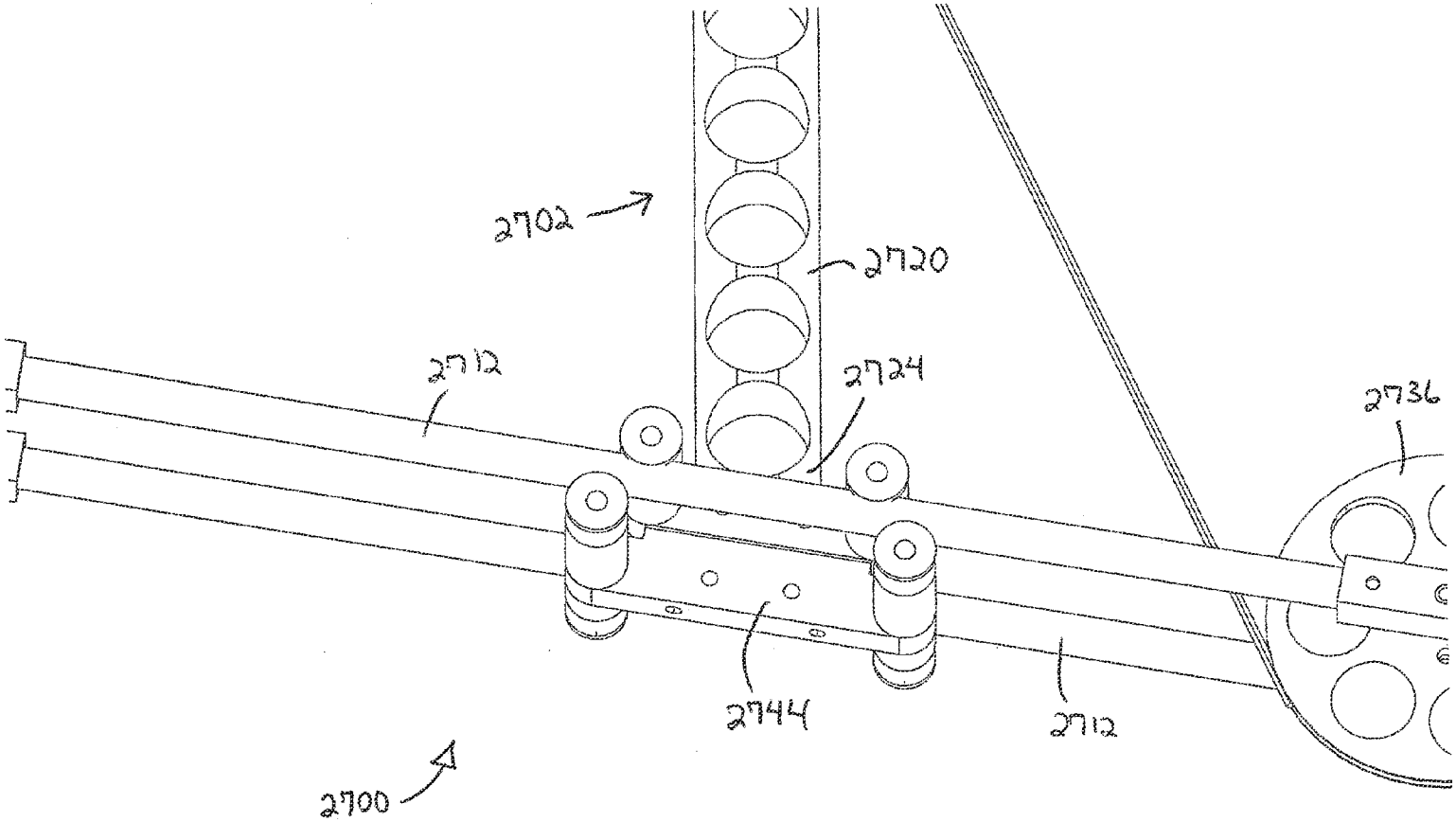
FIG. 31 is an enlarged partial perspective view of portions of the exemplary compound bow shown in FIG. 27.

The flexible limbs 2710, 2712 are preferably clamped in the clamps 2742, 2744 respectively. In certain embodiments, the flexible limbs 2710, 2712 can be adjusted in position relative the riser 2720 by repositioning them within the clamps 2742, 2744. In other embodiments, the position of the flexible limbs 2710, 2712 is non-adjustable. In preferred embodiments, the flexible limbs 2710, 2712 are positioned along their length in the clamps 2742, 2744. The flexible limbs 2710, 2712 are preferably used in pairs as best illustrated at FIG. 30. The pairs of flexible limbs 2710, 2712 are preferably positioned at opposite sides of the riser 2720 and the guide wheels 2730, 2730', 2732, 2734, 2736. Other embodiments of limbs 2710, 2712 include unitary limbs having cutout regions for positioning of guide wheels or other features. Yet other embodiments of limbs 2710, 2712 have more than two members that work together as a single limb. In the discussion below, limbs 2710, 2712 are referred to in the singular, even though some embodiments of limbs 2710, 2712 include two or more members.

The flexible limb 2710 defines a first end 2714 and a second end 2715. Likewise, the flexible limb 2712 defines a first end 2716 and a second end 2717. The guide wheel 2734 is rotatably mounted at or near the end 2715 of the flexible limb 2710. Likewise, the guide wheel 2736 is rotatably mounted at or near the end 2717 of the flexible limb 2712.

Figure 27:
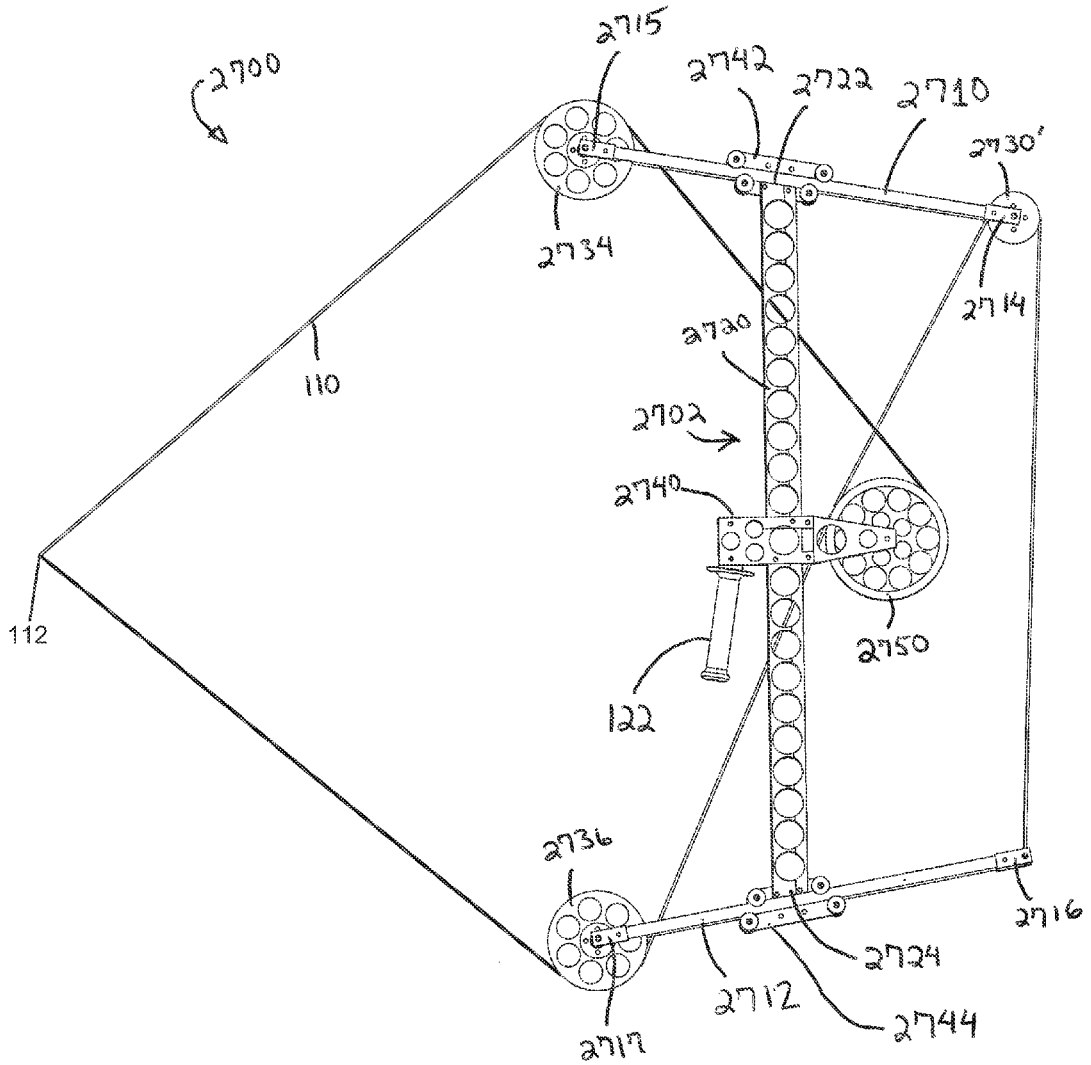
FIG. 27 is a perspective view of another exemplary embodiment of a compound bow according to the present disclosure.
Figure 28:
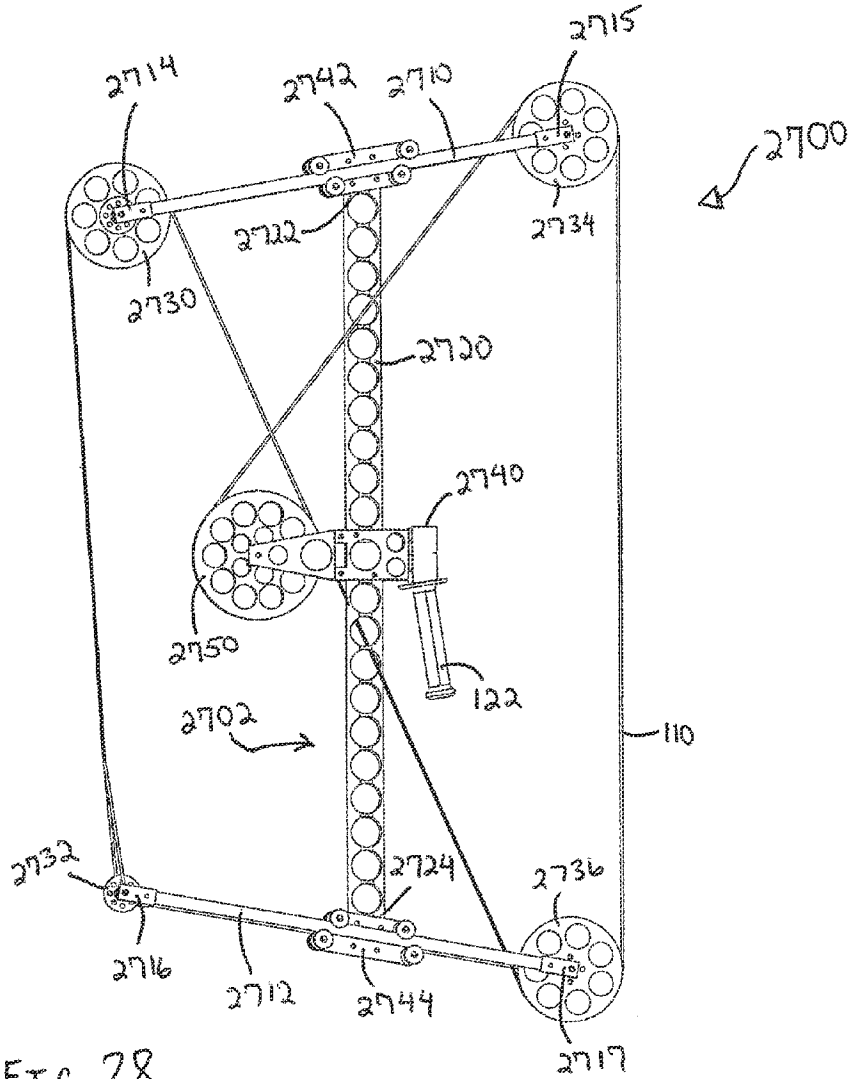
FIG. 28 is another perspective view of the exemplary compound bow shown in FIG. 27.
Figure 29:
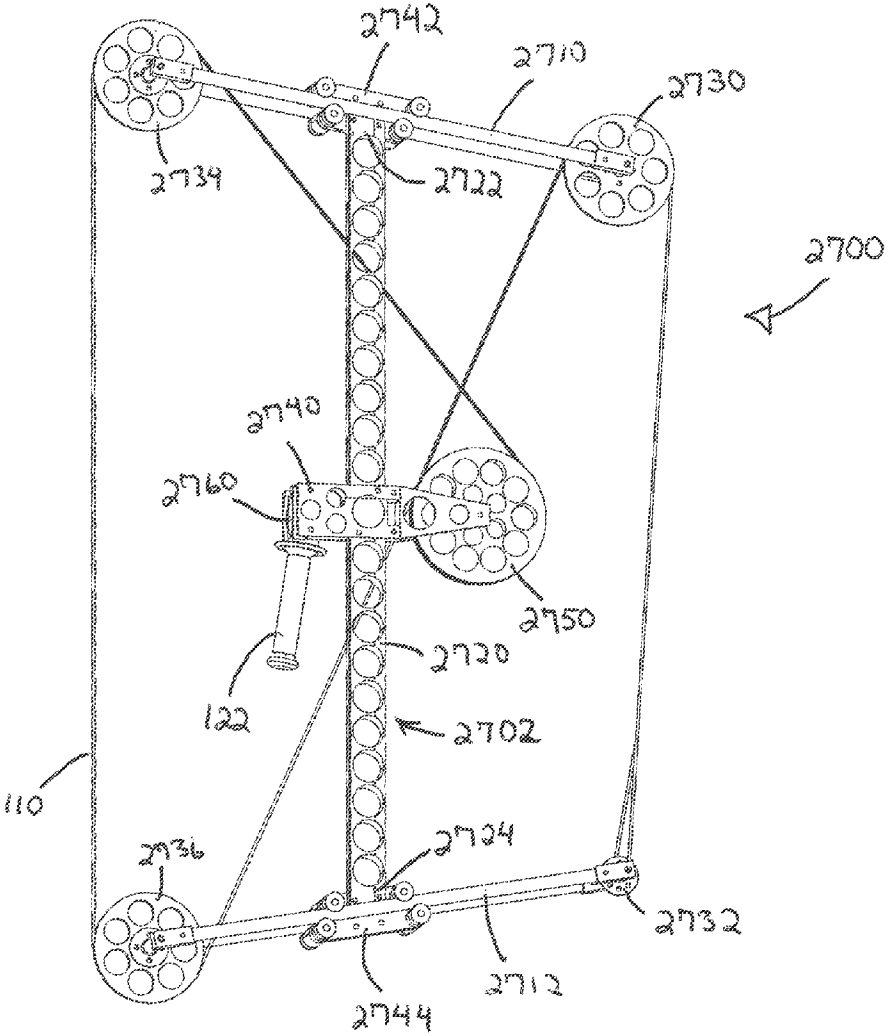
FIG. 29 is still another perspective view of the exemplary compound bow shown in FIG. 27.

In the embodiment depicted at FIG. 27, a first end of the bow string 110 is connected at the first end 2716 of the flexible limb 2712. From there, the bow string 110 is routed to guide wheel 2730' rotatably mounted at the first end 2714 of the flexible limb 2710. The bow string 110 loops around guide wheel 2730' and next loops around feed wheel 2750 thus rotationally engaging feed wheel 2750. The bow string 110 next loops around guide wheel 2736 and further loops around guide wheel 2734. An arrow engaging portion of the bow string 110 is defined between the guide wheels 2734 and 2736. FIG. 27 illustrates the compound bow 2700 in a drawn position with the arrow engaging portion (e.g., nocking point) of the bow string 110 at or near a vertex along the bow string 110 between the guide wheels 2734, 2736. From guide wheel 2734, the bow string 110 next is attached to feed wheel 2750. The bow string 110 is preferably at least partially wrapped around feed wheel 2750 and partially unwraps as the compound bow 2700 is drawn. The feed wheel 2750 thus coordinates the movement of bow string 110. As described above, different embodiments include different arrangements for routing the bow string 110 away from the path of the arrow.

As the bow 2700 is drawn, the flexible limbs 2710, 2712 flex and store energy. The flexing of the flexible limbs 2710, 2712 occurs between the clamps 2742, 2744 and both ends 2714, 2715, 2716, 2717. When the bow string 110 is released (see FIGS. 28-30) the flexible limbs 2710, 2712 unflex and release the stored energy to the arrow thereby propelling the arrow.

An example of a force compounding system is shown in FIG. 27. In this example, the force compounding system includes guide wheel 2730' and feed wheel 2750.

Figure 32:
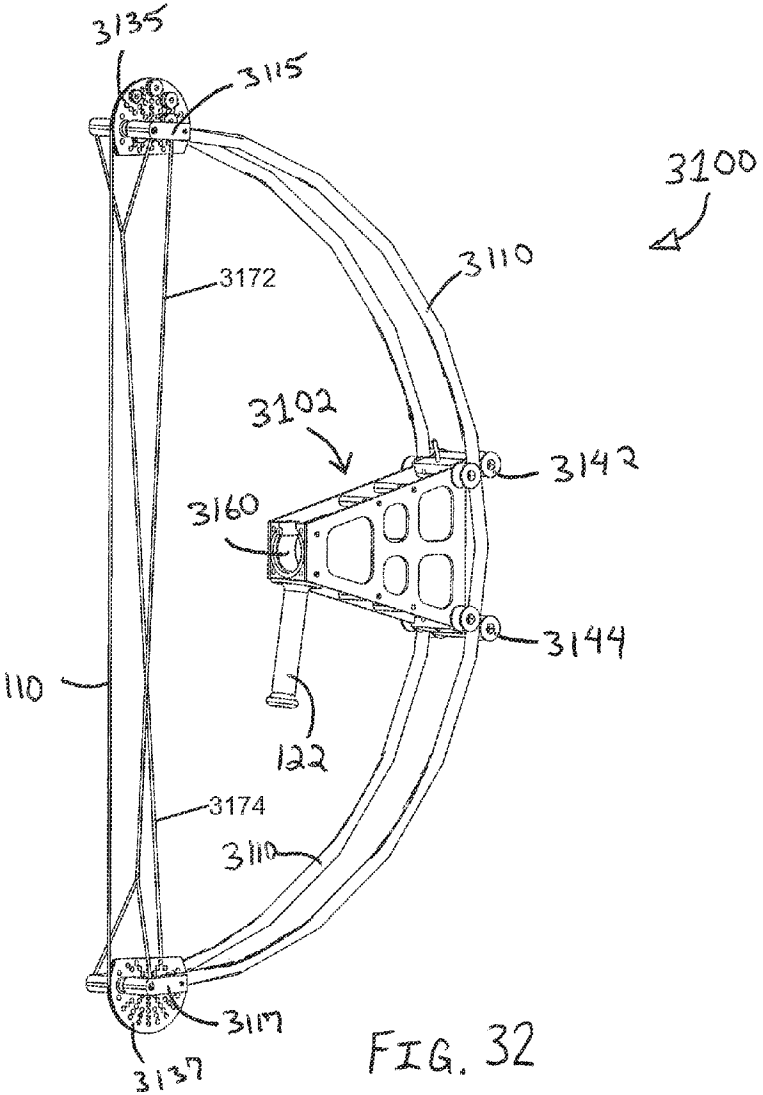
FIG. 32 is a perspective view of another exemplary embodiment of a compound bow according to the present disclosure.
Figure 33:
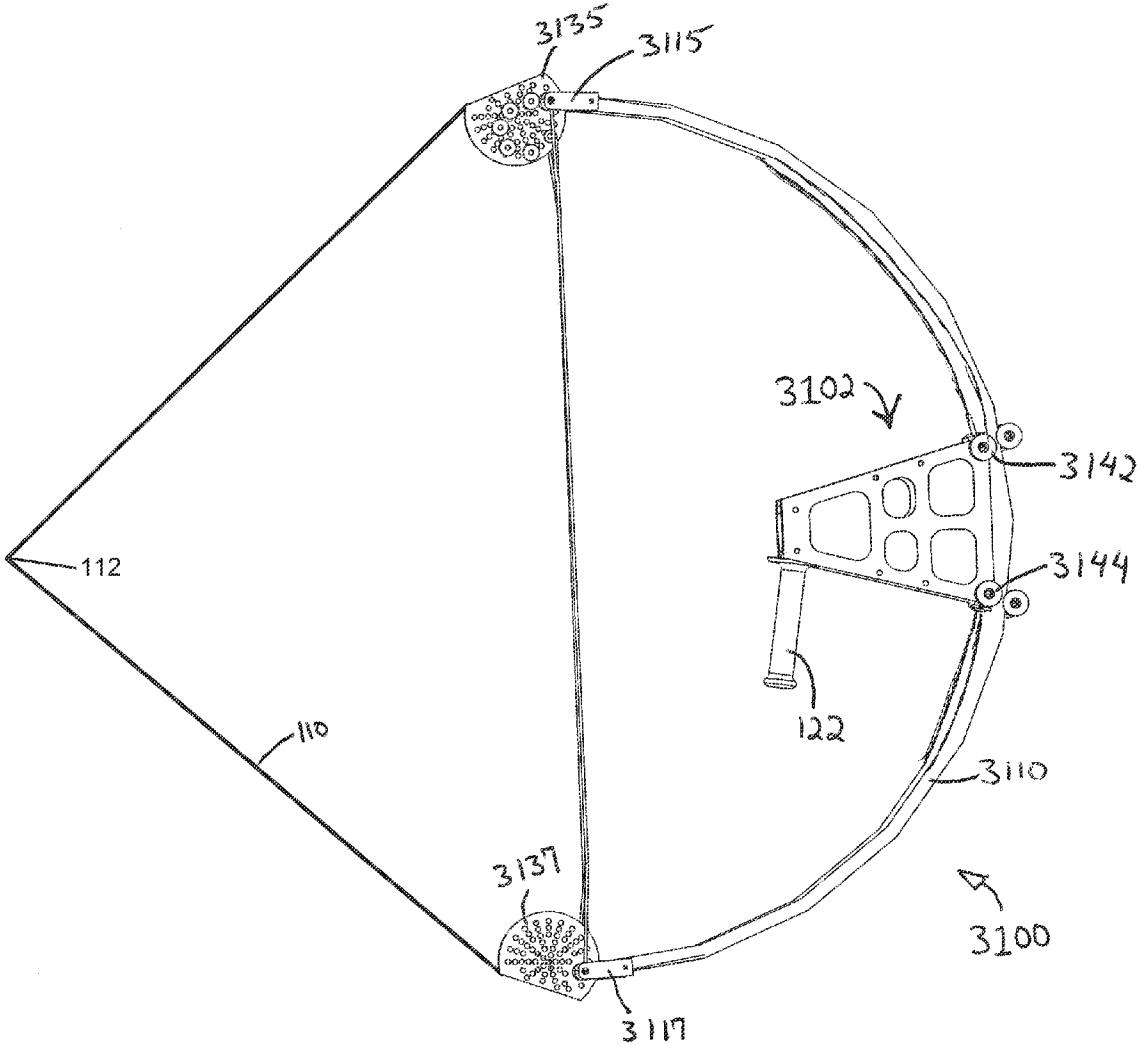
FIG. 33 is another perspective view of the exemplary compound bow shown in FIG. 32.
Figure 34:
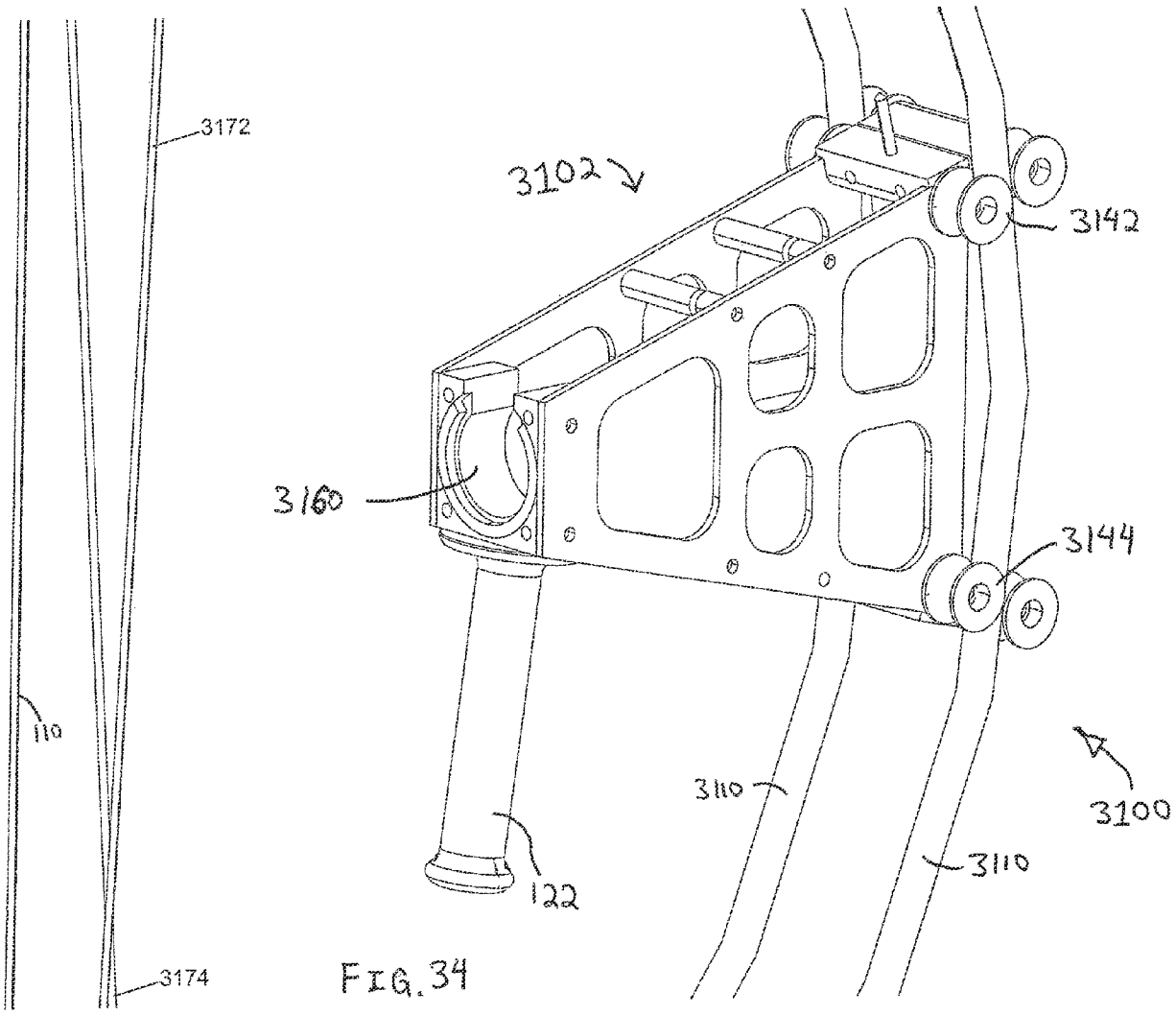
FIG. 34 is an enlarged partial perspective view of portions of the exemplary compound bow shown in FIG. 32.

FIGS. 32-34 illustrate another exemplary compound bow 3100 including flexible limbs 3110 for storing energy. Compound bow 3100 further includes a substantially rigid frame 3102, eccentric cams 3135, 3137, handle 122, tension members 3172, 3174, and a bow string 110.

Figure 51:
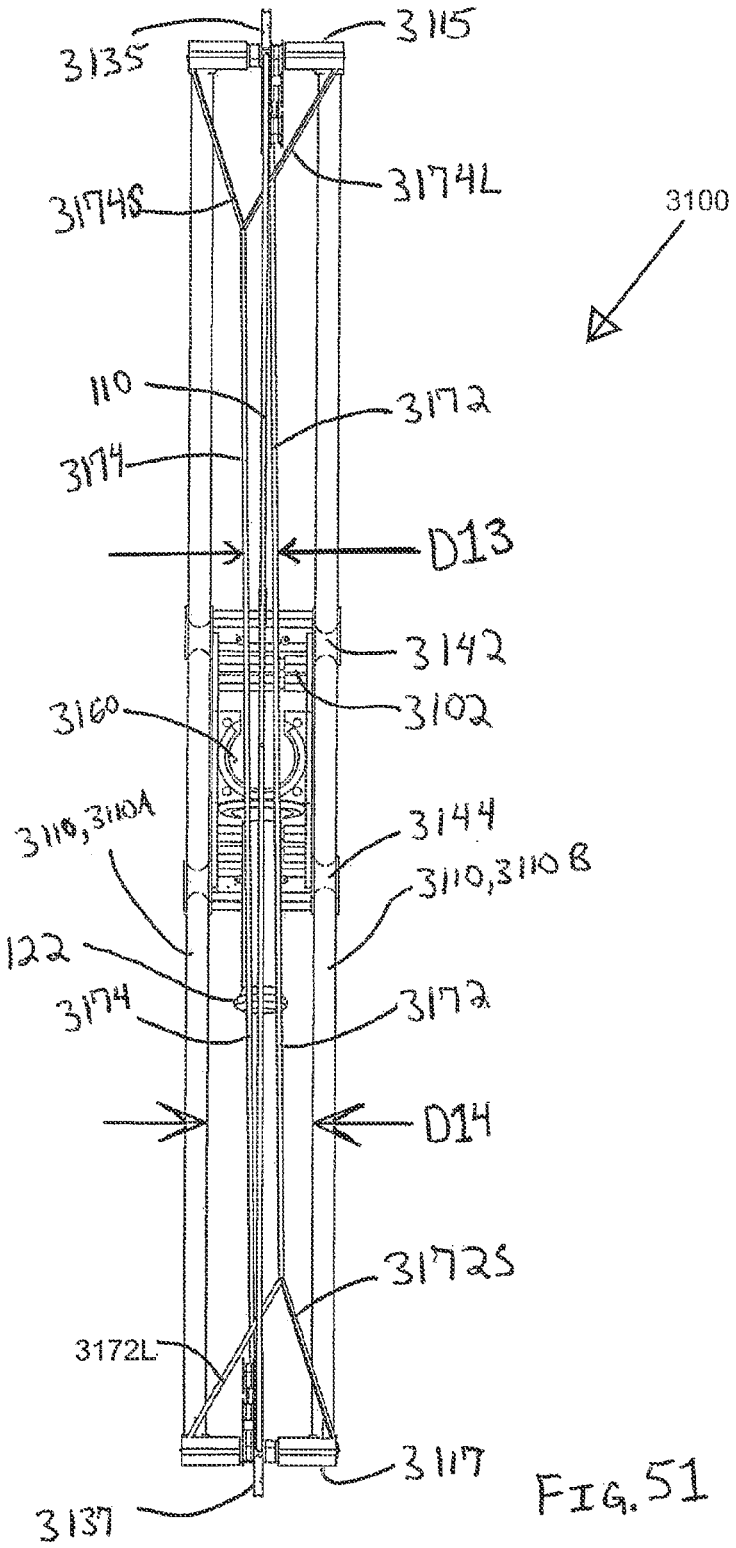
FIG. 51 is a rear elevation view of the compound bow of FIG. 32.

The frame 3102 includes a mount, for mounting handle 122, an arrow rest 3160, and clamps 3142, 3144. The flexible limbs 3110 define a first end 3115 and a second end 3117. In some embodiments flexible limbs 3110 are a single unitary member, but in other embodiments flexible limbs 3110 are two or more members 3110A, 3110B (see FIG. 51). Preferably, the flexible limbs 3110 are a pair of flexible limbs 3110A, 3110B, as depicted in FIGS. 32, 34, and 51, and are positioned on opposite sides of the frame 3102. The flexible limbs 3110, 3110A, 3110B are clamped in the clamps 3142, 3144 of the frame 3102. In some embodiments, the flexible limbs 3110, 3110A, 3110B can be adjusted in position relative the frame 3102 by repositioning them within the clamps 3142, 3144. In other embodiments, the position of the flexible limbs 3110, 3110A, 3110B is non-adjustable. In preferred embodiments, the pair of flexible limbs 3110A, 3110B is positioned along their lengths in the clamps 3142, 3144 between their first and second ends 3115, 3117 and an arrow may pass between them. In certain embodiments, the flexible limbs 3110A, 3110B are parallel to each other and spaced from each other by a distance D14 (see FIG. 51). In some embodiments, the distance D14 is in a range from about 1.5 inches and about 4 inches. In other embodiments, the distance D14 has other dimensions. In still other embodiments, the flexible limbs 3110A, 3110B are not parallel to each other.

In embodiments with a single unitary flexible limb 3110, the distance D14 can be formed in a gap, a slot, or other passage in the single unitary flexible limb 3110. As in the preceding paragraph, the arrow may pass through the gap, slot, or other passage measured by the distance D14.

The eccentric cam 3135 is positioned and rotatably mounted at or near the first end 3115 of the flexible limbs 3110, and the eccentric cam 3137 is positioned and rotatably mounted at or near the second end 3117 of the flexible limbs 3110. In preferred embodiments, the eccentric cams 3135, 3137 are rotatably mounted between and to the pair of flexible limbs 3110. In some embodiments, eccentric cams 3135 and 3137 form an example of a force compounding system that compounds a force supplied by an archer or other user.

Tension member 3172 is connected between the second end 3117 of the flexible limbs 3110 and the eccentric cam 3135. In some embodiments a fork is included in tension member 3172 to clear the eccentric cam 3137, also mounted at the second end 3117 of the flexible limbs 3110. Such a fork is illustrated at FIG. 51 where tension member 3172 branches into tension members 3172S and 3172L. Tension member 3172L is longer than tension member 3172S thereby tilting tension member 3172 toward the right at the bottom as shown at FIG. 51. Tension member 3174 is connected between the first end 3115 of the flexible limbs 3110 and the eccentric cam 3137. Another fork is included in tension member 3174 in some embodiments to clear the eccentric cam 3135, also mounted at the first end 3115 of the flexible limbs 3110. Such a fork is illustrated at FIG. 51 where tension member 3174 branches into tension members 3174S and 3174L. Tension member 3174L is longer than tension member 3174S thereby tilting tension member 3174 toward the left at the top as shown at FIG. 51. By having tensions members 3172 and 3174 tilted as shown at FIG. 51, a distance D13 is provided between tension members 3172, 3174. The distance D13 allows an arrow to pass between the tension members 3172, 3174. The distance D13 is typically in a range from about 1 inch to about 2 inches. Other embodiments include other dimensions for distance D13. The separation (distance D13) provided between tension members 3172 and 3174 created by tilting the tension members 3172, 3174 as illustrated at FIG. 51 can be similarly offset by other means, such as idler wheels. A first end of the bow string 110 is preferably at least partially wrapped around the eccentric cam 3135, and a second end of the bow string 110 is preferably at least partially wrapped around the eccentric cam 3137.

The flexible limbs 3110 are preloaded and tend to pull the eccentric cams 3135, 3137 away from each other when the compound bow 3100 is in the configuration shown at FIGS. 32-34. The pulling tendency of the flexible limbs 3110 is resisted by the bow string 110 and the tension members 3172, 3174. As shown at FIG. 32, the eccentric cam 3135 is urged upwards by its connection with the first end 3115 of the flexible limbs 3110. This upwards urging of the eccentric cam 3135 is balanced by a downward urging by both the bow string 110 and the tension member 3172. As shown at FIG. 32, the downward urging of the eccentric cam 3135 by the tension member 3172 also results in a clockwise rotational urging about the eccentric cam's 3135 mount. Similarly, the downward urging of the eccentric cam 3135 by the bow string 110 also results in a counter-clockwise rotational urging about the eccentric cam's 3135 mount. When the exemplary compound bow 3100 is at rest, the clockwise and counter-clockwise rotational urgings of the eccentric cam 3135 are balanced.

A similar force and moment balance is established with respect to eccentric cam 3137 when the exemplary compound bow 3100 is at rest. In particular, as shown at FIG. 32, the eccentric cam 3137 is urged downwards by its connection with the second end 3117 of the flexible limbs 3110. This downwards urging of the eccentric cam 3137 is balanced by an upward urging by both the bow string 110 and the tension member 3174. As shown at FIG. 32, the upward urging of the eccentric cam 3137 by the tension member 3174 also results in a counter-clockwise rotational urging about the eccentric cam's 3137 mount. Similarly, the upward urging of the eccentric cam 3137 by the bow string 110 also results in a clockwise rotational urging about the eccentric cam's 3137 mount. The clockwise and counter-clockwise rotational urgings and the upwards and downwards urgings of the eccentric cam 3137 are thus balanced.

As the bow string 110 is drawn (with or without an arrow present), starting from a position illustrated at FIG. 32 and ending at a position illustrated at FIG. 33, the eccentric cam 3135 is rotated in the counter-clockwise direction and the eccentric cam 3137 is rotated in the clockwise direction. The resulting configuration further inwardly flexes the flexible limbs 3110 thereby storing energy (generated by drawing the bow string 110) within the flexible limbs 3110. The geometry of the eccentric cams 3135, 3137 and other components of the compound bow 3100 is preferably chosen to give a favorable force vs. draw distance characteristic to the compound bow 3100 (e.g., as illustrated at FIG. 24).

Releasing the bow string 110 from the drawn position (see FIG. 33) results in the unflexing of the flexible limbs 3110 thereby returning the compound bow 3100 to its pre-drawn configuration (see FIG. 32). Energy can thereby be transferred to the arrow to propel the arrow from the compound bow 3100.

Figure 35:
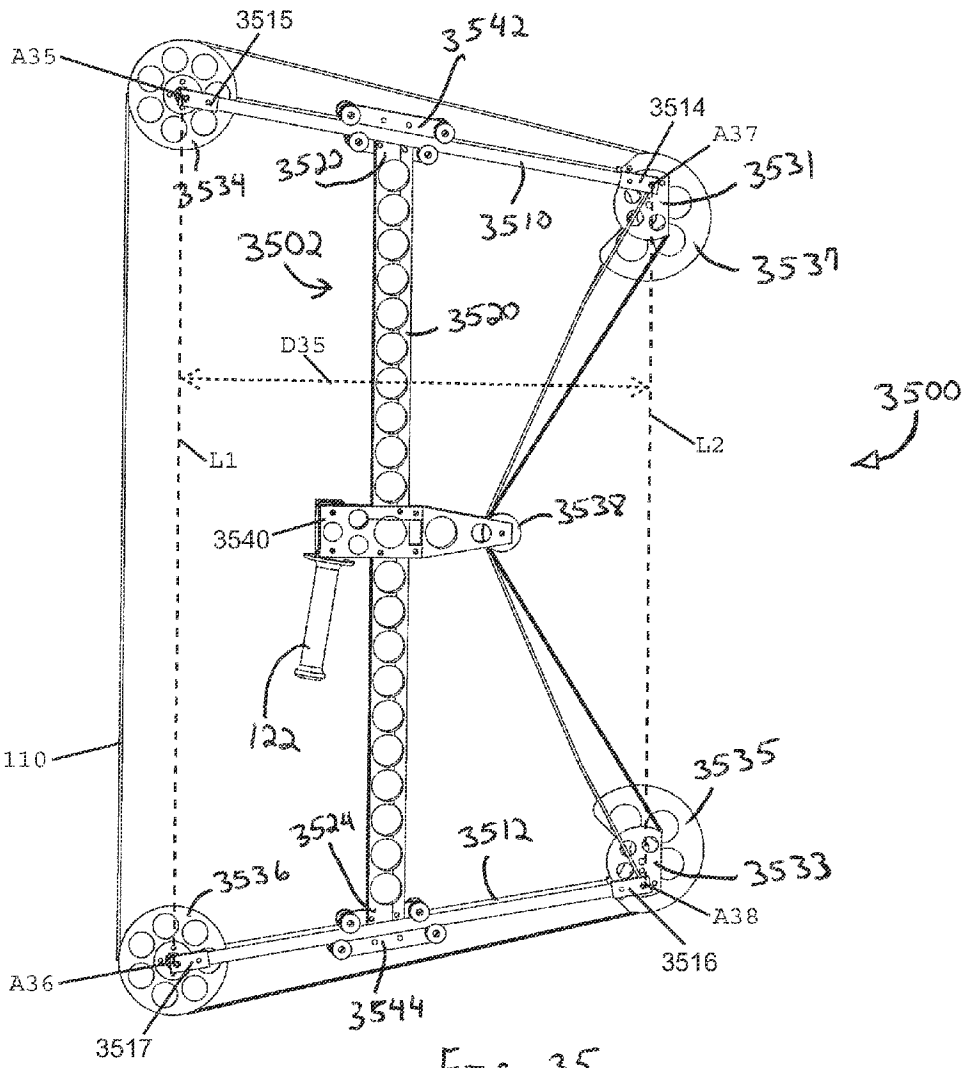
FIG. 35 is a perspective view of another exemplary embodiment of a compound bow according to the present disclosure.
Figure 36:
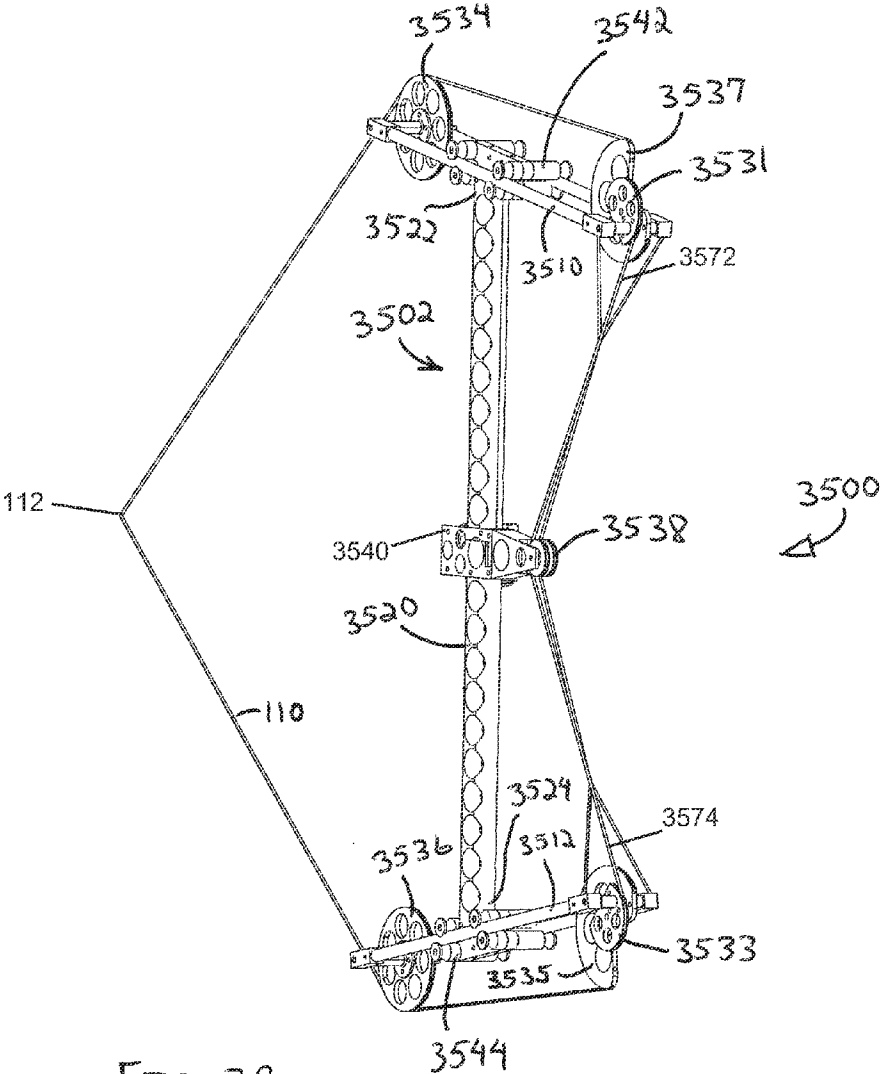
FIG. 36 is another perspective view of the exemplary compound bow shown in FIG. 35.

FIGS. 35 and 36 illustrate another exemplary compound bow 3500 including flexible limbs 3510, 3512 for storing energy. Compound bow 3500 further includes a substantially rigid frame 3502, guide wheels 3534, 3536, 3538, a handle 122, eccentric cams 3531, 3533, 3535, 3537, tension members 3572, 3574, and a bow string 110.

The frame 3502 includes a riser 3520 that extends from a first end 3522 to a second end 3524. Clamps 3542, 3544 are positioned and preferably fixedly attached at the first and second ends 3522, 3524 of the riser 3520. A center piece 3540 is positioned and preferably fixedly attached to the riser 3520 between the first and second ends 3522, 3524. The center piece 3540 is preferably approximately centered between the first and second ends 3522, 3524. The position of the center piece 3540 is adjustable in some embodiments. In other embodiments, center piece 3540 is non-adjustable. The center piece 3540 includes an arrow rest in some embodiments (not visible in FIGS. 35 and 36, but similar to other arrow rests described herein). Center piece 3540 is mounted to the handle 122 and rotatably mounted to guide wheel 3538. All or portions of the clamps 3542, 3544; the center piece 3540; the handle 122; and the riser 3520 may be separate pieces or they may be combined into a single piece construction.

The flexible limbs 3510, 3512 are preferably clamped in the clamps 3542, 3544 respectively. In certain embodiments, the flexible limbs 3510, 3512 can be adjusted in position relative the riser 3520 by repositioning them within the clamps 3542, 3544. In other embodiments, the position of the flexible limbs 3510, 3512 is non-adjustable. In preferred embodiments, the flexible limbs 3510, 3512 are positioned along their length in the clamps 3542, 3544. The flexible limbs 3510, 3512 are preferably used in pairs as best illustrated at FIG. 36. The pairs of flexible limbs 3510, 3512 are preferably positioned at opposite sides of the riser 3520, the guide wheels 3534, 3536, and the eccentric cams 3531, 3533, 3535, 3537.

The flexible limb 3510 or pair of limbs 3510 defines a first end 3514 and a second end 3515. Likewise, the flexible limb 3512 or pair of limbs 3512 defines a first end 3516 and a second end 3517. The guide wheel 3534 is rotatably mounted at or near the end 3515 of the flexible limbs 3510. Likewise, the guide wheel 3536 is rotatably mounted at or near the end 3517 of the flexible limbs 3512. Collectively, guide wheels 3534 and 3536 are examples of a draw string guide system that is configured to guide the draw string portion of the bow string 110 that extends between guide wheels 3534 and 3536. Other embodiments include a draw string guide system including one or more other types of string guides, such as cams, wheels, pulleys, or combinations thereof. The eccentric cams 3531, 3537 are rotatably mounted at or near the end 3514 of the flexible limbs 3510. Likewise, the eccentric cams 3533, 3535 are rotatably mounted at or near the end 3516 of the flexible limbs 3512. The eccentric cams 3531 and 3537 are preferably rotationally coupled together, and the eccentric cams 3533 and 3535 are preferably rotationally coupled together.

A first end of the bow string 110 is connected and preferably at least partially wrapped around the eccentric cam 3537. From there, the bow string 110 is routed to guide wheel 3534 rotatably mounted at the second end 3515 of the flexible limb 3510. The bow string 110 at least partially loops around the guide wheel 3534 and next at least partially loops around the guide wheel 3536. An arrow engaging portion of the bow string 110 is defined between the guide wheels 3534 and 3536. FIG. 36 illustrates the compound bow 3500 in a drawn position with the arrow engaging portion of the bow string 110 at or near a vertex along the bow string 110 between the guide wheels 3534, 3536. From the guide wheel 3536, the bow string 110 next is attached to and at least partially wrapped around the eccentric cam 3535. The bow string 110 at least partially unwraps from the eccentric cams 3535, 3537 as the compound bow 3500 is drawn.

Some embodiments disclosed herein include a force compounding system. Another example of a force compounding system includes eccentric cams 3531, 3533, 3535, and 3537. Some example force compounding systems further include tension members 3572 and 3574. Other embodiments include other force compounding systems.

In preferred embodiments, the eccentric cams 3531, 3533, 3535, 3537 are rotatably mounted between and to the corresponding pair of flexible limbs 3510, 3512 at or near the corresponding ends 3514, 3516. Tension member 3572 is connected between the first end 3516 of the flexible limbs 3512 and the eccentric cam 3531. A fork can be included in tension member 3572 to clear the eccentric cams 3533, 3535, also mounted at the first end 3516 of the flexible limbs 3512. Tension member 3574 is connected between the first end 3514 of the flexible limbs 3510 and the eccentric cam 3533. A fork can be included in tension member 3574 to clear the eccentric cams 3531, 3537, also mounted at the first end 3514 of the flexible limbs 3510.

The flexible limbs 3510, 3512 are preloaded and tend to pull the eccentric cams 3531, 3537 away from the eccentric cams 3533, 3535 when the compound bow 3500 is in the configurations shown at FIGS. 35 and 36. The pulling tendency of the flexible limbs 3510, 3512 is resisted by the tension members 3572, 3574. As shown at FIG. 35, the eccentric cam 3531 is urged upwards by its connection with the first end 3514 of the flexible limbs 3510. This upwards urging of the eccentric cam 3531 is balanced by a downward urging by the tension member 3572. As shown at FIG. 35, the downward urging of the eccentric cam 3531 by the tension member 3572 also results in a clockwise rotational urging about the eccentric cam's 3531 mount. Similarly, the leftward urging of the eccentric cam 3537 by the bow string 110 results in a counter-clockwise rotational urging about the eccentric cam's 3531 mount. When the exemplary compound bow 3500 is at rest, the clockwise and counter-clockwise rotational urgings of the eccentric cam 3531 are balanced.

A similar force and moment balance is established with respect to eccentric cams 3533, 3535 when the exemplary compound bow 3500 is at rest. In particular, as shown at FIG. 35, the eccentric cam 3533 is urged downwards by its connection with the first end 3516 of the flexible limbs 3512. This downwards urging of the eccentric cam 3533 is balanced by an upward urging by the tension member 3574. As shown at FIG. 35, the upward urging of the eccentric cam 3533 by the tension member 3574 also results in a counter-clockwise rotational urging about the eccentric cam's 3533 mount. Similarly, the leftward urging of the eccentric cam 3535 by the bow string 110 results in a clockwise rotational urging about the eccentric cam's 3533 mount. The clockwise and counter-clockwise rotational urgings and the upward and downward urgings of the eccentric cams 3533, 3535 are thus balanced.

As the bow string 110 is drawn (with or without an arrow present), starting from a position illustrated at FIG. 35 and ending at a position illustrated at FIG. 36, the eccentric cams 3531, 3537 are rotated in the counter-clockwise direction and the eccentric cams 3533, 3535 are rotated in the clockwise direction. The resulting configuration further inwardly flexes the flexible limbs 3510, 3512 thereby storing energy (generated by drawing the bow string 110) within the flexible limbs 3510, 3512. The geometry of the eccentric cams 3531, 3533, 3535, 3537 and other components of the compound bow 3500 is preferably chosen to give a favorable force vs. draw distance characteristic to the compound bow 3500 (e.g., as illustrated at FIG. 24).

Releasing the bow string 110 from the drawn position (see FIG. 36) results in the unflexing of the flexible limbs 3510, 3512 thereby returning the compound bow 3500 to its pre-drawn configuration (see FIG. 35). Energy can thereby be transferred to the arrow and propel the arrow from the compound bow 3500.

As the bow 3500 is drawn, the flexible limbs 3510, 3512 flex and store energy. The flexing of the flexible limbs 3510, 3512 occurs between the clamps 3542, 3544 and both ends 3514, 3515, 3516, 3517. When the bow string 110 of the compound bow 3500 is released the flexible limbs 3510, 3512 unflex and transfer the stored energy to the arrow thereby propelling the arrow.

Some embodiments are arranged to route the tension members 3572, 3574 away from the path of the arrow (e.g., routing the tension members 3572, 3574 with one or more guide wheels 3538).

Referring now to FIG. 35, axes A35, A36, A37, and A38 as well as lines L1 and L2 are shown. A38 is the axis of rotation of guide wheel 3534. A36 is the axis of rotation of guide wheel 3536. A37 is the axis of rotation of eccentric cams 3531 and 3537. A38 is the axis of rotation of eccentric cams 3533 and 3535. In other possible embodiments, A35, A36, A37, and A38 are axes of other string guides, such as cams, wheels, or pulleys. Imaginary lines L1 and L2 can be defined to illustrate the arrangement of certain components of compound bows disclosed herein. For example, in this embodiment line L1 is a line that extends between axis A35 and axis A36. L2 is a line that extends between axis A37 and axis A38.

In some embodiments, L1 and L2 are separated by a distance D35. A compound bow including a separation distance D35 can be referred to as a compound bow that incorporates string redirection technology. In one possible embodiment, D35 is greater than 2 inches. In another possible embodiment, D35 is greater than 4 inches. In another possible embodiment, D35 is greater than 6 inches. In another possible embodiment, D35 is greater than 12 inches. In yet another possible embodiment, D35 is greater than 18 inches. In some embodiments distance D35 is in a range from about 2 inches to about 20 inches. Other embodiments include other distances that may be larger or smaller than these.

In some embodiments the configuration of the compound bow can be described with reference to the location of lines L1 and L2. For example, the location of lines L1 and L2 can be described with reference to a portion of the frame, such as riser 3520. In this example, line L1 is arranged rearward of riser 3520 and line L2 is arranged forward of riser 3520. In another possible embodiment, L1 is arranged forward of riser 3520 and line L2 is arrange rearward of riser 3520. In yet another possible embodiment, L1 and L2 are both arranged rearward of riser 3520. In another possible embodiment, L1 and L2 are both arranged forward of riser 3520. Other embodiments include other configurations, such as disclosed herein.

Figure 38:
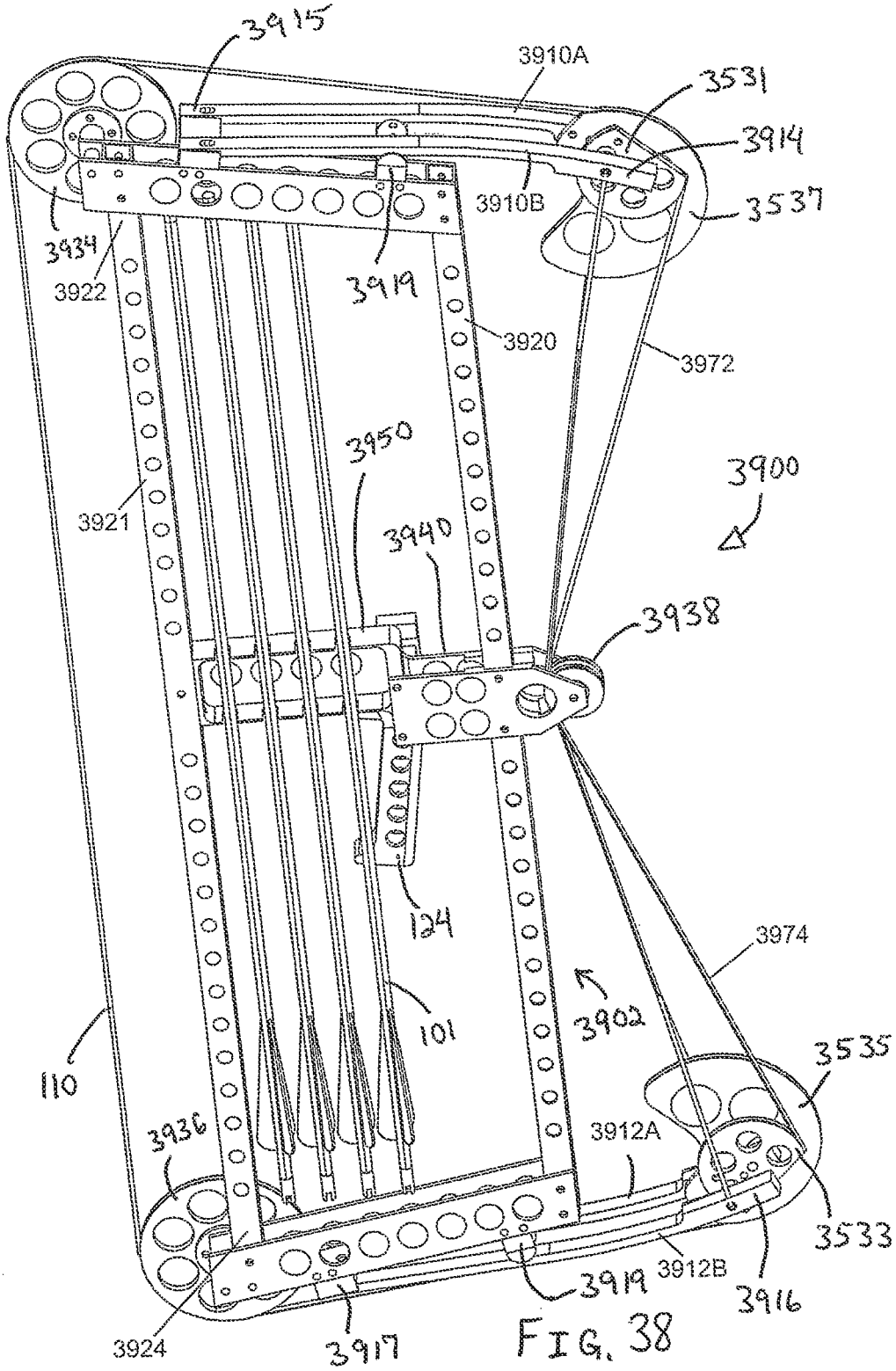
FIG. 38 is another perspective view of the exemplary compound bow shown in FIG. 37.
Figure 42:
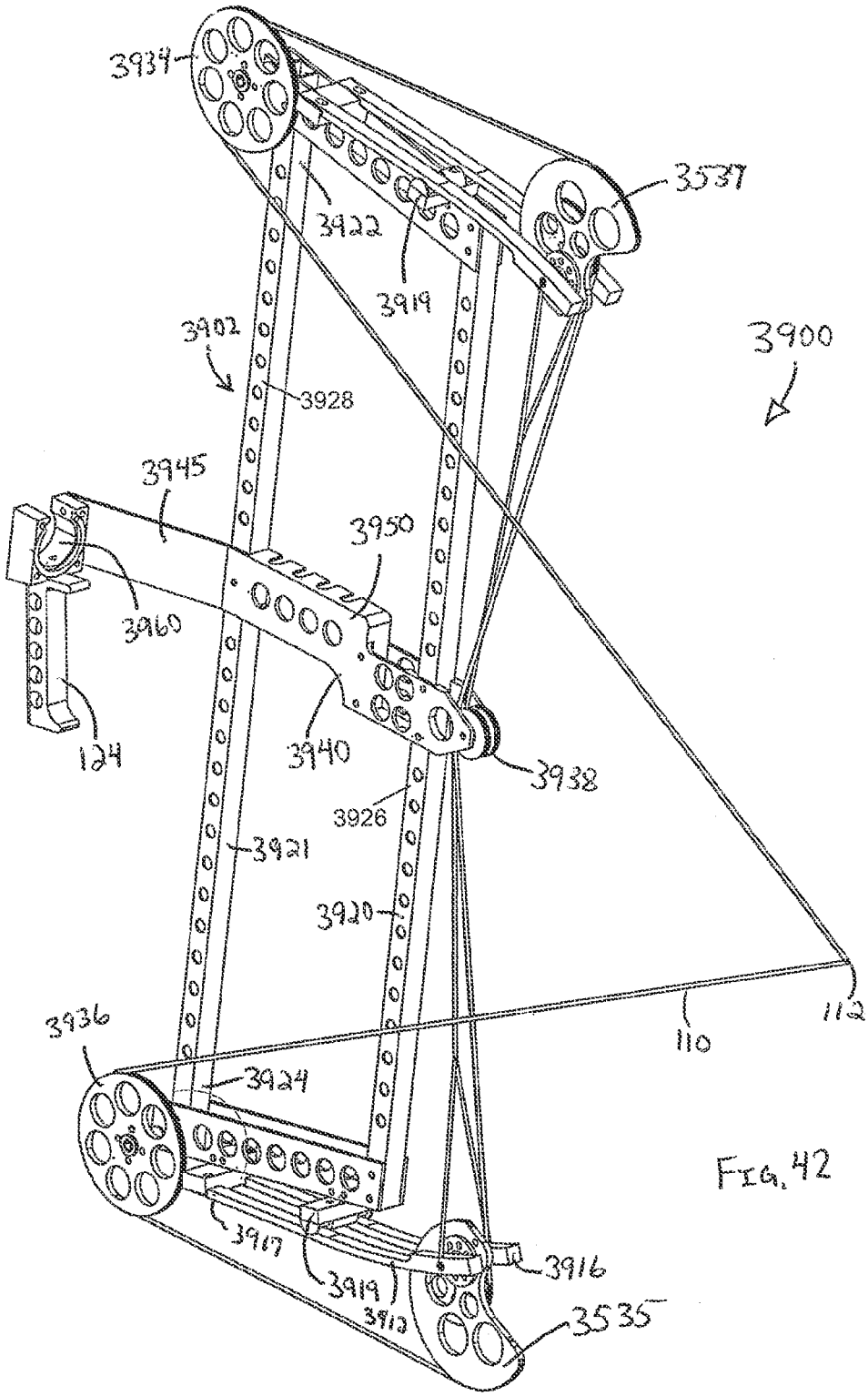
FIG. 42 is a perspective view of a modified configuration of the compound bow of FIG. 37 arranged for reverse bow string pulling.
Figure 43:
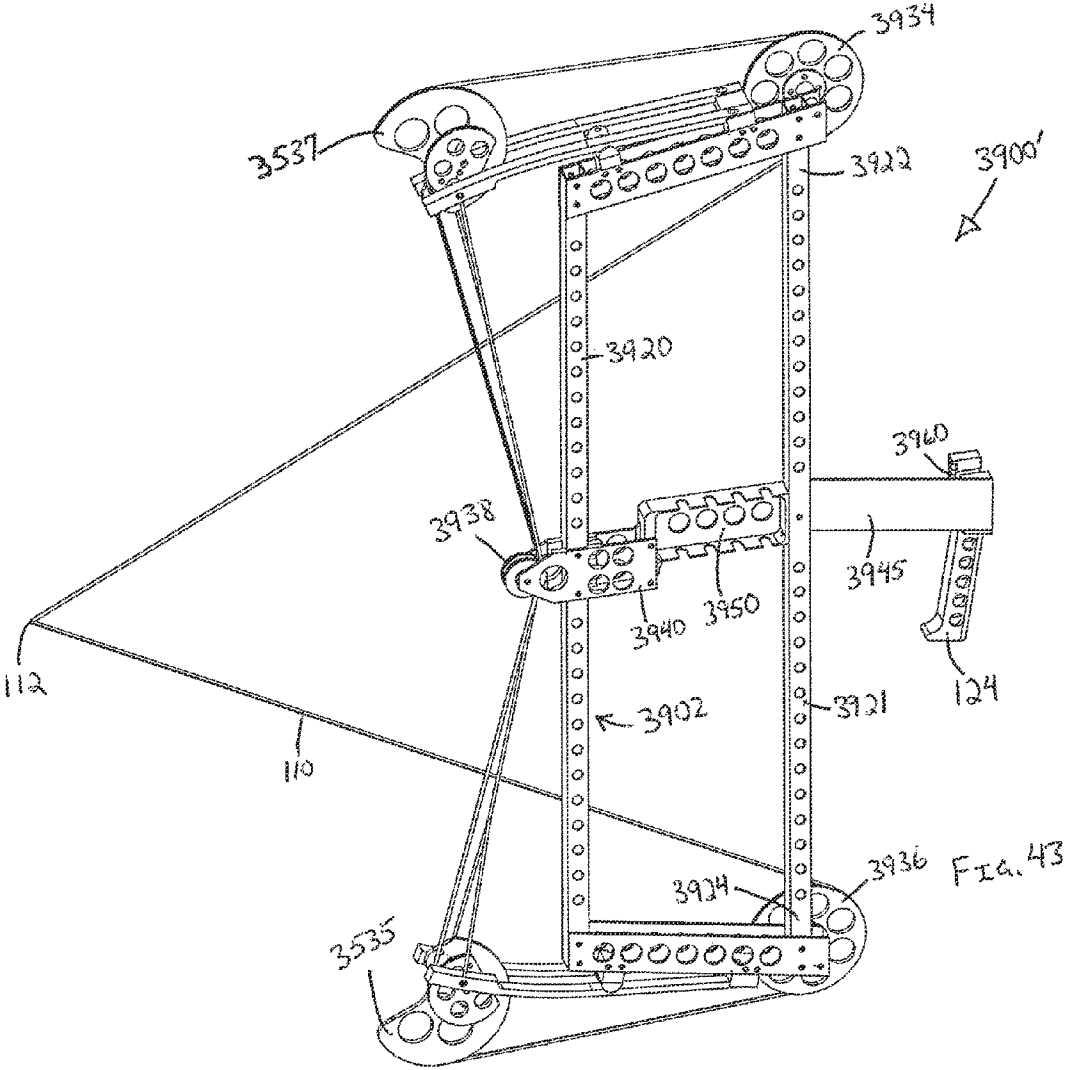
FIG. 43 is another perspective view of the compound bow of FIG. 42.
Figure 44:
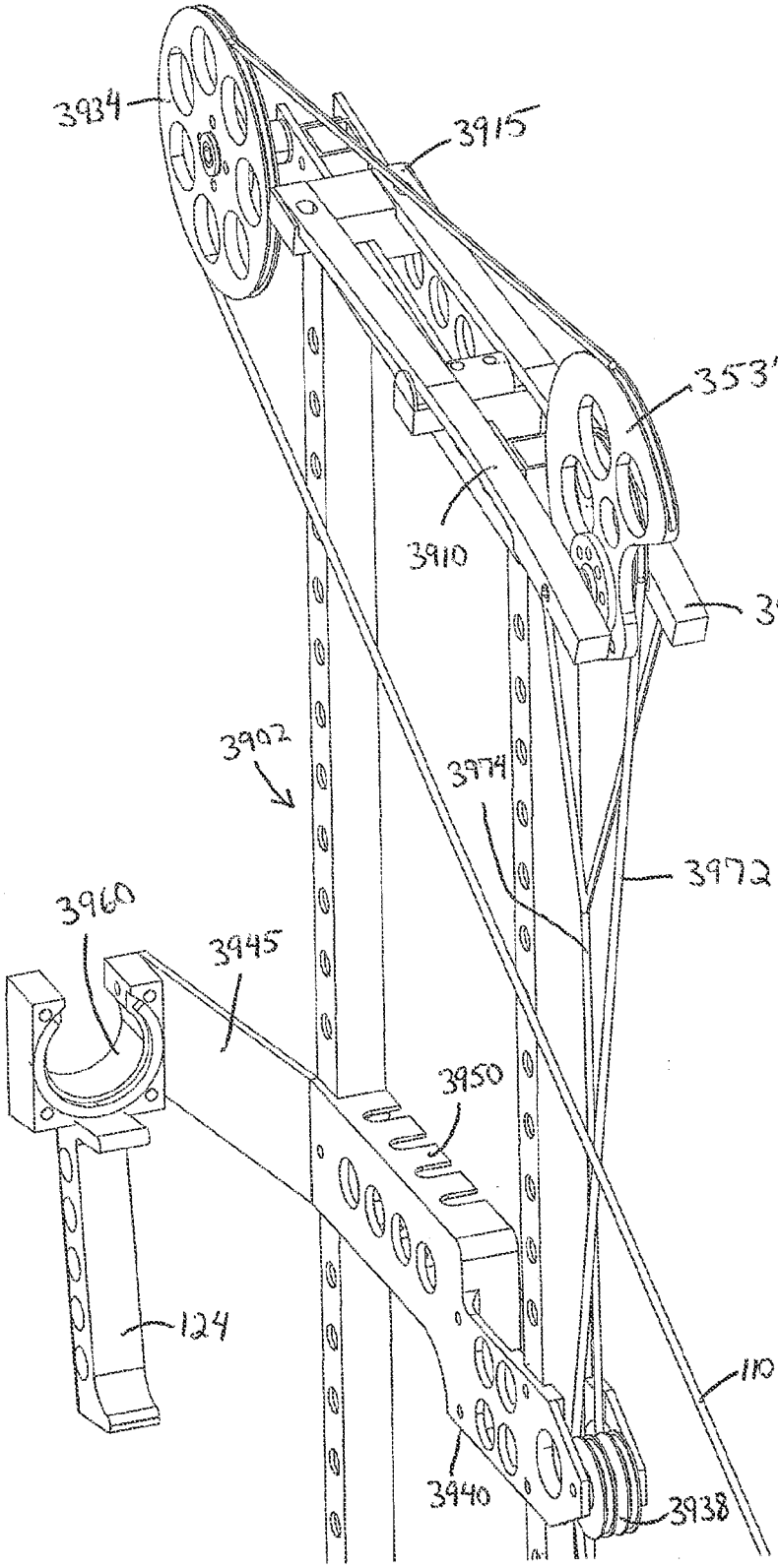
FIG. 44 is a partial perspective view of an upper portion of the compound bow of FIG. 42.
Figure 45:
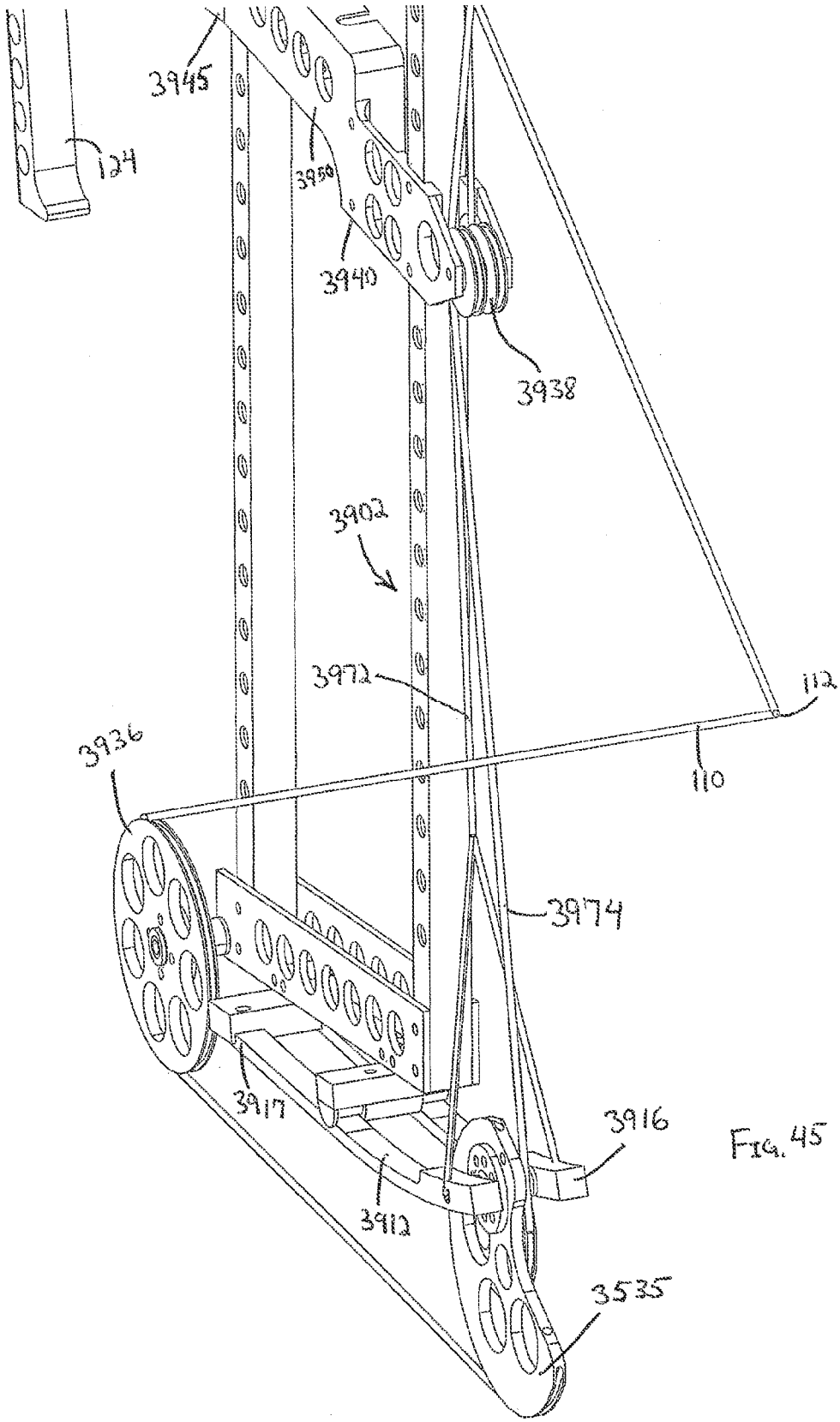
FIG. 45 is a partial perspective view of a lower portion of the compound bow of FIG. 42.
Figure 46:
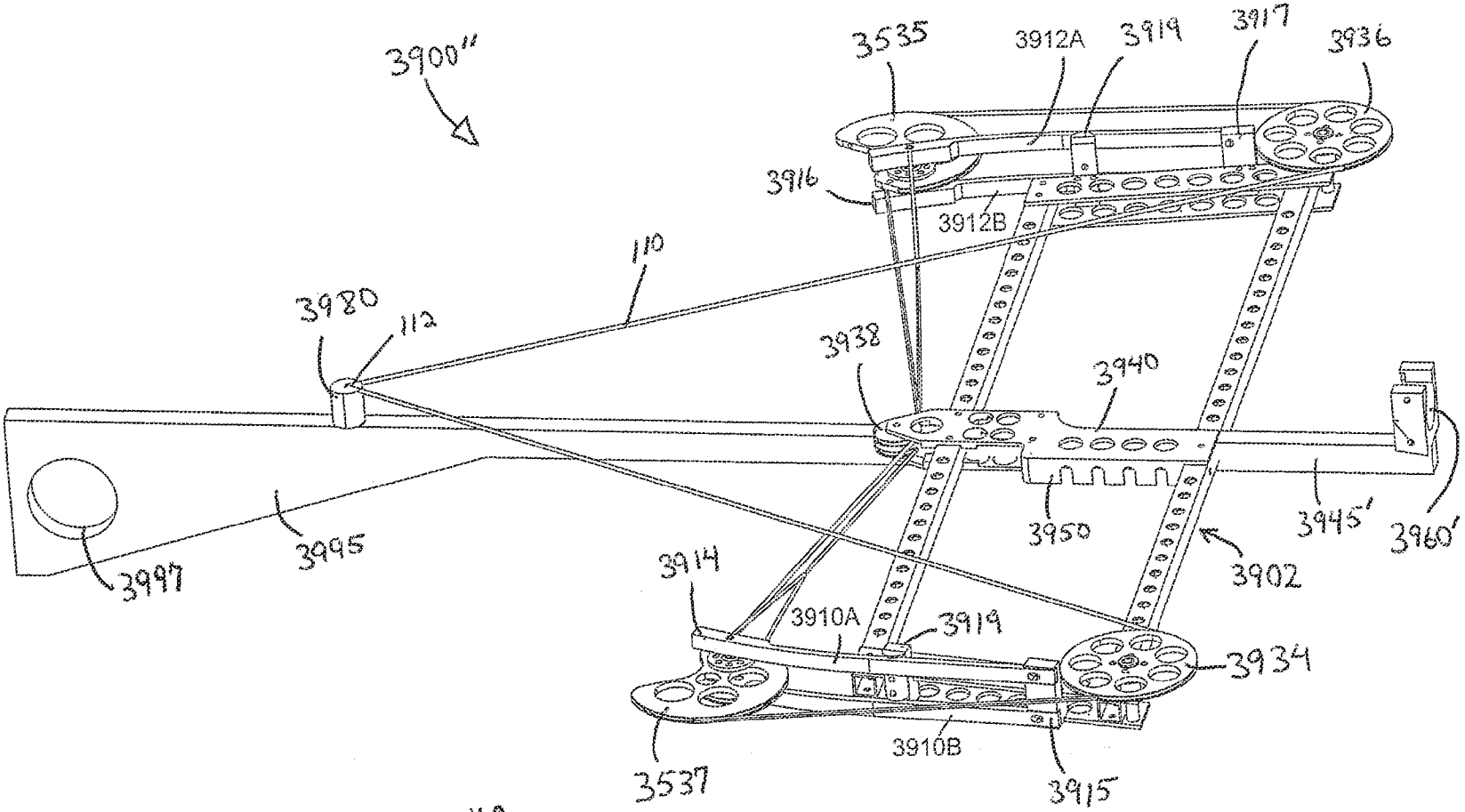
FIG. 46 is a perspective view of a modified configuration of the compound bow of FIG. 37 arranged as a cross-bow.
Figure 47:
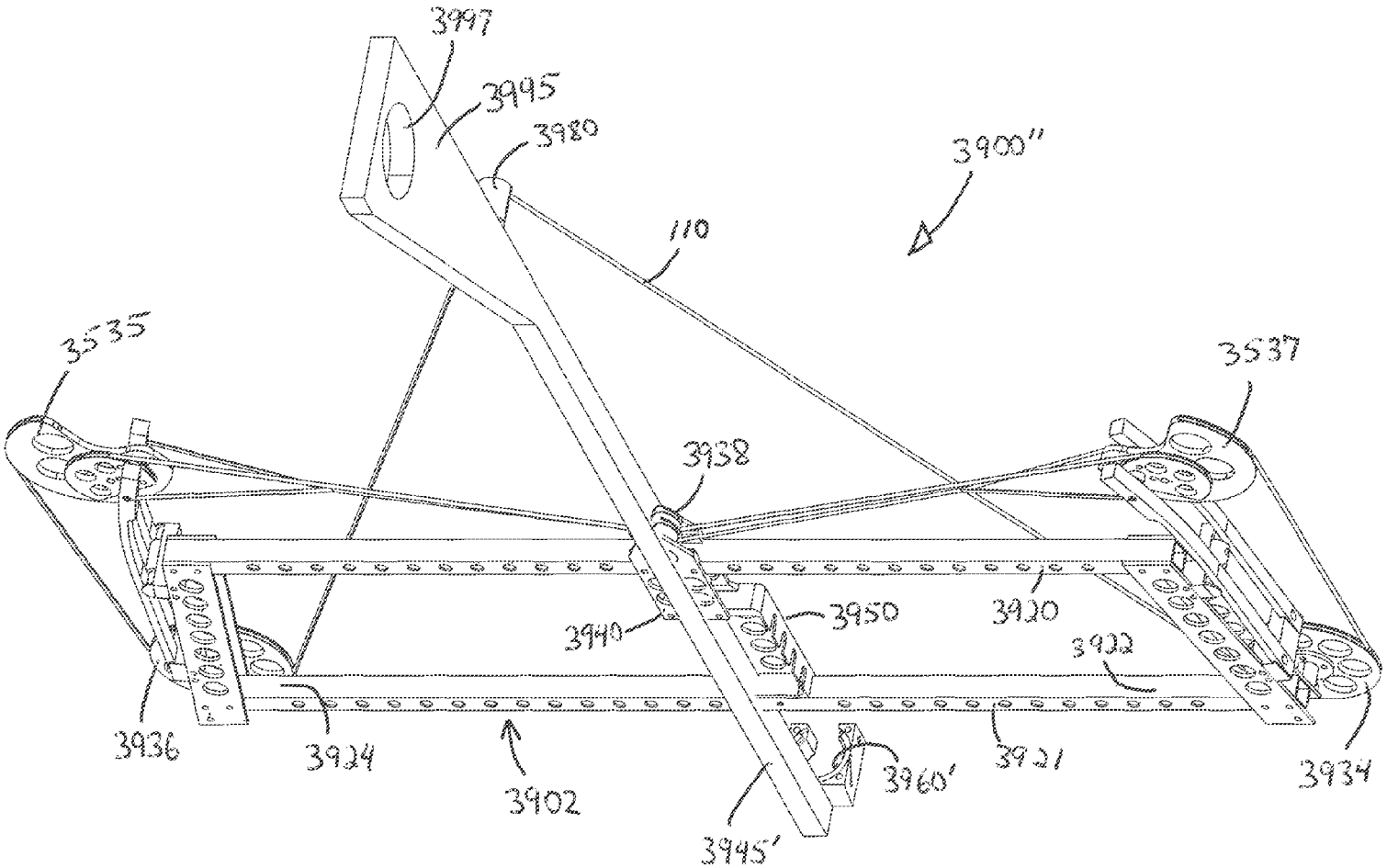
FIG. 47 is another perspective view of the cross-bow of FIG. 46.

In some embodiments, handle 122 is arranged between lines L1 and L2. In other embodiments handle 122 is arranged forward of lines L1 and L2 (such as shown in FIG. 42). In yet other embodiments, handle 122 is arranged rearward of lines L1 and L2. In some embodiments, a quiver 3950 (such as shown in FIG. 38) is arranged between lines L1 and L2. Other embodiments include other arrangements and configurations.

Figure 37:
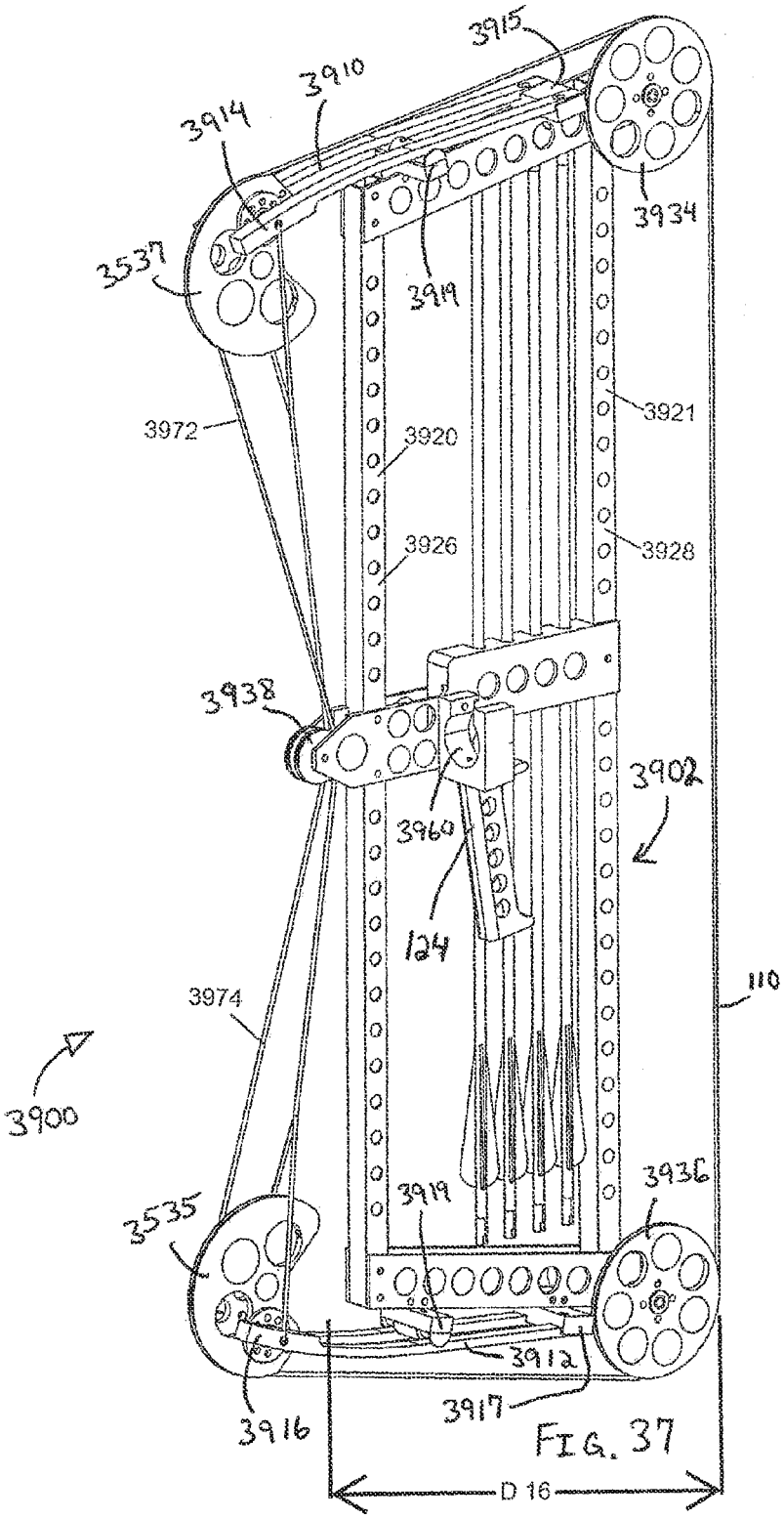
FIG. 37 is a perspective view of another exemplary embodiment of a compound bow according to the present disclosure.
Figure 39:
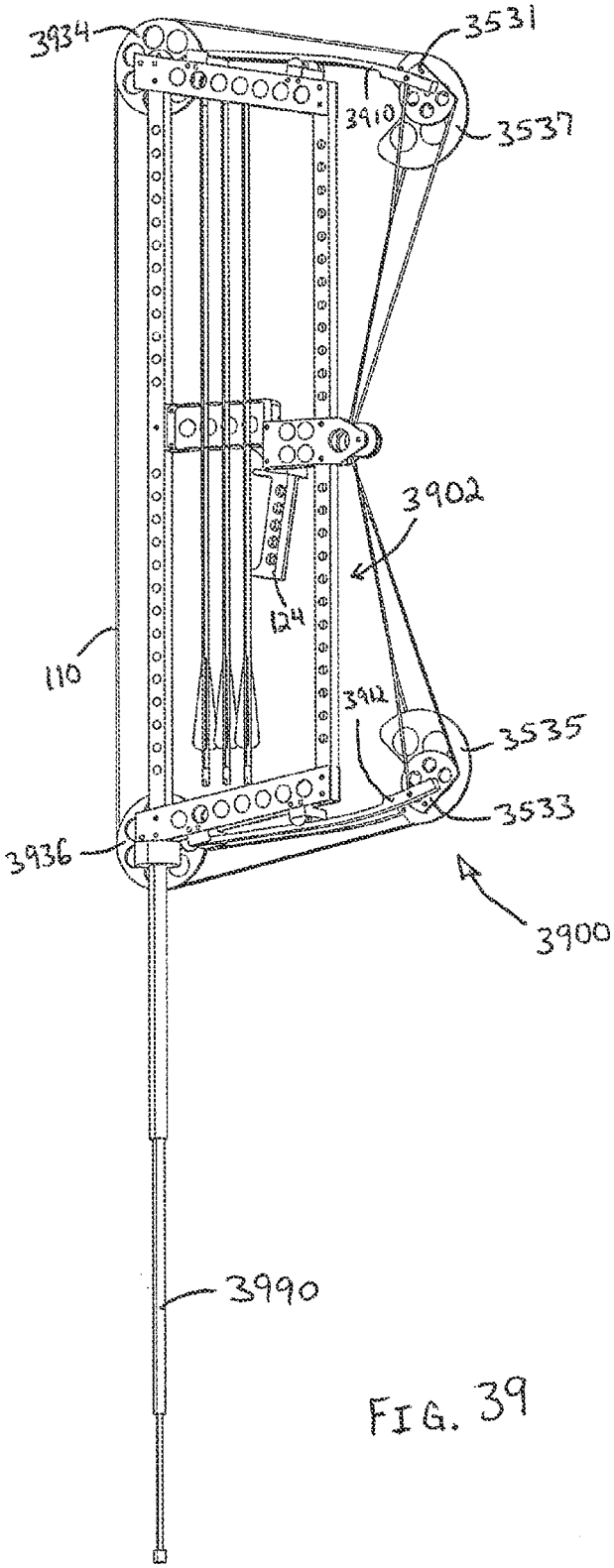
FIG. 39 is another perspective view of the exemplary compound bow shown in FIG. 37 further including a monopod.

FIGS. 37-39 illustrate another exemplary compound bow 3900 including flexible limbs 3910, 3912 for storing energy. Compound bow 3900 further includes a substantially rigid frame 3902, guide wheels 3934, 3936, 3938, a handle 124, eccentric cams 3531, 3533, 3535, 3537, tension members 3972, 3974, and a bow string 110.

The frame 3902 includes one or more risers 3920, 3921 that extend from a first end 3922 to a second end 3924. A center piece 3940 is positioned and preferably fixedly attached to the risers 3920 and/or 3921 between the first and second ends 3922, 3924. The center piece 3940 is preferably approximately centered between the first and second ends 3922, 3924. The position of the center piece 3940 is adjustable in some embodiments. In other embodiments, center piece 3940 is non-adjustable. The center piece 3940 can include an arrow rest 3960 (see FIG. 37) and a quiver 3950 (see FIG. 38). The quiver 3950 can store one or more arrows 101 (see FIG. 38). In some embodiments, quiver 3950 is incorporated into the riser in the space or region between forward riser 3920 and rear riser 3921 and generally within a perimeter of the frame 3902. The unique arrangement of the bow 3900 provides an open space where arrows may be stored without interfering with the operation of bow 3900. The arrows, including both ends of the arrows, stored in quiver 3950 are generally protected with the frame 3902.

The arrows stored in quiver 3950 can be positioned with an offset distance D11 from an arrow being shot from the bow 3900. The offset distance D11 is illustrated in a related embodiment shown in FIG. 50. In some embodiments, D11 is in a range from about 0.5 inches to about 1.5 inches. By having the quiver 3950 and the arrows within the quiver 3950 positioned near the arrow being shot from the bow 3900, the balance of the bow 3900 can be improved compared to bows with larger distances between the stored and shot arrows. The center piece 3940 further mounts the handle 124, and rotatably mounts the guide wheels 3938. All or portions of the center piece 3940; the handle 124; and the frame 3902 may be separate pieces or they may be combined into a single piece construction. The risers 3920, 3921 and/or other components of the frame 3902 and the handle 124 are preferably made of hollow material. The hollow material generally improves the stiffness characteristics of the frame 3902 at a given weight. The hollow material also affords storage capacity within the frame 3902 and/or the handle 124. The storage capacity can be used to carry spare bow string, extra arrows, liquid beverages, etc. In some embodiments the frame defines a storage cavity and includes a cap or cover that encloses the storage cavity. In one embodiment a screw-in cap is provided that engages with a threaded orifice to enclose the storage cavity when in place, and provides access to the storage cavity when removed. In certain embodiments, various components of the frame 3902 and the handle 124 can include lightening holes, as illustrated at FIGS. 37-39.

The flexible limbs 3910, 3912 are preferably attached to the frame 3902. In certain embodiments, the flexible limbs 3910, 3912 can be adjusted in position relative the frame 3902 by repositioning them on the frame 3902. In other embodiments, the position of the flexible limbs 3910, 3912 is non-adjustable. In preferred embodiments, the flexible limbs 3910, 3912 are cantilevered off the frame 3902. The flexible limbs 3910, 3912 are preferably used in pairs 3910A, 3910B and 3912A, 3912B as illustrated at FIG. 38. The pairs of flexible limbs 3910A, 3910B and 3912A, 3912B are preferably positioned at opposite sides of the risers 3920, 3922, the guide wheels 3934, 3936, and the eccentric cams 3531, 3533, 3535, 3537. In some embodiments, the pairs of flexible limbs 3910A, 3910B and 3912A, 3912B are spaced from each other (3910A spaced from 3910B and 3912A spaced from 3912B) by a distance D12 as illustrated in a related embodiment at FIG. 50. In certain embodiments, the distance D12 is in a range from about 1.5 inches to about 4 inches. In other embodiments, the distance D12 can have other dimensions.

The flexible limb 3910 or pair of limbs 3910A, 3910B defines a first end 3914 and a second end 3915. Likewise, the flexible limb 3912 or pair of limbs 3912A, 3912B defines a first end 3916 and a second end 3917. The second ends 3915, 3917 of the flexible limbs 3910, 3912 are secured to the frame 3902. Fulcrums 3919 are positioned between the frame 3902 and a central area of each of the flexible limbs 3910, 3912. The eccentric cams 3531, 3537 are rotatably mounted at or near the end 3914 of the flexible limbs 3910. Likewise, the eccentric cams 3533, 3535 are rotatably mounted at or near the end 3916 of the flexible limbs 3912. The eccentric cams 3531 and 3537 are preferably rotationally coupled together, and the eccentric cams 3533 and 3535 are preferably rotationally coupled together. The guide wheel 3934 is rotatably mounted to the frame 3902 near the end 3915 of the flexible limbs 3910. Likewise, the guide wheel 3936 is rotatably mounted to the frame 3902 near the end 3917 of the flexible limbs 3912.

A first end of the bow string 110 is connected and preferably at least partially wrapped around the eccentric cam 3537. From there, the bow string 110 is routed to guide wheel 3934. The bow string 110 at least partially loops around the guide wheel 3934 and next at least partially loops around the guide wheel 3936. An arrow engaging portion of the bow string 110 is defined between the guide wheels 3934 and 3936. From the guide wheel 3936, the bow string 110 next is attached to and at least partially wrapped around the eccentric cam 3535. The bow string 110 at least partially unwraps from the eccentric cams 3535, 3537 as the compound bow 3900 is drawn.

In preferred embodiments, the eccentric cams 3531, 3533, 3535, 3537 are rotatably mounted between and to the corresponding pair of flexible limbs 3910, 3912 at or near the corresponding ends 3914, 3916. Tension member 3972 is connected between the first end 3916 of the flexible limbs 3912 and the eccentric cam 3531. A fork can be included in tension member 3972 to clear the eccentric cams 3533, 3535, also mounted at the first end 3916 of the flexible limbs 3912. Tension member 3974 is connected between the first end 3914 of the flexible limbs 3910 and the eccentric cam 3533. A fork can be included in tension member 3974 to clear the eccentric cams 3531, 3537, also mounted at the first end 3914 of the flexible limbs 3910.

As illustrated at FIGS. 37 and 38, the routing of the tension members 3972, 3974 (i.e., cross-over cables) are substantially vertical between the ends 3914, 3916 of the flexible limbs 3910, 3912 and the eccentric cams 3531, 3533. In the undrawn position, the bow string 110 is spaced away from the tension members 3972, 3974 by a distance D16 or greater. In some embodiments, the distance D16 is greater than about 2 inches. In other embodiments, the distance D16 is greater than about 4 inches. In still other preferred embodiments, the distance D16 is in a range from about 6 inches to about 18 inches, and preferably from about 6 inches to about 12 inches. In some embodiments, when bow the bow is in the undrawn position, bow string 110 is positioned beyond an opposite side of the frame 3902 from the tension members 3972, 3974.

The flexible limbs 3910, 3912 are preloaded and tend to pull the eccentric cams 3531, 3537 away from the eccentric cams 3533, 3535 when the compound bow 3900 is in the configuration shown at FIGS. 37-39. The pulling tendency of the flexible limbs 3910, 3912 is resisted by the tension members 3972, 3974. As shown at FIG. 38, the eccentric cam 3531 is urged upwards by its connection with the first end 3914 of the flexible limbs 3910A, 3910B. This upward urging of the eccentric cam 3531 is balanced by a downward urging by the tension member 3972. As shown at FIG. 38, the downward urging of the eccentric cam 3531 by the tension member 3972 also results in a clockwise rotational urging about the eccentric cam's 3531 mount. Similarly, a leftward urging of the eccentric cam 3537 by the bow string 110 results in a counter-clockwise rotational urging about the eccentric cam's 3531 mount. When the exemplary compound bow 3900 is at rest, the clockwise and counter-clockwise rotational urgings of the coupled eccentric cams 3531, 3537 are balanced.

A similar force and moment balance is established with respect to eccentric cams 3533, 3535 when the exemplary compound bow 3900 is at rest. In particular, as shown at FIG. 38, the eccentric cam 3533 is urged downwards by its connection with the first end 3916 of the flexible limbs 3912A, 3912B. This downwards urging of the eccentric cam 3533 is balanced by an upward urging by the tension member 3974. As shown at FIG. 38, the upward urging of the eccentric cam 3533 by the tension member 3974 also results in a counter-clockwise rotational urging about the eccentric cam's 3533 mount. Similarly, the leftward urging of the eccentric cam 3535 by the bow string 110 results in a clockwise rotational urging about the eccentric cam's 3533 mount. The clockwise and counter-clockwise rotational urgings and the upward and downward urgings of the coupled eccentric cams 3533, 3535 are thus balanced.

As the bow string 110 is drawn (with or without an arrow present), starting from a position illustrated at FIG. 38, the eccentric cams 3531, 3537 are rotated in the counter-clockwise direction and the eccentric cams 3533, 3535 are rotated in the clockwise direction. The resulting configuration further inwardly flexes the flexible limbs 3910, 3912 thereby storing energy (generated by drawing the bow string 110) within the flexible limbs 3910, 3912. The geometry of the eccentric cams 3531, 3533, 3535, 3537 and other components of the compound bow 3900 is preferably chosen to give a favorable force vs. draw distance characteristic to the compound bow 3900 (e.g., as illustrated at FIG. 24).

Releasing the bow string 110 from the drawn position results in the unflexing of the flexible limbs 3910, 3912 thereby returning the compound bow 3900 to its pre-drawn configuration (see FIG. 38). Energy can thereby be transferred to the arrow and propel the arrow from the compound bow 3900.

As the bow 3900 is drawn, the flexible limbs 3910, 3912 bend and store energy. The flexing of the flexible limbs 3910, 3912 occurs as the flexible limbs 3910, 3912 are bent over the fulcrums 3919. When the bow string 110 of the compound bow 3900 is released the flexible limbs 3910, 3912 unbend and transfer the stored energy to the arrow thereby propelling the arrow.

Some embodiments are arranged to route the tension members 3972, 3974 away from the path of the arrow (e.g., routing the tension members 3972, 3974 with one or more guide wheels 3938).

As illustrated at FIG. 39, a monopod 3990 can be mounted to the compound bow 3900. In particular, the monopod 3990 is preferably mounted to the frame 3902 of the compound bow 3900. The monopod 3990 can preferably be extended and retracted. For example, the monopod 3990 can telescope and in some embodiments can telescopingly retract into a hollow frame 3902 member. The substantially rigid frame 3902 provides a preferred mounting structure for the monopod 3990 as the frame 3902 substantially maintains its position with respect to the arrow rest 3960 and guide wheels 3934, 3936. An archer may rest the monopod 3990 on the ground or other suitable surface. Restring the monopod 3990 and thereby restring the compound bow 3900 can reduce archer fatigue and/or steady the compound bow 3900. The monopod 3990 is therefore useful in improving arrow shooting accuracy of the compound bow 3900.

In addition to providing a mounting platform for the monopod 3990, the frame 3902 can be used as a mounting platform for other accessories. For example, sites, an optical scope, a rangefinder, a laser, and other accessories can be mounted on the frame 3902 and benefit from its consistent position with respect to the arrow rest 3960 and guide wheels 3934, 3936.

Figure 48:
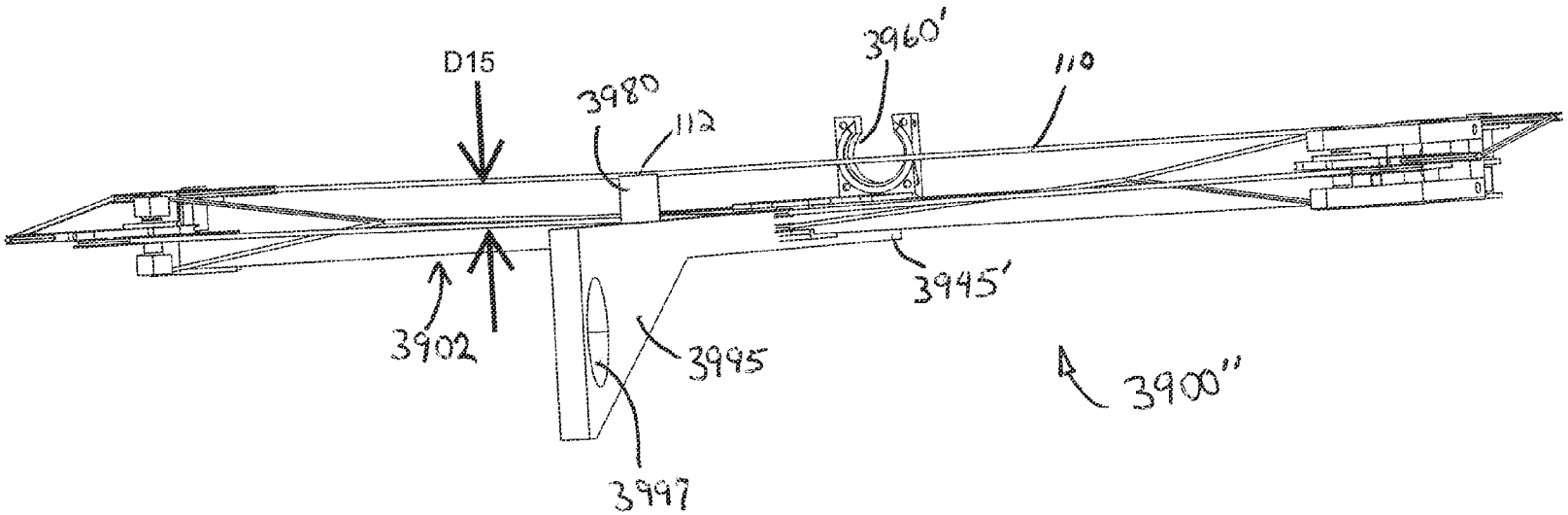
FIG. 48 is still another perspective view of the cross-bow of FIG. 46.
Figure 49:
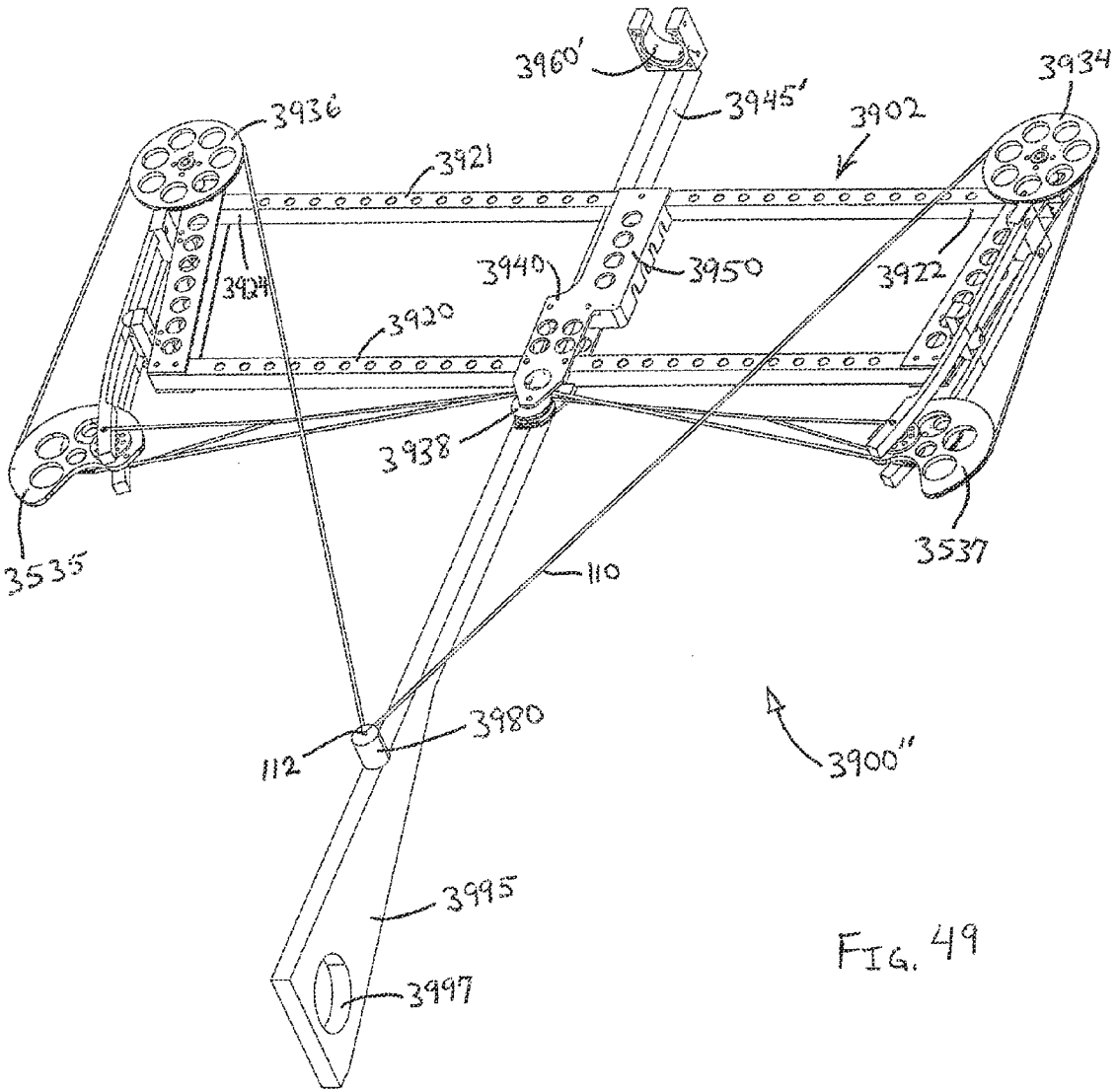
FIG. 49 is yet another perspective view of the cross-bow of FIG. 46.
Figure 50:
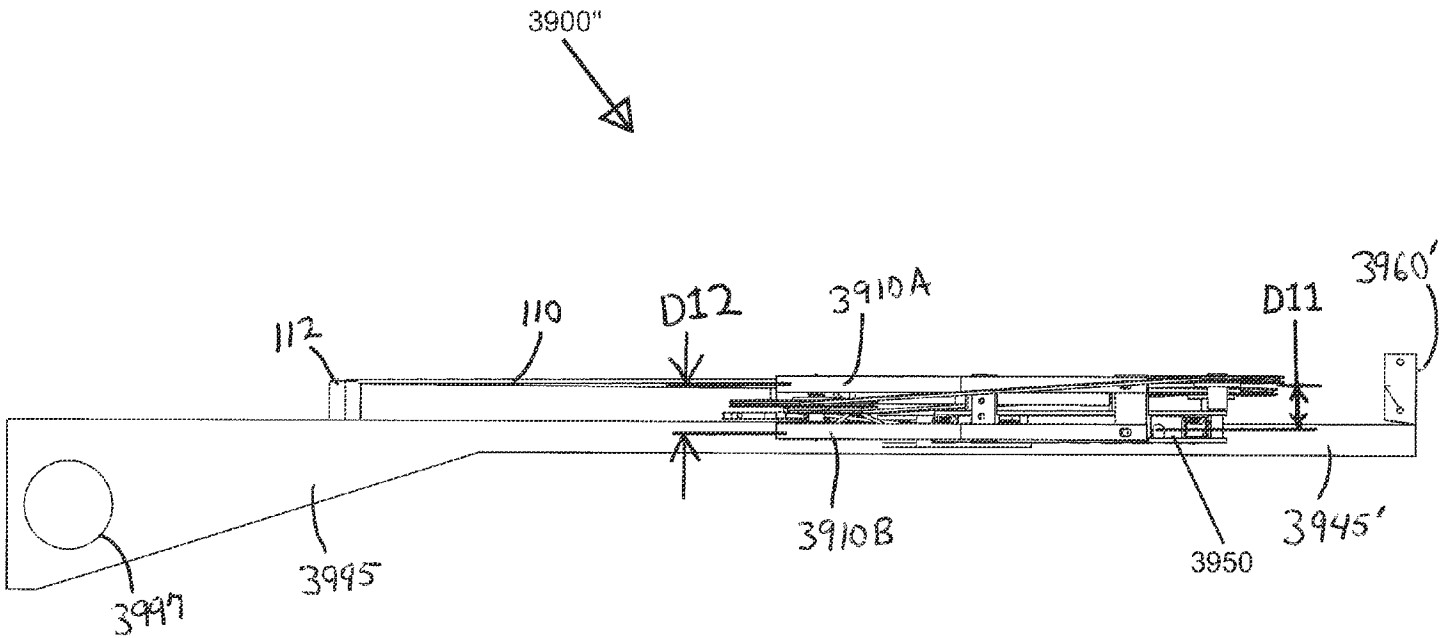
FIG. 50 is a slightly tilted side elevation view of the cross-bow of FIG. 46.

The risers 3920, 3921 of the frame 3902 of the compound bow 3900 and related embodiments are spaced from the bow string 110 of the compound bow 3900 and related embodiment by a distance D15 illustrated in a related embodiment at FIG. 48. In particular, the bow string 110 defines a plane when drawn that is generally parallel or somewhat parallel to a plane defined by inside surfaces 3926, 3928 of the risers 3920, 3921 (see FIGS. 37 and 42). The bow string 110 clears the risers 3920 and/or 3921 by the distance D15 when the bow string 110 is drawn past the risers 3920, 3921 as illustrated at FIG. 42. In certain embodiments, the distance D15 is in a range from about 1 inch to about 2 inches. In other embodiments, the distance D15 is in a range from about 0.5 inch to about 3 inches. In still other embodiments, the distance D15 can be other dimensions. By offsetting the bow string 110 from the risers 3920, 3921, the bow string 110 can be pulled past the risers 3920, 3921 as illustrated at FIG. 42. The configuration of bow 3900 allows the bow string 110 to pass by and clear the risers 3920, 3921. This configuration allows the bow string 110 to be drawn in either direction. In the example embodiment illustrated at FIGS. 37-39, the compound bow 3900 is configured to have the bow string 110 drawn away from the risers 3920, 3921 (drawn to the right in FIG. 37). In a related embodiment, further described below and illustrated at FIGS. 42-45, the compound bow 3900' is configured to have the bow string 110 drawn towards and past the risers 3920, 3921 (as shown in FIG. 42). In another related embodiment, further described below and illustrated at FIGS. 46-50, the compound bow 3900" is arranged as a cross-bow that is configured to have the bow string 110 drawn towards and past the risers 3920, 3921 (see, for example, FIG. 49).

The compound bow 3900', illustrated at FIGS. 42-45, is related to the compound bow 3900, illustrated at FIGS. 37-39 and described above. In describing the features and the operation of the compound bow 3900', the differences from the compound bow 3900 will be discussed in detail. As mentioned above, the bow string 110 of the compound bow 3900' is drawn in an opposite direction from the drawing direction of the bow string 110 of the compound bow 3900 and therefore passes by the risers 3920, 3921. Accordingly, the arrow rest 3960 and the handle 124 are repositioned so that the bow string 110 is drawn away from them as illustrated at FIG. 42. As shown at FIG. 37, the handle 124 and the arrow rest 3960 of the compound bow 3900 are positioned between the risers 3920, 3921 in some embodiments. In contrast, in other embodiments, as shown at FIG. 42, the handle 124 and the arrow rest 3960 of the compound bow 3900' are positioned forward of the riser 3921 and not necessarily between the risers 3920, 3921. A bracket 3945 can be used to secure the handle 124 and/or the arrow rest 3960 to the frame 3902. A mirror image of the quiver 3950 of the compound bow 3900 can be used as the quiver 3950 of the compound bow 3900'. Arrangements and relationships between other components of the compound bows 3900 and 3900' can be mirrored as well to form yet other embodiments. Compound bow 3900' also includes a bow string 110 that is guided by guide wheels 3934, 3936, and cams 3535 and 3537. However, this embodiments provides a longer draw stroke in some embodiments due to the forward position of draw string 110 when bow 3900' is in the undrawn position.

Figure 40:
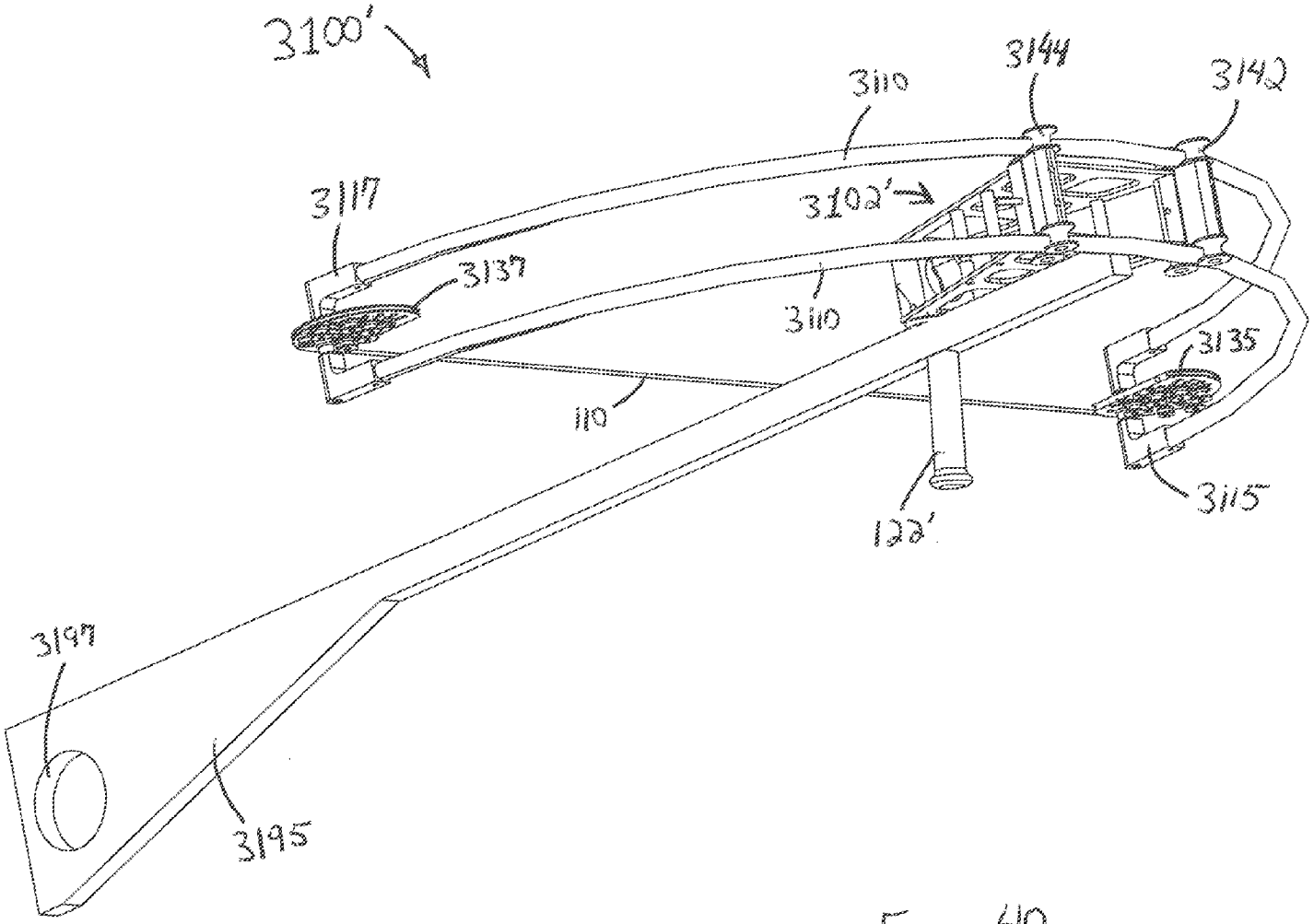
FIG. 40 is a perspective view of a modified configuration of the compound bow of FIG. 32 arranged as a cross-bow.
Figure 41:
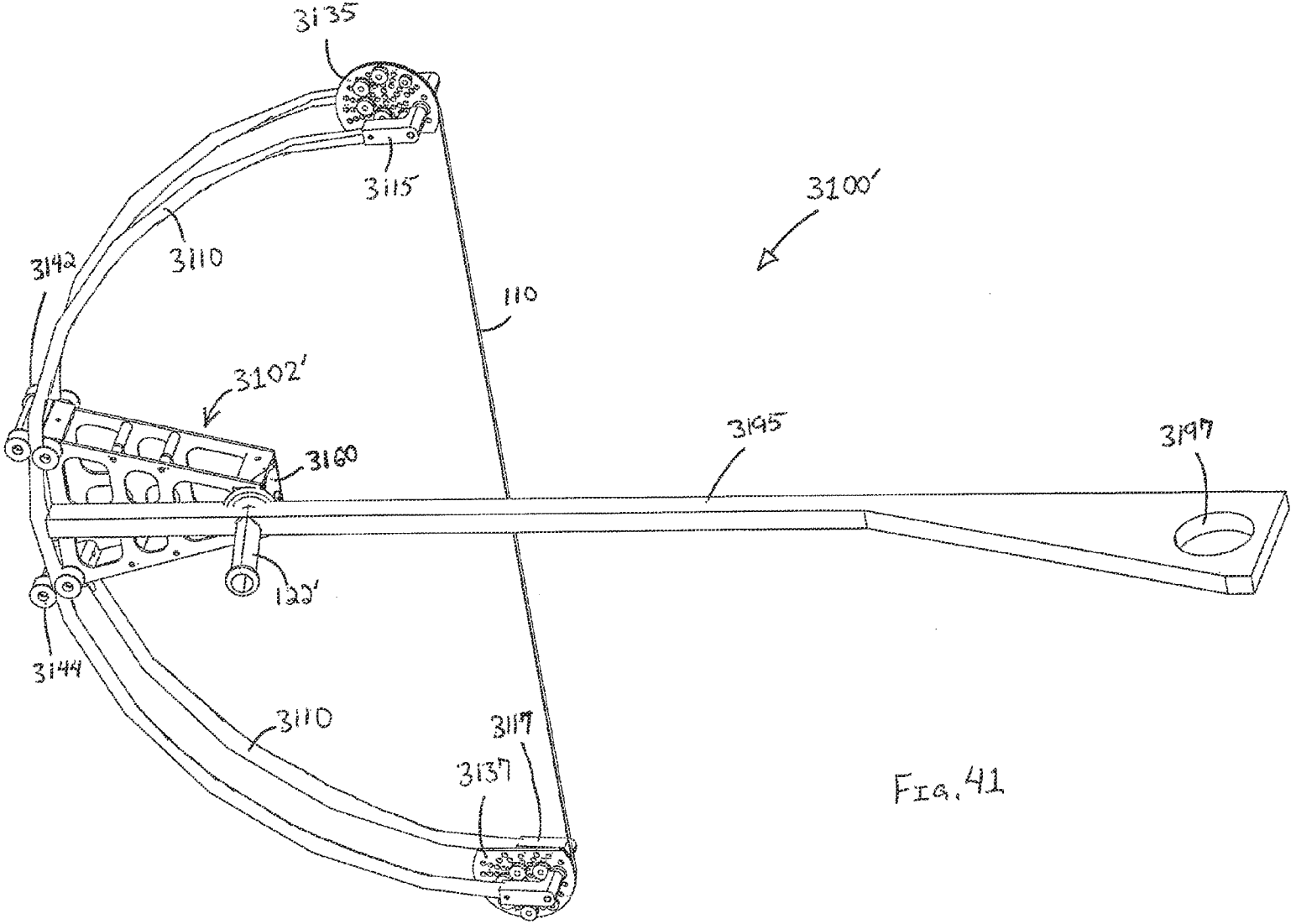
FIG. 41 is another perspective view of the cross-bow of FIG. 40.

As previously discussed, the various compound bows (e.g., 100, 1200, 1500, 1900, 2100, 2700, 3100, 3500, 3900, and 3900') of the present disclosure can be configured and/or arranged into a cross-bow configuration. FIGS. 40 and 41 illustrate a compound bow 3100' similar to compound bow 3100. Compound bow 3100' is arranged in a cross-bow configuration and hereinafter will be named cross-bow 3100'. Likewise, FIGS. 46-50 illustrate a compound bow 3900" similar to compound bows 3900 and 3900'. Compound bow 3900" is arranged in a cross-bow configuration and hereinafter will be referred to as cross-bow 3900". The other example compound bows (e.g., 100, 1200, 1500, 1900, 2100, 2700, and 3500) of the present disclosure can similarly be configured and/or arranged as cross-bows.

As shown at FIGS. 40 and 41, cross-bow 3100' includes many of the same or similar components as compound bow 3100. The same or similar components include bow string 110, tension members 3172 and 3174, flexible limbs 3110, eccentric cams 3135 and 3137, and clamps 3142, 3144. A frame 3102' is similar to frame 3102 of compound bow 3100 but has mounting provisions for the stock 3195 and can have an alternate mounting location for a handle 122'. Cross-bow 3100' can further include a let-off mechanism and a trigger mechanism that can hold the entire draw force of the bow string 110 when the bow string 110 is drawn. For example, a let-off mechanism 3980, illustrated at FIG. 46 on cross-bow 3900", can be implemented on cross-bow 3100'. The let-off mechanism (alternatively referred to as a bow string engagement device) is supported by the stock and configured to selectively engage the bow string, such as to hold the bow string in a drawn position. The trigger mechanism is coupled to the bow string engagement device to cause the bow string engagement device to release the bow string when the trigger is pulled. The tension members 3172, 3174 are hidden in FIGS. 40 and 41 but are routed as previously described for compound bow 3100.

As shown at FIGS. 46-50, cross-bow 3900" includes many of the same or similar components as compound bows 3900 and 3900'. The same or similar components include bow string 110; tension members 3972, 3974; flexible limbs 3910A, 3910B, 3912A, 3912B; eccentric cams 3531, 3533, 3535, 3537; fulcrums 3919; frame 3902; quiver 3950; and guide wheels 3934, 3936, 3938. The frame 3902 is mounted to the stock 3995 and can have an alternate mounting location for a handle. Cross-bow 3900" can further include a let-off mechanism 3980 and a trigger mechanism that can hold the entire draw force of the bow string 110 when the bow string 110 is drawn.

The bow string 110 of cross-bow 3900" is drawn past the risers 3920, 3921 (see FIG. 47), and thus the configuration is much like that of the compound bow 3900'. An arrow rest 3960' can be mounted to the stock 3995. An extension 3945' can position the arrow rest 3960' forward of the riser 3921 (see FIG. 47) just as the bracket 3945 positioned the arrow rest 3960 forward of the riser 3921 in compound bow 3900'. The extension 3945' can be part of the stock 3995 or can be a separate bracket. The let-off mechanism 3980 can be mounted to the stock 3995. The let-off mechanism 3980 is preferably positioned beyond and opposite side of the frame 3902 from the arrow rest 3960'. As in the compound bow 3900 and 3900', the cross bow 3900" include a quiver 3950 that can hold arrows within the perimeter of the frame 3902.

Certain embodiments of the present disclosure, including compound bows 2700, 3500, 3900 and 3900', are illustrated with guide wheels 2734, 2736, 3534, 3536, 3934, 3936 that are rotatably mounted at the center of the guide wheel 2734, 2736, 3534, 3536, 3934, 3936. This results in the arrow engaging portion of the bow string 110 being held by guide wheels 2734, 2736, 3534, 3536, 3934, 3936 that do not themselves cause the bow string's 110 route to fluctuate as the arrow is launched. The bow string 110 engaging perimeter of such guide wheels 2734, 2736, 3534, 3536, 3934, 3936 remains consistent as the arrow is launched. In contrast, cams and eccentrically mounted wheels adjacent the arrow engaging portion of the bow string 110 cause the bow string's 110 route to fluctuate as the arrow is launched and the bow string 110 engaging perimeter of the cam or eccentrically mounted wheel moves. Providing the consistent bow string 110 engaging perimeter adjacent the arrow engaging portion of the bow string 110 can improve accuracy and consistency of the arrow's launch. The substantially rigid frame 3902 of compound bow 3900 provides substantially rigid support for guide wheels 3934, 3936 further enhancing the accuracy and consistency of the arrow's launch.

Cams described herein typically are structures having a varying radius. Typically, a cord or cable is wrapped around the cam. A cam follower is not required by all embodiments that utilize a cam mechanism.

Some embodiments disclosed herein include a frame assembly. Some embodiments include a frame assembly including one or more of a riser, a frame, and a limb. For example, some embodiments include a frame assembly having a rigid frame. Some other embodiments include a frame assembly having a rigid frame and one or more rigid or flexible limbs. Yet other embodiments include a frame assembly including one or more risers. Further embodiments include a frame assembly having one or more risers and one or more cross-members. One or more additional support members are included in frame assemblies of some embodiments. One example of a frame assembly is shown in FIG. 37 and includes rigid frame 3902 and flexible limbs 3910 and 3912. Another example of a frame assembly is shown in FIG. 35 and includes rigid frame 3502 (including riser 3520) and flexible limbs 3510 and 3512. Another example of a frame assembly is shown in FIG. 3 and includes upper limb 200, riser 202, lower limb 204, and secondary riser 206. Yet another example of a frame assembly is shown in FIG. 32, and includes frame 3102 and flexible limbs 3110. Some embodiments include a stock as part of a frame assembly.

Some embodiments disclosed herein include one or more string guides. Some embodiments include a string guide selected from one or more of a guide wheel, a cam, a pulley, and any combination thereof. Yet other embodiments include other string guides that act to guide a bow string. In some embodiments a string guide is connected to the frame assembly. For example, the string guide is connected to one of a frame, a riser, and a limb. In some embodiments the connection is through another part or component. Other embodiments include string guides that are directly connected to the frame assembly.

Other embodiments of compound bows include other features and variations. For example, wheels described herein need not be round, but rather may include shapes having a non-constant radius. Further, in some embodiments, the axis of rotation of one or more wheels are offset from a center of the wheel. The offset axis of rotation can include angular and linear offsets. The axes of rotation of the various cams and wheels can be generally parallel with each other or the axes may not necessarily be parallel with each other. Similarly, cams may be either non-constant radius or constant radius, or combinations of the two in different portions of the cam. Many additional embodiments may be formed by intermixing various components of one embodiment with components of another embodiment.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A compound archery bow comprising:

a first continuous limb having a first end and a second end opposite the first end;

a second continuous limb having a third end and a fourth end opposite the third end;

a first rotatable member supported by the first end and the third end, and a second rotatable member supported by the second end and the fourth end;

a frame attached to the first continuous limb and the second continuous limb; and a drawstring extending between the first and second rotatable members.

2. The compound archery bow of claim 1, wherein the frame is attached to the first continuous limb via a clamp.

3. The compound archery bow of claim 1, wherein the first continuous limb is adjustable with respect to the frame.

4. The compound archery bow of claim 1 defining a region between a midportion of said first continuous limb and a midportion of said second continuous limb, a shooting axis of said bow extending through said region.

5. The compound archery bow of claim 1, wherein the frame comprises a handle.

6. The compound archery bow of claim 1, wherein the frame comprises an arrow rest.

7. The compound archery bow of claim 1, further comprising an axle extending between said first end and said third end, said first rotatable member supported by said axle.

8. The compound archery bow of claim 1, further comprising a first tension member cable extending from a first end of the first continuous limb.

9. The compound archery bow of claim 8, wherein the drawstring travels from a brace configuration to a drawn configuration, defining a drawstring plane along the path of travel.

10. The compound archery bow of claim 9, wherein the first tension member comprises a main portion which lies entirely outside the drawstring plane.

11. The compound archery bow of claim 10, wherein the first tension member cable further comprises a first branch portion having a first length and a second branch portion having a second length, the first length longer than the second length.

12. The compound archery bow of claim 9 further comprising a second tension member cable extending from a second end of the first continuous limb.

13. The compound archery bow of claim 12, wherein the second tension member comprises a main portion which lies entirely outside the drawstring plane.

14. The compound archery bow of claim 13, wherein the second tension member cable further comprises a third branch portion having a third length and a fourth branch portion having a fourth length, the third length longer than the fourth length.

15. A bow comprising:

a pair of elongate flexible limbs supported in a side-by-side arrangement and separated by a distance, each flexible limb being continuous from a first end to a second end and comprising a midpoint therebetween, wherein the bow is configured to propel an arrow along an arrow flight path extending through a region located between the midpoints.

16. The bow of claim 15, wherein the distance is at least 1.5 inches.

17. The bow of claim 15, wherein the pair of elongate flexible limbs are substantially parallel.

18. The bow of claim 15, wherein said distance is oriented substantially perpendicular to said arrow flight path.

* * * * *